US008235498B2

(12) United States Patent
Miyazawa et al.

(10) Patent No.: US 8,235,498 B2
(45) Date of Patent: Aug. 7, 2012

(54) HEAD REPAIRING APPARATUS AND FLUID EJECTING APPARATUS

(75) Inventors: Hisashi Miyazawa, Nagano (JP); Takato Hayashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 144 days.

(21) Appl. No.: 12/905,757

(22) Filed: Oct. 15, 2010

(65) Prior Publication Data

US 2011/0090281 A1 Apr. 21, 2011

(30) Foreign Application Priority Data

Oct. 20, 2009 (JP) ..... 2009-241754
Dec. 17, 2009 (JP) ..... 2009-286588

(51) Int. Cl.
*B41J 2/165* (2006.01)

(52) U.S. Cl. ..... 347/32

(58) Field of Classification Search ..... None
See application file for complete search history.

(56) References Cited

U.S. PATENT DOCUMENTS

2009/0051728 A1 2/2009 Miyazawa
2009/0051729 A1 2/2009 Miyazawa
2009/0051731 A1 2/2009 Miyazawa

FOREIGN PATENT DOCUMENTS

| | | | |
|---|---|---|---|
| JP | 2005-066852 | A | 3/2005 |
| JP | 2007-050602 | A | 3/2007 |
| JP | 2007-276304 | A | 10/2007 |
| JP | 2008-213463 | A | 9/2008 |
| JP | 2009-045-899 | A | 3/2009 |
| JP | 2009-045898 | A | 3/2009 |
| JP | 2009-045900 | A | 3/2009 |

*Primary Examiner* — Matthew Luu
*Assistant Examiner* — Alejandro Valencia
(74) *Attorney, Agent, or Firm* — Global IP Counselors, LLP

(57) ABSTRACT

A push latch cam is provided so as to be rotatable integrally with a intermittence gear, a cam driving gear for rotating a wiper support member cam rotates in connection with the rotation of the intermittence gear, and in a range in which the intermittence gear is engaged with a planetary gear, so that the intermittence gear can be rotated, a rotation range of the intermittence gear capable of opening and closing a atmosphere opening valve by the push latch mechanism and a rotation range of the intermittence gear in which the wiper is displaced by the rotation of the wiper support member cam are set in non-overlapped positions.

4 Claims, 33 Drawing Sheets

MAINTENANCE UNIT RISE
MAINTENANCE UNIT RISE
HEAD GUIDE DROP
MAINTENANCE UNIT DROP
MAINTENANCE UNIT DROP
HEAD GUIDE RISE
MAINTENANCE UNIT DROP
16
50
56, 57
426, 427
397, 398
424
39
40
55
425
395, 396
423
392
ZU
ZD

OPEN
CLOSE 956
943
942
944
953
935
957
941
954
934

E1
E1
E1

J
M
E1

L
L
OPEN
CLOSE

E2

E1

E2

HEAD REPAIRING APPARATUS AND FLUID EJECTING APPARATUS

CROSS REFERENCES TO RELATED APPLICATIONS

The entire disclosure of Japanese Patent Application Nos. 2009-241754, filed Oct. 20, 2009, 2009-286588, filed Dec. 17, 2009, are expressly incorporated by reference herein.

BACKGROUND

1. Technical Field

The present invention relates to a head repairing apparatus for repairing a liquid ejecting head of a liquid ejecting apparatus which ejects liquid from a liquid ejecting nozzle provided on a head surface of the liquid ejecting head to an ejection object.

2. Related Art

In a known ink jet printer as an example of a liquid ejecting apparatus, in order to always maintain a head surface of a recording head (a liquid ejecting head) in a favorable state, there is generally provided a head repairing apparatus for repairing the recording head between standby and recording implementation. As one of main functions of the head repairing apparatus, there is a function that seals the head surface of the recording head with a seal member during standby to prevent ink of an ink ejecting nozzle provided at the head surface from drying, thereby preventing a nozzle blockage or the like. Specifically, there is provided a mechanism which brings the seal member in close contact with the head surface of the recording head during standby to seal the head surface and separates the seal member from the head surface of the recording head during recording implementation.

In addition, as one of the main functions of the head repairing apparatus, there is a function that, in a state of sealing the head surface of the recording head with the seal member, generates a negative pressure at a closed space formed between the head surface of the recording head and the sealing surface of the seal member, thereby sucking the ink within the ink ejecting nozzle by the negative pressure. Specifically, there are provided a suction path that communicates with the sealing surface of the seal member, a pump capable of sucking the suction path, an atmosphere communication path that causes the sealing surface of the seal member to communicate with the atmosphere, a valve mechanism for opening and closing the atmosphere communication path or the like (see, for example, JP-A-2005-66852).

In the head repairing apparatus of this configuration, two types of suction motions can be performed according to objects. Two types of suction motions as described below can be selected by performing the suction motion in the state in which the atmosphere communication path is opened or performing the suction motion in the state in which the atmosphere communication path is closed.

One of them is a suction motion that seals the head surface of the recording head with the sealing surface of the seal member and operates the suction pump in the state of closing the atmosphere communication path (hereinafter, referred to as "main suction motion"). A main objective of performing the main suction motion is to forcibly discharge ink, an air bubble or the like from the ink ejecting nozzle. In the main suction motion, since the suction pump is operated in the state of closing the atmosphere communication path, it is possible to cause the suction force due to the negative pressure generated in the closed space formed between the head surface of the recording head and the sealing surface of the seal member to act in the ink ejection nozzle. As a result, it is possible to prevent an occurrence of dot missing or the like due to the blockage of the ink ejecting nozzle or the air bubble in the ink ejecting nozzle in advance.

The other of them is a suction motion that seals the head surface of the recording head with the sealing surface of the seal member and operates the suction pump in the state of opening the atmosphere communication path (hereinafter, referred to as "empty suction motion"). A main object of the empty suction motion is to suck the ink stored in the sealing surface of the seal member to deliver the ink to a waste water tank or the like. In the empty suction motion, since the suction pump is operated in the state of opening the atmosphere communication path, a suitable negative pressure is generated in the closed space formed between the head surface of the recording head and the sealing surface of the seal member, and the closed space enters the state in which the atmosphere can enter. As a result, the ink stored in the sealing surface of the seal member is delivered to the waste water tank or the like while being readily sucked by the suction force of the suction pump.

Furthermore, as one of the main functions of the head repairing apparatus, there is a function that wipes out and removes (hereinafter, referred to as "wiping") ink (liquid) and foreign matters such as a paper powder or dust (hereinafter, referred to as "affixed matter") which are attached to the head surface of the recording head. Specifically, a member (hereinafter, referred to as "wiper") formed of a material having elasticity for wiping the affixed matter is provided so as to be displaceable in a direction coming into contact with and separated from the head surface of the recording head. In order to perform the wiping, the wiper is moved to a position capable of coming into slide-contact with the head surface of the recording head in advance. In addition, the recording head is moved in a direction along the head surface of the recording head, thereby bringing the wiper into slide-contact with the head surface of the recording head. As a result, the affixed matter attached to the head surface of the recording head is wiped and removed by the wiper (see JP-A-2007-276304).

The head repairing apparatus has a configuration in which all of the driving of the suction pump, the open and closed of the atmosphere opening valve, the movement of the wiper or the like can be performed by the driving force of one motor. The head repairing apparatus of this configuration has an advantage in that the miniaturization and the low cost of the head repairing apparatus are possible.

However, the head repairing apparatus adopts a configuration in which the opening and closing of the atmosphere opening valve, the movement position of the wiper or the like is selected and maintained by a complicated shaped selection cam in which a plurality of cam surfaces (a non-selection cam surface, a suction cam surface, an empty suction cam surface, and a wiping cam surface) is formed with steps in a rotational axis direction. For this reason, it is possible to perform only a fixed pattern of maintenance operation that performs the wiping after going through the empty suction motion from the main suction motion. That is, for example, it is impossible to perform the maintenance operation by a flexible combination in which the wiping is performed without going through the main suction motion and the empty suction motion or the main suction motion and the empty suction motion are alternately repeated.

SUMMARY

An advantage of some aspects of the invention is to realize a head repairing apparatus which has a configuration, in which all of the driving of the suction pump, the opening and closing of the atmosphere opening valve, and the movement of the wiper can be performed by the driving force of one driving force source, and can flexibly select the main suction motion, the empty suction motion, the wiping and the combination thereof to perform the maintenance operation.

According to an aspect of the invention, there is provided head repairing apparatus for repairing a liquid ejecting head of a liquid ejecting apparatus which ejects liquid from a liquid ejecting nozzle provided on a head surface of the liquid ejecting head to a ejection object, including one or two more maintenance units which are supported by an apparatus base body so as to be displaceable in a predetermined displacement direction becoming a direction intersecting the head surface of the liquid ejecting head, wherein the maintenance unit has a unit base portion that is supported by the apparatus base body so as to be displaceable in the displacement direction; a seal member capable of sealing the head surface of the liquid ejecting head; a suction pump capable of sucking a suction path that communicates with the sealing surface of the seal member; an atmosphere communication path in which one side thereof communicates with the sealing surface of the seal member and the other side thereof is opened to the outside atmosphere; an atmosphere opening valve capable of opening and closing the atmosphere communication path; a push latch mechanism for performing the opening and closing operation of the atmosphere opening valve; a push latch cam which is engaged with an operation portion of the push latch mechanism and can perform a pushing movement operation of the operation portion; a wiper support member which is supported by the unit base portion so as to be displaceable in the displacement direction; a wiper attached to the wiper support member; a wiper support member cam which is engaged with the wiper support member to displace the wiper support member in the displacement direction; and a driving force transmission mechanism for transmitting the driving force of a driving force source. The driving force transmission mechanism includes a pump driving force transmission mechanism which transmits the driving force of the driving force source to the suction pump; a sun gear to which the driving force of the driving force source is transmitted so as to be rotated; a rolling arm in which a rolling range thereof is limited to a certain range and which is pivotally supported on a rotation axis of the sun gear; a planetary gear which is rotatably supported by the rolling arm and is engaged with the sun gear; and an intermittence gear which is engaged with the planetary gear in a range in which teeth are formed. The push latch cam is provided so as to be rotatable integrally with the intermittence gear, a cam driving gear for rotating the wiper support member cam rotates in connection with the rotation of the intermittence gear, and in a range in which the intermittence gear is engaged with the planetary gear, so that the intermittence gear can be rotated, a rotation range of the intermittence gear capable of opening and closing the atmosphere opening valve by the push latch mechanism and a rotation range of the intermittence gear in which the wiper is displaced by the rotation of the wiper support member cam are set in non-overlapped positions.

In the state in which the intermittence gear is engaged with the planetary gear in the range in which the teeth are formed, the rotation of the sun gear is transmitted to the intermittence gear via the planetary gear, so that the intermittence gear is rotated. In addition, when the intermittence gear is rotated up to a position where a portion without the teeth reaches the planetary gear, the planetary gear enters an idling state. Thus, even if the sun gear is rotated by the driving force of the driving force source, the intermittence gear enters the non-rotation state. From this state, when reversing the rotation direction of the sun gear, a planetary lever rolls in a rotation direction after the reverse in a certain rolling range, whereby the planetary gear is engaged with the portion formed with the teeth of the intermittence gear again. As a result, the rotation of the sun gear is transmitted to the intermittence gear via the planetary gear, so that the intermittence gear enters the rotation state.

In a rotation range (hereinafter, referred to as "rotation range capable of opening and closing the atmosphere opening valve") of the intermittence gear capable of opening and closing the atmosphere opening valve by the push latch mechanism, the open and closed state of the atmosphere opening valve can be alternately switched by the push operation of the operation portion of the push latch mechanism. Moreover, the open and closed state of the atmosphere opening valve is maintained by the push latch mechanism. On the other hand, the suction pump is transmitted with the driving force of the driving force source by the pump driving force transmission mechanism and is operated. That is, while the driving force source is operated, so that the driving force is generated, the suction pump is continuously operated. Thus, in the state in which the planetary gear idles, it is possible to operate the suction pump while maintaining the open and closed state of the atmosphere opening valve.

That is, in the state of closing the atmosphere opening valve, when the planetary gear continues to idle, thereby operating the suction pump, the main suction motion can be performed. Furthermore, when the rotation direction of the sun gear is reversed from that state to rotate the intermittence gear to a rotation range capable of opening and closing the atmosphere opening valve, the operation portion of the push latch mechanism is pushed and the atmosphere opening valve enters the opened state. In addition, when the rotation direction of the sun gear is reversed from that state (the state of opening the atmosphere opening valve) again, so that the planetary gear continues to idle to operate the suction pump, the empty suction motion can be performed. Thus, for example, when repeating an operation in which, from the state in which the planetary gear idles, the rotation direction of the sun gear is reversed to rotate the intermittence gear up to the rotation range capable of opening and closing the atmosphere opening valve, and then the rotation direction of the sun gear is reversed again to make the planetary gear the idling state again, a state capable of performing the main suction motion and a state capable of performing the empty suction motion can be alternately switched. That is, it is possible to alternately and repeatedly perform the main suction motion and the empty suction motion.

In addition, in a rotation range (hereinafter, referred to as "rotation range in which the wiper is displaced") of the intermittence gear in which the wiper is displaced by the rotation of the wiper support member cam, it is possible to displace the wiper in a direction intersecting the head surface of the liquid ejecting head. The rotation range in which the wiper is displaced is set at a position where it is not overlapped with the rotation range capable of opening and closing the atmosphere opening valve. Furthermore, the open and closed state of the atmosphere opening valve is maintained by the push latch mechanism. Thus, when rotating the sun gear so that the intermittence gear is rotated in the rotation range in which the wiper is displaced, the wiping by the wiper can be performed at any time, which makes it possible to perform the wiping, for example, without going through the main suction motion and the empty suction motion.

As a result, it is possible to obtain a working effect capable of realizing a head repairing apparatus which has a configuration, in which all of the driving of the suction pump, the opening and closing of the atmosphere opening valve, and the movement of the wiper can be performed by the driving force of one driving force source, and can flexibly select the main suction motion, the empty suction motion, the wiping and the combination thereof to implement the maintenance motion.

According to an aspect of the invention, the maintenance unit has a reset mechanism capable of resetting a latch of the push latch mechanism, and a reset cam which is provided so as to be rotatable integrally with the intermittence gear and is engaged with the operation portion of the reset mechanism. The rotation range of the intermittence gear, in which the latch of the push latch mechanism is reset by the reset cam, is set in a position where it is not overlapped with any one of a rotation range of the intermittence gear in which the atmosphere opening valve can be opened and closed by the push latch mechanism and a rotation range of the intermittence gear in which the wiper is displaced by the rotation of the wiper support member cam, within a range in which the intermittence gear is engaged with the planetary gear and the intermittence gear can rotate.

The open and closed state of the atmosphere opening valve maintained by the push latch mechanism is configured so that the opened state and the closed state are alternately witched whenever the push latch mechanism is operated. Thus, for example, if the operation number or the like of the push latch mechanism is stored in a memory or the like of a control circuit of the head repairing apparatus, the open and closed state of the atmosphere opening valve can be accurately specified. However, for example, when information stored in the memory is lost due to a power failure or the like, after the power source recovery, the open and closed state of the atmosphere opening valve becomes indefinite.

Furthermore, for example, if a sensor capable of detecting the open and closed state of the atmosphere opening valve is provided in advance, it is possible to accurately specify the open and closed state of the atmosphere opening valve at every case, without the need to store the operation number or the like of the push latch mechanism in the memory or the like of the control circuit of the head repairing apparatus. However, if the sensor capable of detecting the open and closed state of the atmosphere opening valve is provided, the cost of the head repairing apparatus increases accordingly.

The head repairing apparatus according to an aspect of the invention has a reset mechanism capable of resetting the latch of the push latch mechanism. That is, by operating the reset mechanism, the open and closed state of the atmosphere opening valve can be forcibly transformed to an already decided state. As a result, it is possible to accurately specify the open and closed state of the atmosphere opening valve at every case, without providing a sensor capable of detecting the open and closed state of the atmosphere opening valve.

According to an aspect of the invention, the maintenance unit has a guide member which is supported by the unit base portion so as to be displaceable in the displacement direction and regulates a relative positional relationship between the liquid ejecting head and the seal member in a direction along the head surface of the liquid ejecting head, in a state of being engaged with the liquid ejecting head; and a guide member cam which is engaged with the guide member to displace the guide member in the displacement direction. The driving force transmission mechanism is configured so that the cam driving gear rotates the guide member cam, and the rotation range of the intermittence gear in which the guide member is displaced by the rotation of the guide member cam is set at a position where it is not overlapped with one of a rotation range of the intermittence gear in which the atmosphere opening valve can be opened and closed by the push latch mechanism, a rotation range of the intermittence gear in which the wiper is displaced by the rotation of the wiper support member cam, and a rotation range of the intermittence gear in which the latch of the push latch mechanism can be reset by the reset mechanism, in a range in which the intermittence gear is engaged with the planetary gear, so that the intermittence gear can rotate.

According to the aspect of the invention, it is possible to further accurately perform the positioning when the sealing surface is brought into close contact with the head surface of the liquid ejecting head.

Furthermore, since the guide member, which is provided separately from the seal member, has a configuration that can be independently displaced, only the guide member can be displaced in the displacement direction, while maintaining a relative gap between the head surface of the liquid ejecting head and the sealing surface of the seal member. As a result, when performing a motion (hereinafter, referred to as "flushing") that periodically leaves liquid on the sealing surface of the seal member during implementation of the liquid ejection relative to the ejection object, in a state in which the gap between the head surface of the liquid ejecting head and the sealing surface of the seal member is maintained at a gap suitable for the flushing, the guide member can be retreated in a range in which the movement of the liquid ejecting head or the transportation of the ejection object is not hindered. Thus, there is no need to move the maintenance unit back and forth in the displacement direction each flushing instance, whereby the time necessary for the flushing is not unnecessarily lengthened. In addition, since the gap between the head surface of the liquid ejecting head and the sealing surface of the seal member can be maintained suitably for the flushing to perform the flushing, an amount of the mist generated during flushing can be reduced.

As a result, in addition to the above-mentioned working effect, in a head repairing apparatus of a configuration that can regulate the relative positional relationship between the liquid ejecting head and the seal member in a direction along the head surface of the liquid ejecting head, it is possible to obtain a working effect that can reduce the amount of the mist generated during flushing without lowering the throughput of the liquid ejecting apparatus.

According to the aspect of the invention, the liquid ejecting apparatus for ejecting liquid from the liquid ejecting nozzle provided on the head surface of the liquid ejecting head to the ejection object may include the above-mentioned head repairing apparatus.

According to the aspect of the invention, in the liquid ejecting apparatus for ejecting liquid from the liquid ejecting nozzle provided on the head surface of the liquid ejecting head to the ejection object, the above-mentioned effect can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described based on the drawings.

Configuration of Ink Jet Printer 1

Firstly, a configuration of an ink jet printer 1 as "a liquid ejecting apparatus" will be described.

Figure 1:
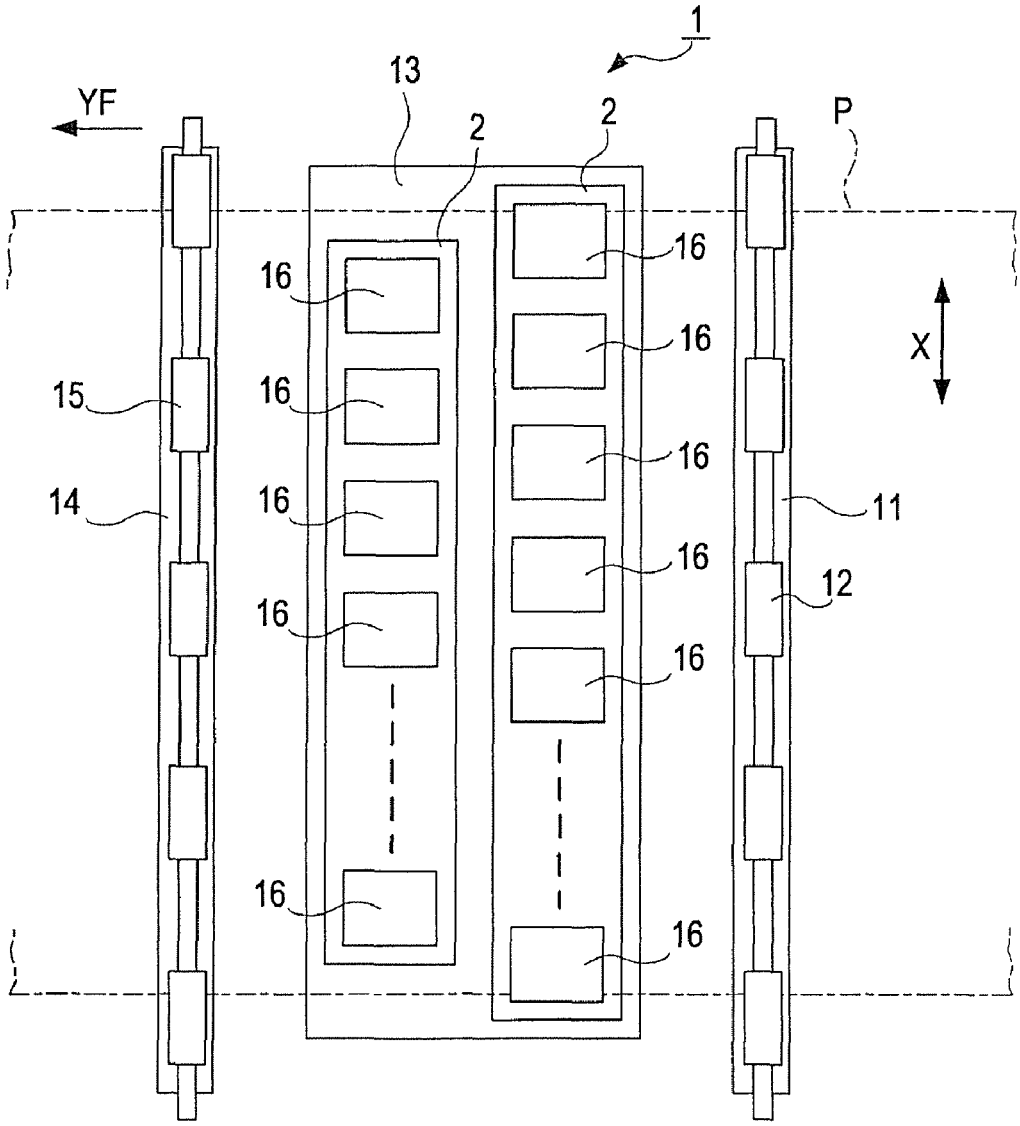
FIG. 1 is a plan view of the principal parts of an ink jet printer.
Figure 2:
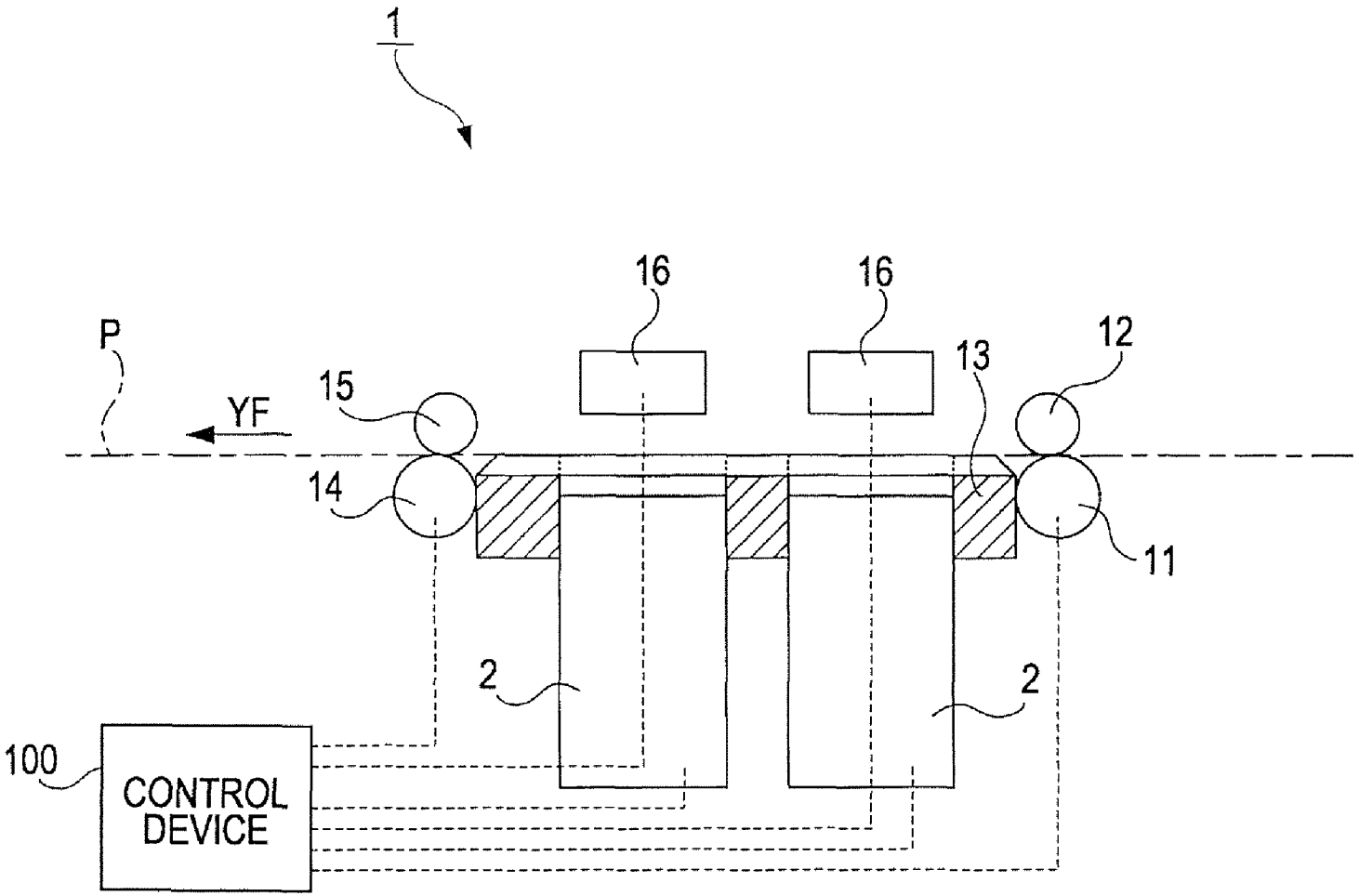
FIG. 2 is a side view of the principal parts of an ink jet printer.

FIG. 1 is a plan view of the principal part of the ink jet printer 1, and FIG. 2 is a side view of the principal part thereof.

The ink jet printer 1 according to an aspect of the invention is a so-called line head type ink jet printer in the present embodiment. The ink jet printer 1 includes a transport driving roller 11, a transport driven roller 12, a recording paper support member 13, a discharge driving roller 14, a discharge driven roller 15, and a plurality of recording heads 16 as units for implementing the recording to a recording paper P as an "ejection object".

The transport driving roller 11 is provided with a high frictional film at an outer peripheral surface and the rotational driving force of a transport motor (not shown) is transmitted thereto, whereby the transport driving roller 11 is rotated. The transport driven roller 12 is pivotally supported in such a manner that it can be driven and rotated in the state of being pressed in a direction coming into contact with the transport driving roller 11. The recording paper support member 13 supports the recording paper P from the rear surface side thereof. A gap between a head surface of the recording heads 16 and a recording surface of the recording paper P (a surface to be recorded, hereinafter, it is identical) is maintained at a certain gap by the recording paper support member 13. The rotational driving force of a transport motor (not shown) is transmitted to the discharge driving roller 14, so that the discharge driving roller 14 is rotated. The discharge driven roller 15 is pivotally supported in such a manner that it can be driven and rotated, and is pressed in a direction coming into contact with the discharge driving roller 14.

A plurality of recording heads 16 as "liquid ejecting heads" are provided so that head rows disposed in a width direction X (a direction intersecting a transport direction YF) at regular intervals are provided in the transport direction YF in two rows. Each recording heads 16 of the head row provided at the downstream side of the transport direction YF is provided at a position corresponding to the portion between the respective recording heads 16 of the head row provided at the upstream side of the transport direction YF. The plurality of recording heads 16 is provided so that the head surface faces the recording surface of the recording paper P in the state of being supported by the recording paper support member 13. At the head surface of the recording heads 16, a plurality of ink ejecting nozzles (liquid ejecting nozzles) for ejecting ink (liquid) to the recording surface of the recording paper P to from the dot is disposed (not shown).

The recording paper P is pinched by the transport driving roller 11 and the transport driven roller 12 and is transported on the recording paper support member 13 in the transport direction YF by the driving rotation of the transport driving roller 11. The recording paper P on the recording paper support member 13 is transported at a predetermined transport amount in the transport direction YF by the driving rotation of the transport driving roller 11, while ink is ejected from the head surface of the plurality of recording heads 16, whereby dots are formed on the recording surface. As a result, the recording is performed on the recording surface of the recording paper P. In addition, the recording paper P, in which the recording is implemented on the recording surface, is pinched by the discharge driving roller 14 and the discharge driven roller 15, is transported in the transport direction YF by the driving rotation of the discharge driving roller 14, and is discharged from the ink jet printer 1. The series of recording control is implemented by a control apparatus 100 having a known micro computer control circuit.

In addition, the ink jet printer 1 includes head repairing apparatuses 2 for repairing the plurality of recording heads 16 for each head row. The head repairing apparatuses 2 are disposed at a position corresponding to the head row of the recording head 16 and are provided so that they can come into contact with and can be separated from the recording heads 16 via through holes provided at the recording paper support member 13. The control of the head repairing apparatuses 2 is carried out by the control apparatus 100.

Configuration of Head Repairing Apparatus 2

A configuration of the head repairing apparatus 2 will be described with reference to FIGS. 3 and 4.

Figure 3:
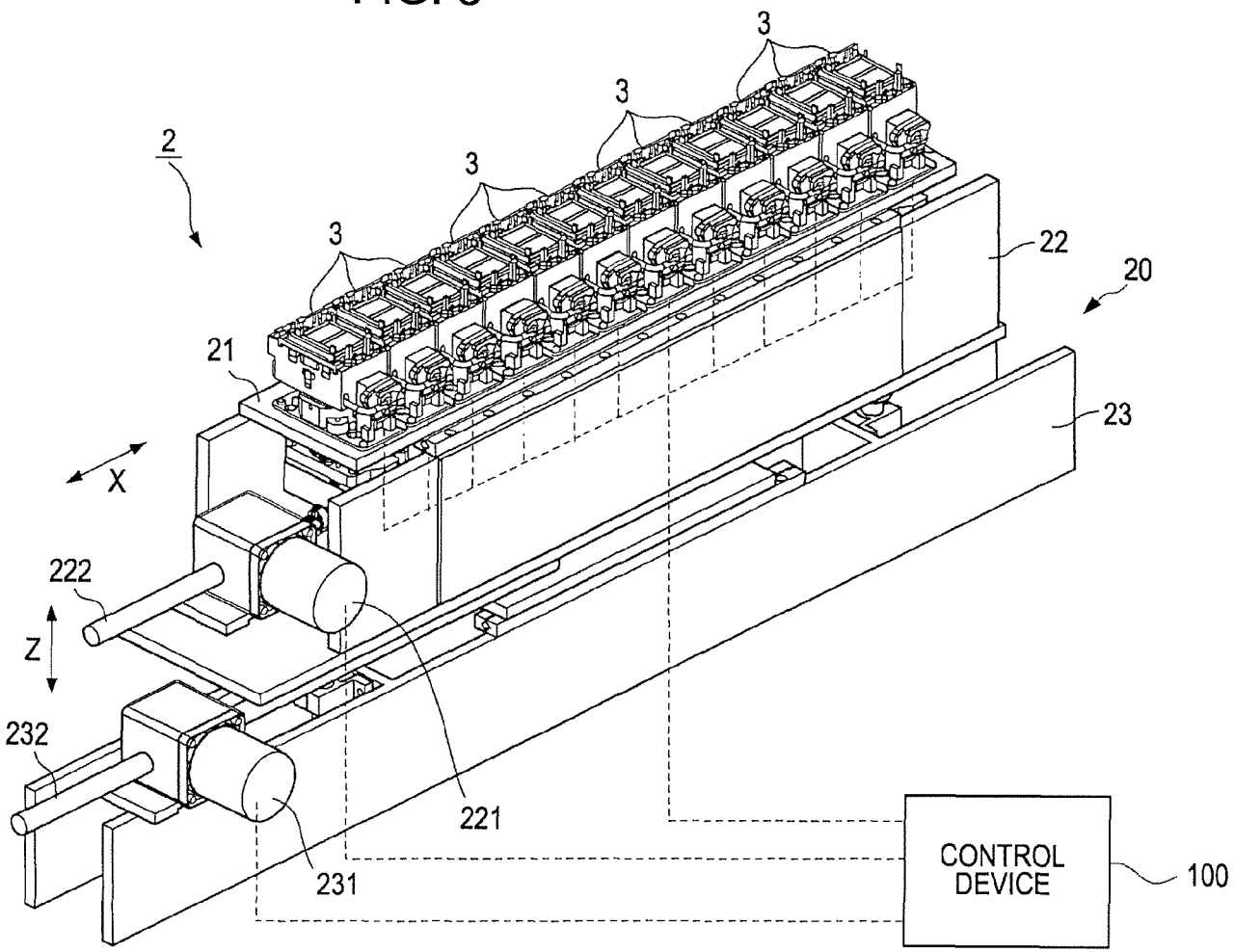
FIG. 3 is a perspective view of a head repairing apparatus.
Figure 4:
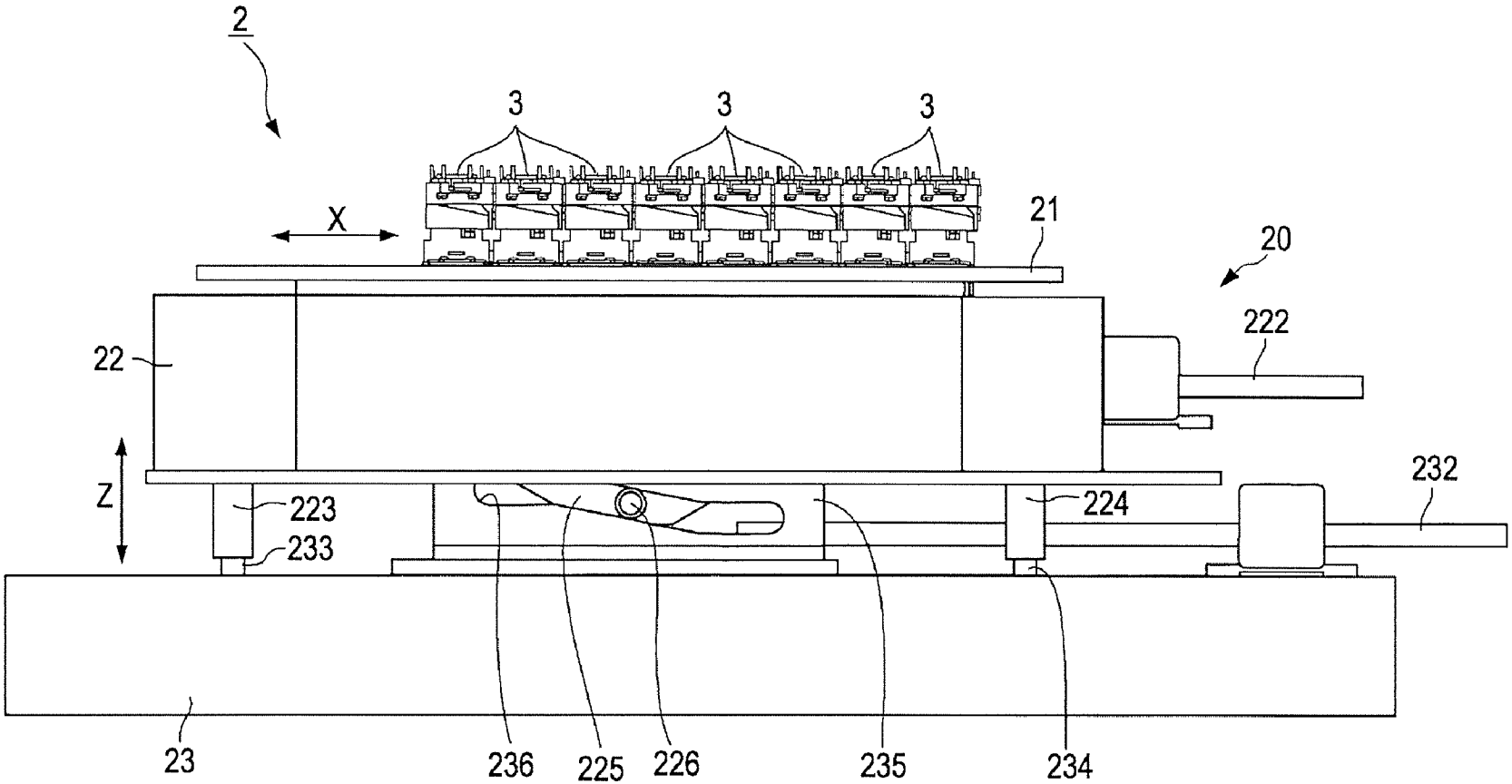
FIG. 4 is a front view of a head repairing apparatus.

FIG. 3 is a perspective view of the head repairing apparatus 2, and FIG. 4 is a front view thereof.

The head repairing apparatus 2 includes an apparatus main body 20 and a plurality of maintenance units 3. The apparatus base body 20 includes a pedestal 21, a slide apparatus 22 and a lift apparatus 23.

A plurality of maintenance units 3 is provided in the pedestal 21 in an array individually corresponding to the plurality of recording heads 16, and the pedestal 21 is supported by the slide apparatus 22 slidably in a direction shown by reference numeral X. The direction shown by reference numeral X is the same as the width direction X (hereinafter, referred to as "X direction"). By rotating a slide motor 221 of the slide apparatus 22, a slide shaft 222 is slid in the X direction, whereby the pedestal 21 is displaced in the X direction. That is, the slide apparatus 22 is an apparatus that displaces the maintenance unit 3 in the X direction with respect to the recording heads 16. The rotation control of the slide motor 221 is carried out by the control apparatus 100.

Furthermore, the slide apparatus 22 is supported by the lift apparatus 23 in such a manner that it can be lifted up and down in the direction shown by reference numeral Z in the state in which support shafts 233 and 234 provided at the upper part of the lift apparatus 23 are inserted into cylindrical bearing portions 223 and 224 provided at the bottom part. The direction shown by reference numeral Z is a direction intersecting the head surface of the recording heads 16 (hereinafter, referred to as "Z direction"). A cam engagement portion 225 is provided integrally at the bottom part of the slide apparatus 22. A lift cam portion 235 is supported by a lift apparatus 23 so as to be slidable in the X direction. A convex portion 226 provided at the cam engagement portion 225 is engaged with a cam hole 236 of the lift cam portion 235. By rotating the lift motor 231, the slide shaft 232 is slid in the X direction, whereby the lift cam portion 235 is slid in the X direction. As a result, the slide apparatus 22 is displaced in the Z direction depending on the shape of the cam hole 236 of the slid cam portion 235, so that the pedestal 21 is lifted up and down in the Z direction. That is, the lift apparatus 23 is an apparatus that displaces the maintenance apparatus 3 in the Z direction with respect to the recording heads 16. The rotation control of the lift motor 231 is carried out by the control apparatus 100.

Configuration of Maintenance Unit 3

A configuration of the maintenance unit 3 will be described with reference to FIG. 5.

Figure 5:
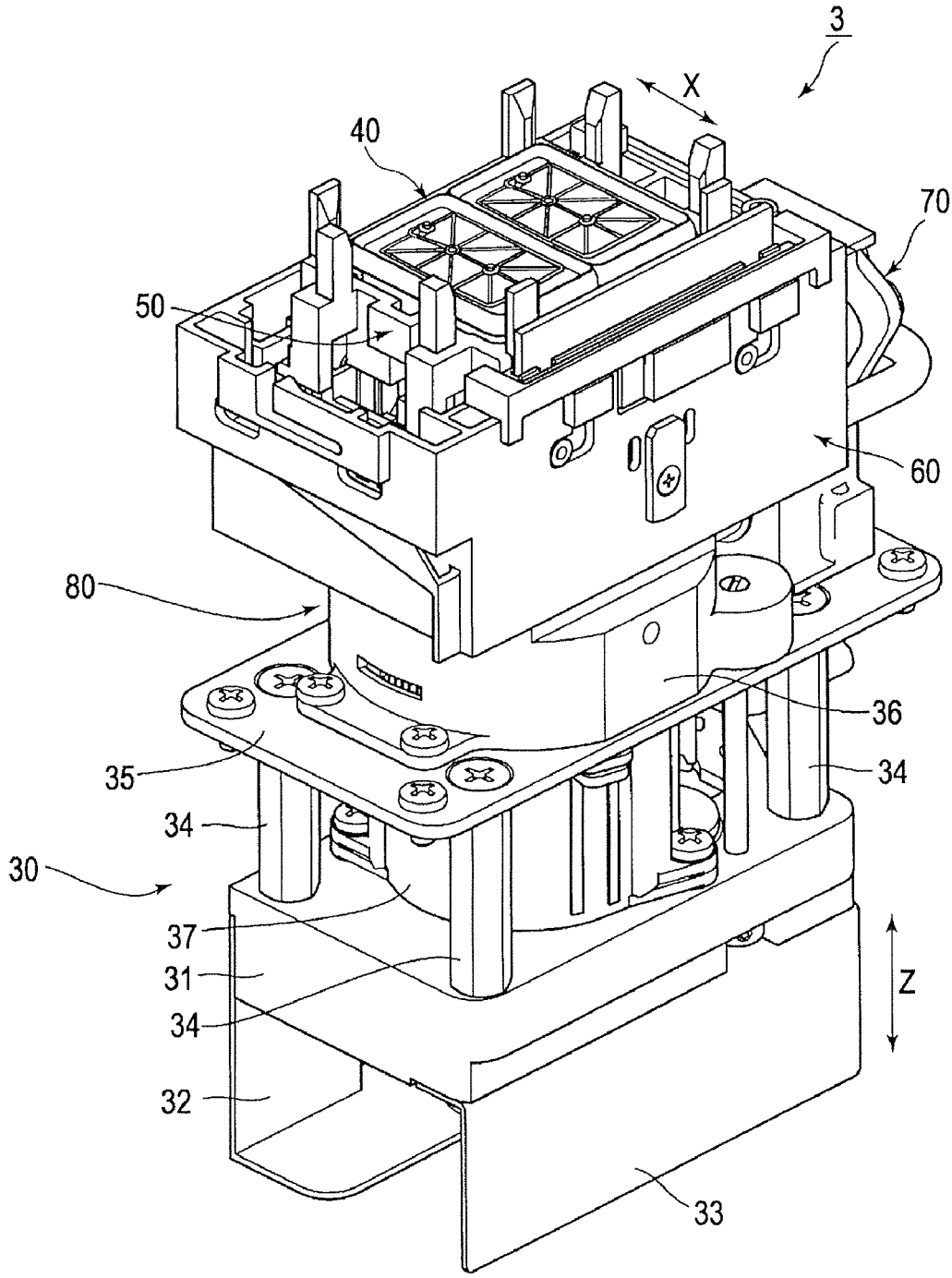
FIG. 5 is an overall perspective view of a maintenance unit.

FIG. 5 is an overall perspective view of the maintenance unit 3.

The maintenance unit 3 includes a unit base portion 30, a cap 40, a head guide 50, a wiper unit 60, an atmosphere opening valve unit 70 and a driving force transmission mechanism 80. Hereinafter, the detailed configurations will be sequentially described.

Configuration of Unit Base Portion 30

A configuration of the unit base portion 30 will be described with reference to FIGS. 5 and 6.

Figure 6:
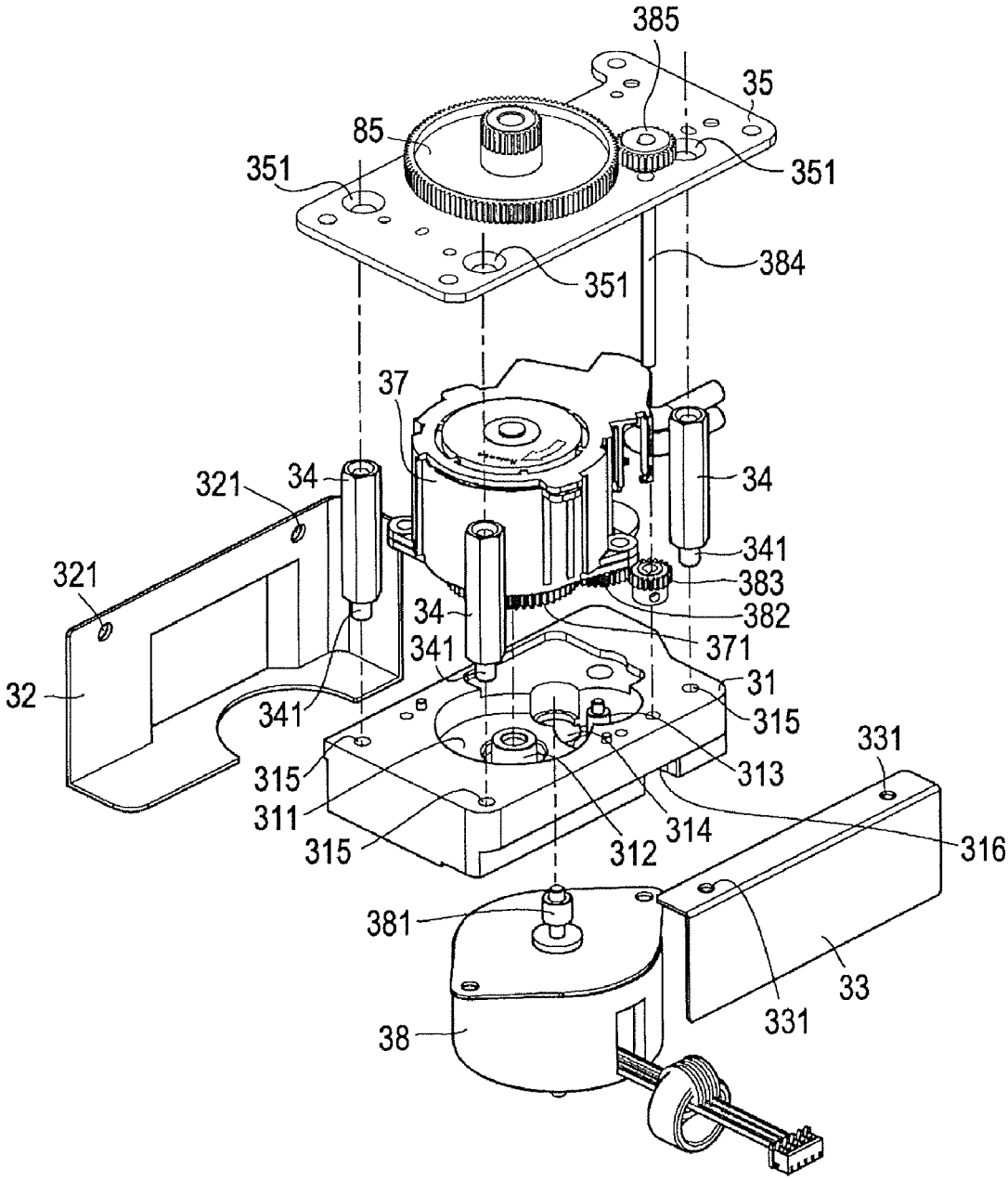
FIG. 6 is an exploded perspective view of a unit base portion.

FIG. 6 is an exploded perspective view of the unit base portion 30.

The unit base portion 30 is provided on the pedestal 21 of the head repairing apparatus 2. That is, the unit base portion 30 is supported by the apparatus base body 20 so as to be displaceable in the X direction and the Z direction. The unit base portion 30 has a pedestal 31, a left side frame 32, a right side frame 33, a pillar 34, a support plate 35, a cover member 36, a suction pump 37, a maintenance unit motor 38 and a base member 39 (the base member 39 will be described based on FIGS. 7 to 10A and 10B).

The pedestal 31 is a member becoming a foundation of the unit base portion 30. On the surface of the pedestal 31, a concave portion 311 and three female screw holes 315 are formed. In the concave portion 311, a cylindrical portion 312, a gear shaft portion 313, and a through hole 314 are formed. The left side frame 32 and the right side frame 33 are members that form installation spaces of the maintenance unit motor 38. The left side frame 32 is fixed by the screw to the left side surface of the pedestal 31 via the through hole 321. The right side frame 33 is fixed by the screw to the right side surface of the pedestal 31 via the through hole 331.

The pillar 34 has a male screw formed at one end side and a female screw formed at the other end side. Three pillars 34 stand up on the surface of the pedestal 31 in the state in which the male screw of one end side is screwed into the female screw hole 315 of the pedestal 31. The support plate 35 is a member for fixing the maintenance unit 3 to the pedestal 21 by the screw and is a member that supports an atmosphere opening valve 70 and a driving force transmission mechanism 80 as described later. The support member 35 is supported by the other end sides of three pillars 34, and is supported in the state in which a male screw (not shown) is screwed into the female screw of the other end side of the pillar 34 via the through hole 351. The cover member 36 is a member that is fixed by the screw to the support plate 35 and has a driving force transmission mechanism 80 described later accommodated therein.

The suction pump 37 is fixed by the screw to the surface of the pedestal 31. A pump gear 371 engaged with the driving shaft in the suction pump 37 is disposed in the concave portion 311 of the pedestal 31 in the state of being pivotally supported by the cylindrical portion 312. The suction pump 37 is for sucking a suction path communicating with a cap 40 described later and is operated by the transmission of the rotation of the maintenance unit motor 38 to the pump gear 371. When the maintenance unit motor 38 is rotated forwardly and is driven, the known suction pump 37 performs the suction motion generating the negative pressure, and when the maintenance unit motor 38 is rotated backwardly and is driven, the suction pump enters the release state and does not generate the negative pressure. More specifically, the suction pump 37 is a known tube pump, and is configured so that, in the suction motion thereof, a tube wound around a built-in wheel is pulled in one direction, so that gas or liquid in the tube is pushed out, whereby the suction force is generated at one end side of the tube (not shown). Furthermore, in the engagement portion of the driving shaft of the inner part of the suction pump 37 and the pump gear 371, a delay mechanism (not shown) is provided, so that, when the rotation direction of the pump gear 371 is completely switched from the reverse rotation to the forward rotation, the delay is generated in the rotation transmission by the rotation amount of less than one rotation.

The maintenance unit motor 38 is a known electric motor, and the rotation thereof is controlled by the control apparatus 100. The maintenance unit motor 38 is fixed by the screw to the bottom surface of the pedestal 31 in the state in which the driving gear 381 provided in the rotation shaft protrudes into the concave portion 311 of the pedestal 31 via the through hole 314 of the pedestal 31. The driving gear 381 is engaged with the pump gear 371 in the concave portion 311 of the pedestal 31. That is, the rotation of the maintenance unit motor 38 is transmitted from the driving gear 381 to the suction pump 37 via the pump gear 371 (pump driving force transmission mechanism).

A gear 382 is pivotally supported in the gear shaft portion 313 provided in the concave portion 311 of the pedestal 31. The gear 382 is engaged with the driving gear 381 of the maintenance unit motor 38, in the concave portion 311 of the pedestal 31. The rotation transmission shaft 384 is pivotally supported in the pedestal 31 and the support plate 35. A gear 383 provided integrally at one end side of the rotation transmission shaft 384 is disposed in a concave portion 316 formed in the bottom surface of the pedestal 31. The concave portion 316 communicates with the concave portion 311 of the upper surface side, and the gear 383 is engaged with the gear 382. A gear 385 provided integrally at the other end side of the rotation transmission shaft 384 is engaged with the sun gear 85 forming a part of a driving force transmission mechanism 80 described later. That is, the rotation of the maintenance unit motor 38 is transmitted from the driving gear 381 to the driving force transmission mechanism 80 via the gear 382, the gear 383, the rotation transmission shaft 384 and the gear 385.

Configuration of Cap 40 and Head Guide 50

Configurations of the cap 40 and the head guide 50 will be described with reference to FIGS. 7 to 12.

Figure 7:
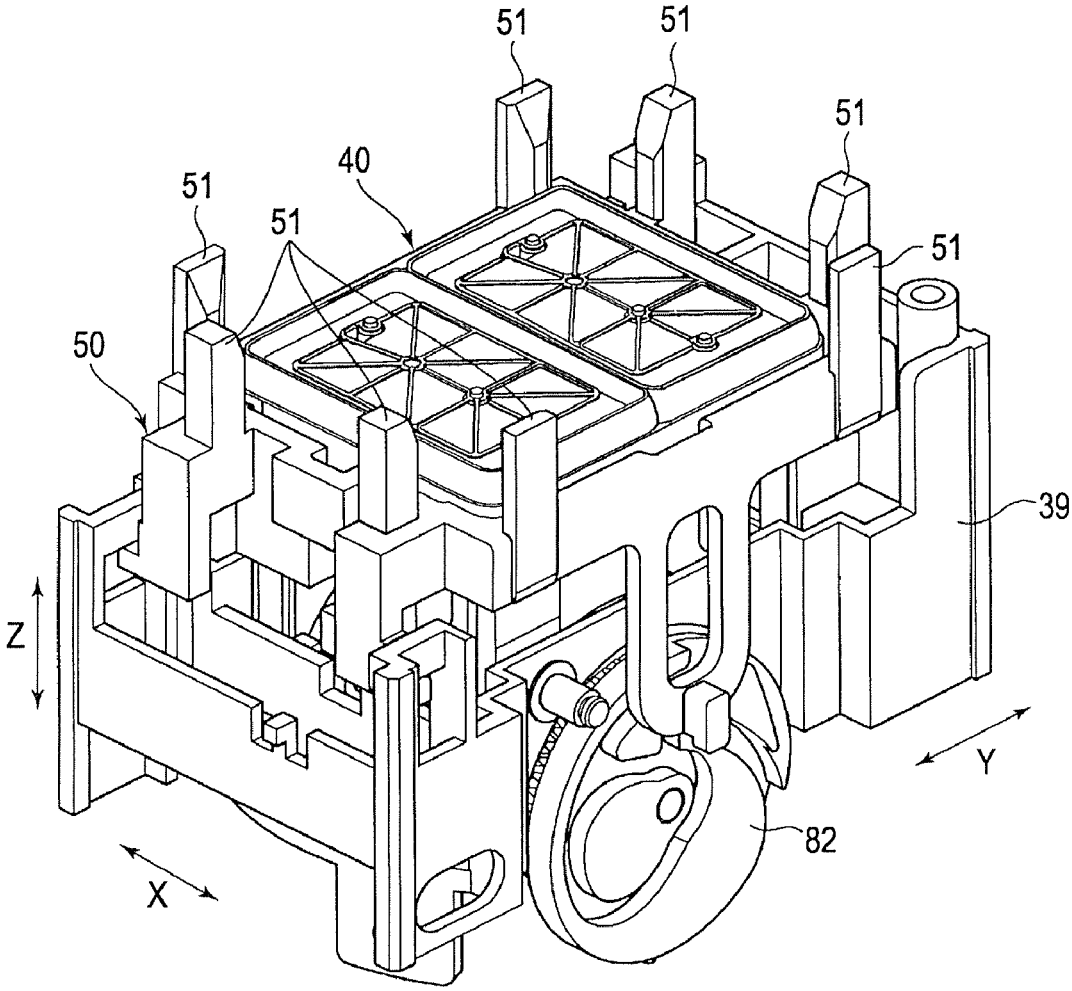
FIG. 7 is a perspective view of a portion where a cap, a head guide, and a base member are provided.
Figure 8:
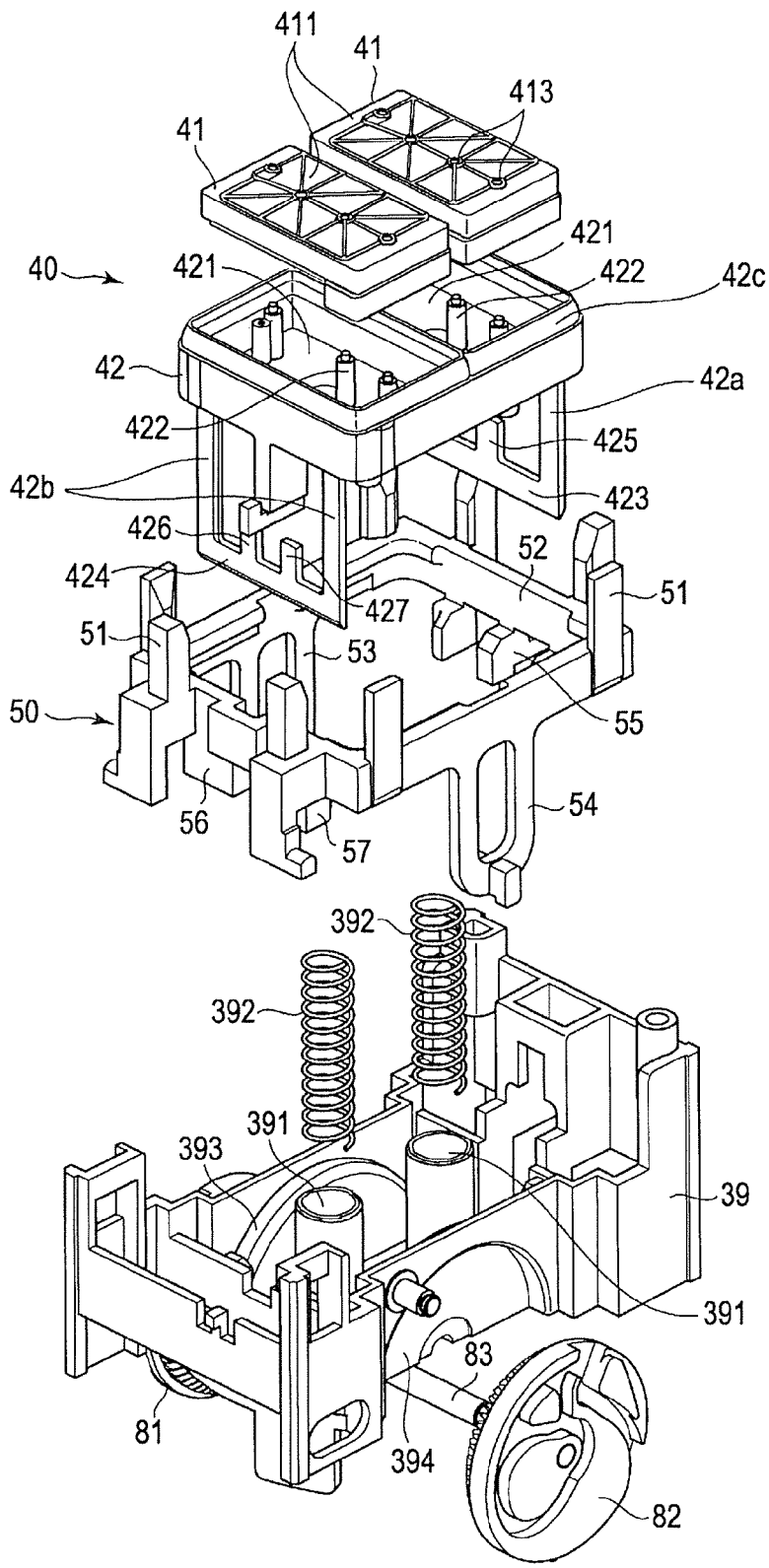
FIG. 8 is an exploded perspective view of a portion where a cap, a head guide, and a base member are provided.

FIG. 7 is an excerpt perspective view showing a portion where the cap 40, the head guide 50, and the base member 39 are provided, FIG. 8 is an exploded perspective view of the portion, and FIG. 9 is a side view of the portion.

The cap 40 as a "seal member" is disposed inside the head guide 50, and includes two absorbent material portions 41 and a cap main body 42. The cap main body 42 has a tubular seal member 42*c* formed of a flexible member. The tubular sealing portion 42*c* is provided so as to surround the outer side of the area where the ink ejecting nozzle of the head surface is provided when coming into contact with the head surface of the recording heads 16. The absorbent material portion 41 is supported by a support portion 422 in the state in which the support hole 413 is engaged with the front end convex portion of the support portion 422 formed in the negative pressure chamber 421 of the cap main body 42. The cap main body 42 forms a space between it and the head surface of the recording heads 16 when the sealing portion 42*c* comes into close contact with the head surface of the recording heads 16, so that the space becomes the negative pressure chamber 421. Furthermore, the negative pressure chamber 421 of the cap main body 42 communicates with a suction hole portion 428 protruded at the bottom part of the cap main body 42 and an atmosphere communication hole portion 429. The suction hole portion 428 is connected to a suction pump 37 via a suction tube (not shown) with flexibility. Moreover, the atmosphere communication hole portion 429 is connected to an atmosphere opening valve unit 70 described later via an atmosphere opening tube (not shown) with flexibility.

The base member 39 forming a part of the unit base portion 30 is fixed by a screw to the surface of the cover member 36. The base member 39 has two cylindrical spring support portions 391. Two coils springs 392 are respectively inserted into the spring support member 391 and are supported by the base member 39 in the state in which one end side thereof is in contact with the bottom portion in the spring support portion 391. Furthermore, the other end sides of two coil springs 392 are in contact with the bottom portion of the cap main body 42. That is, the cap 40 is elastically supported on the unit base portion 30 by two coil springs 392.

The head guide 50 as "a movable member" and "a guide member" is a member that is engaged with the recording heads 16 when the cap 40 is in contact with and brought into close contact with the head surface of the recording heads 16 to regulate the relative positional relationship between the recording heads 16 and the cap 40 in a direction along the head surface of the recording heads 16. More specifically, when the sealing portion 42*c* of the cap main body 42 is in contact with and brought into close contact with the head surface of the recording heads 16, eight guide portions 51 formed so as to surround the cap 40 are engaged with the side portion of the recording heads 16. That is, eight guide portions 51 are engaged with both side ends in a direction along the head surface of the recording heads 16 and a Y direction (a first direction) which is a direction intersecting the X direction and both side ends of the recording heads 16 in the X direction (a second direction). Furthermore, in the state in which the inside surface 52 of the head guide 50 is engaged with the outer peripheral surface of the cap 40, by the inside surface 52 of the head guide 50, the relative positional relationship between the head guide 50 and the cap 40 in the direction along the head surface of the recording heads 16 is regulated. As a result, it is possible to perform the positioning when bringing the cap 40 into close contact with the head surface of the recording heads 16 at a high accuracy.

A semicircular concave portion 393 formed on the base member 39 forms an accommodation space of a left cam structure 81. Similarly, a semicircular concave portion 394 formed on the base member 39 forms an accommodation space of a right cam structure 82. Furthermore, semicircular notch portions formed in the concave portion 393 and the concave portion 394 of the base member 39 are integrated with a support groove 363 (see FIG. 33) formed in the cover member 36 and forms the support portion of the cam shaft 83. The cam shaft 83 is fixedly provided on the support portion. The left cam structure 81 is pivotally supported at one end side of the cam shaft 83 rotatably with respect to the cam shaft 83, and the right cam structure 82 is pivotally supported at the other end side of the cam shaft 83 rotatably with respect to the cam shaft 83.

The left cam structure 81 and the right cam structure 82 are cam structures including the cam for displacing the head guide 50. The left cam structure 81 and the right cam structure 82 are not components of a left and right symmetrical shape but are components of the identical shape. For that reason, the left cam structure 81 and the right cam structure 82 are supported by the unit base portion 30 so that they can independently rotated, whereby in a case where the driving force of the maintenance unit motor 38 is transmitted to the left and right cam structure via a driving force transmission mechanism 80 described later and the left and right cam structures are rotated, the driving force is transmitted so that the left and right cam structures are rotated in opposed rotation directions by the same rotation amount. More specifically, as described later, a gear portion 811 of the left cam structure 81 and a gear portion 821 of the right cam structure 82 are engaged with a cam driving gear portion 841 of a rotating body 84 disposed at the inside of the cover member 36, whereby, by the rotation of the rotation body 84, they are always rotated in opposed rotation directions by the same rotation amount (see FIG. 34). In addition, a convex portion 541 formed in a right arm portion 54 of the head guide 50 is engaged with a head guide cam (guide member cam) 822 of the right cam structure 82. Similarly, a convex portion 531 (see FIG. 11) formed in a left arm portion 53 of the head guide 50 is engaged with a head guide cam (not shown) of the left cam structure 81.

As described above, since the left cam structure 81 and the right cam structure 82 are components of the identical shape, hereinafter, when describing the left cam structure 81 and the right cam structure 82, the right cam structure 82 will be described as an example, and the description of the left cam structure 81 will be suitably omitted.

The head guide 50 is disposed in the space between the cap 40 and the base member 39 and is provided in the base member 39 so as to be displaceable in the Z direction. That is, the maintenance unit 3 has a configuration in which the head guide 50 provided separately from the cap 40 can be independently displaced in the Z direction. In addition, the head guide 50 is supported by the left cam structure 81 and the right cam structure 82, so that the head guide 50 is displaced in the Z direction by rotating the left cam structure 81 and the right cam structure 82. As a result, it is possible to displace only the head guide 50 in the Z direction, while maintaining the gap between the head surface of the recording heads 16 and the absorbent material surface 411 of the cap 40.

Figure 9A:
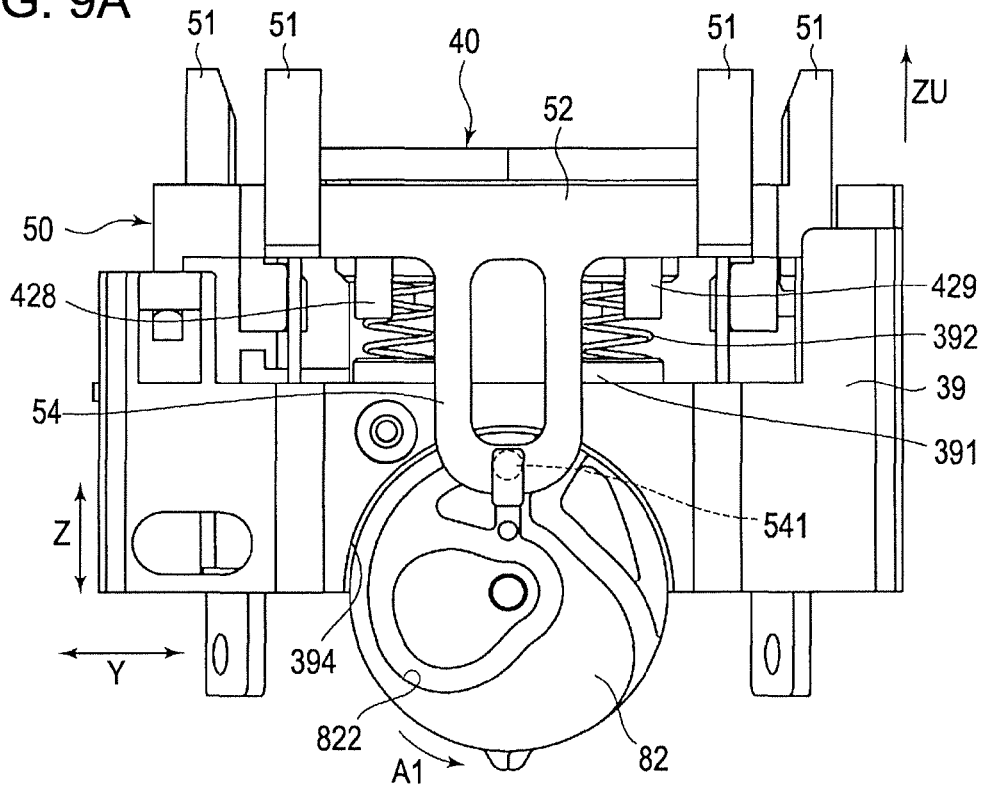
FIGS. 9A and 9B are side views of a portion where a cap, a head guide, and a base member are provided.

More specifically, when the right cam structure 82 is rotated in the rotation direction A1 and the left cam structure 81 is rotated in an opposite direction of the rotation direction A1, the head guide 50 enters the state of being displaced in a rise direction ZU (a direction in the Z direction approaching the recording heads 16) along the shape of the head guide cam 822. In this state, the guide portion 51 of the head guide 50 protrudes from the absorbent material surface 411 of the cap 40 to the recording heads 16 side (FIG. 9A).

Thus, if the maintenance unit 3 is displaced in a direction approaching the recording heads 16 from this state by the lift apparatus 23, the guide portion 51 of the head guide 50 is firstly engaged with the recording heads 16, and then the sealing portion 42*c* of the cap main body 42 comes into contact with the head surface of the recording heads 16. That is, in the state in which the relative positional relationship between recording heads 16 and the cap 40 in the direction along the head surface of the recording heads 16 is regulated by the guide portion 51 of the head guide 50, the sealing portion 42*c* of the cap main body 42 can be brought into close contact with the head surface of the recording heads 16.

Figure 9B:
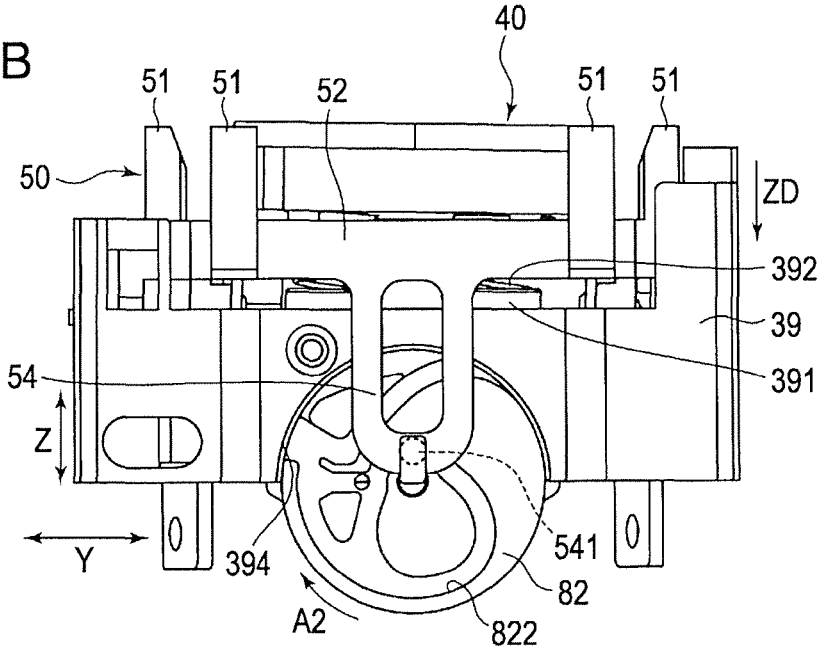

On the other hand, when the right cam structure 82 is rotated in the rotation direction A2 and the left cam structure 81 is rotated in the opposite direction of the rotation direction A2, the head guide 50 is displaced in a drop direction ZD (the other direction in the Z direction which is a direction separated from the recording heads 16) along the shape of the head guide cam 822. In this state, the guide portion 51 of the head guide 50 enters the state of retreating in the direction separated from the recording heads 16 further than the absorbent material surface 411 of the cap 40. That is, the absorbent material surface 411 of the cap 40 slightly protrudes from the protrusion end of the guide portion 51 of the head guide 50 to the head surface side of the recording heads 16 (FIG. 9B).

The flushing performed during recording implementation to the recording paper P is a motion that separates the recording head 16 and the cap 40 from each other, thereby ejecting ink from the recording heads 16 to the absorbent material portion 41 of the cap 40. At this time, if the length between the recording heads 16 and the absorbent material surface 411 is long, the ink ejected from the recording heads 16 decreases in speed due to a lot of air resistance, so that the ink is apt to become the mist. For this reason, it is desirable that the distance between the recording heads 16 and the absorbent material surface 411 of the cap 40 is made as short as possible, while maintaining the distance by which the recording paper P does not come into contact with the cap 40. Thus, during flushing, it is desirable that the cap 40 is disposed at a position separated from the recording heads 16 slightly further than the recording paper P.

However, in a case where the cap 40 is fixed to the head guide 50 in the same manner as in the related art, if it tries to shorten the distance between the recording heads 16 and the absorbent material surface 411 of the absorbent material portion 41, the guide portion 51 of the head guide 50 interferes with the transportation of the recording paper P or the like. On the other hand, if the cap 40 is disposed at a position where the guide portion 51 of the head guide 50 does not interfere with the transportation of the recording paper P or the like, the distance between the recording heads 16 and the absorbent material surface 411 of the absorbent material portion 41 becomes longer, so that the ink mist is apt to occur, as described above. For this reason, in the related art, there was a problem in that, whenever the flushing is performed, the maintenance unit 3 needs to be moved back and forth in the Z direction, whereby the time required for the flushing becomes unnecessarily longer.

The maintenance unit 3 according to an aspect of the invention has a configuration in which the head guide 50 provided separately from the cap 40 can be independently displaced in the Z direction. For this reason, in the state in which the cap 40 is disposed at the position separated from the recording heads 16 slightly further than the recording paper P, it is possible to keep the guide portion 51 of the head guide 50 from interfering with the transportation of the recording paper P or the like. That is, there is no need to move the maintenance unit 3 back and forth in the Z direction whenever performing the flushing, while maintaining the gap between the head surface of the recording heads 16 and the absorbent material surface 411 of the cap 40 at a gap suitable for the flushing. As a result, it is possible to reduce the amount of the mist generated during flushing without lowering the throughput of the ink jet printer 1.

Figure 10A:
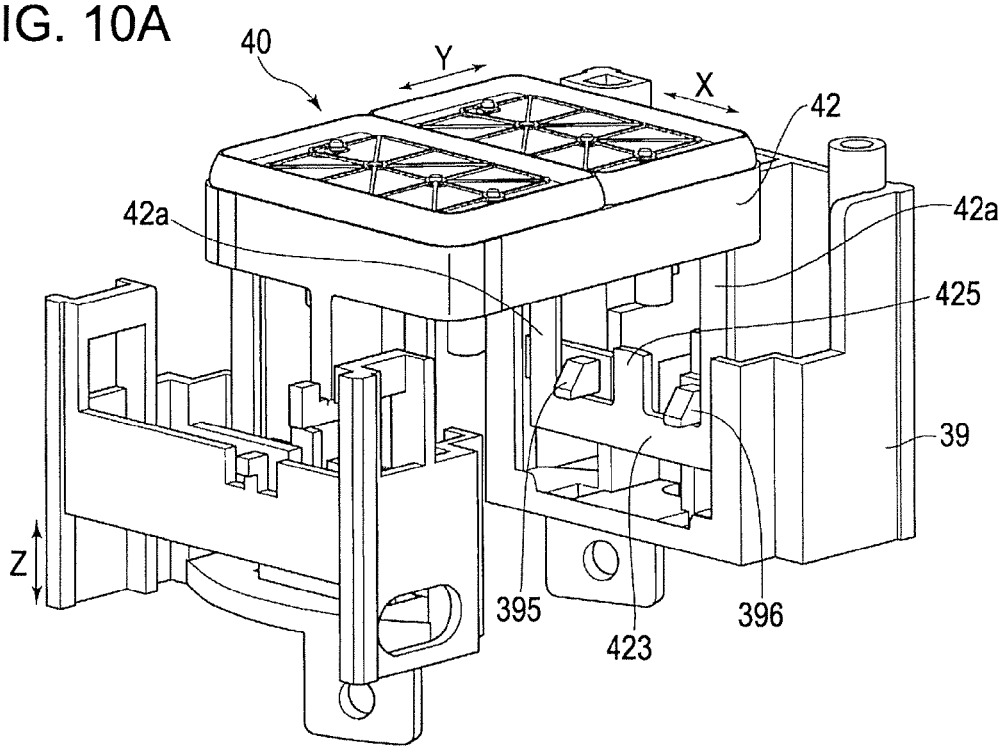
FIGS. 10A and 10B are perspective view showing an engagement state of a cap and a base member.
Figure 10B:
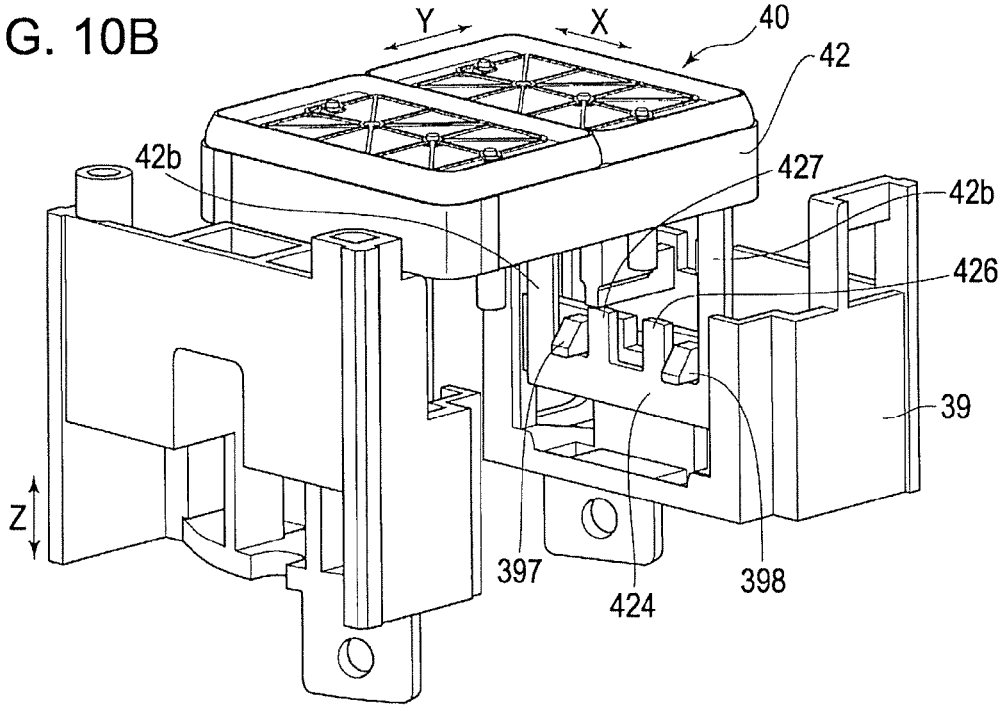

FIGS. 10A and 10B are perspective views showing an engagement state of the cap 40 and the base member 39. FIG. 10A is a perspective view showing an engagement state of a first lock portion 423 of the cap main body 42 and a first locking claw portion 395 and a second lock claw portion 396 of the base member 39 at an angle easy to be observed. FIG. 10B is a perspective view showing an engagement state of a second lock portion 424 of the cap main body 42 and a third lock claw portion 397 and a fourth lock claw portion 398 of the base member 39 at an angle easy to be observed (the state of being rotated by about 180° around the Z axis in FIG. 10A).

Furthermore, in FIGS. 10A and 10B, in order to show the engagement state of the cap 40 and the base member 39 in a manner easy to understand, the base member 39 is shown in a fragmentary manner.

The cap main body 42 of the cap 40 has the first locking portion 423 and the second locking portion 424 as a "first regulation portion". The first locking portion 423 is a portion that connects front ends of two arm portions 42*a*, which are formed so as to protrude from the bottom part of the cap main body 42 in the Z direction, in the X direction. Similarly, the second locking portion 424 is a portion that connects front ends of two arm portions 42*b*, which is formed so as to protrude from the bottom part of the cap main body 42 in the Z direction, in the X direction.

The base member 39 has a first locking claw portion 395, a second locking claw portion 396, a third locking claw portion 397, and a fourth locking claw portion 398. The first locking claw portion 395 and the second locking claw portion 396 are formed at a position corresponding to the Z direction with respect to the first locking portion 423 of the cap main body 42. The third locking claw portion 397 and the fourth locking claw portion 398 are formed at a position corresponding to the Z direction with respect to the second locking portion 424 of the cap main body 42.

In the state in which the head guide 50 is in at least a predetermined position (hereinafter, referred to as the "first displacement position") where the guide portion 51 protrudes from the absorbent material surface 411 of the cap 40 to the recording heads 16 side, by the elastic force of the coil spring 392, the first locking portion 423 of the cap main body 42 comes into contact with the first locking claw portion 395 and the second locking claw portion 396 of the base member 39 (see FIG. 10A), and the second locking portion 424 of the cap main body 42 comes into contact with the third locking claw portion 397 and the fourth locking claw portion 398 of the base member 39 (see FIG. 10B). As a result, the posture of the cap 40 is regulated so that the sealing portion 42*c* of the cap main body 42 becomes parallel to the head surface of the recording heads 16.

Figure 11A:
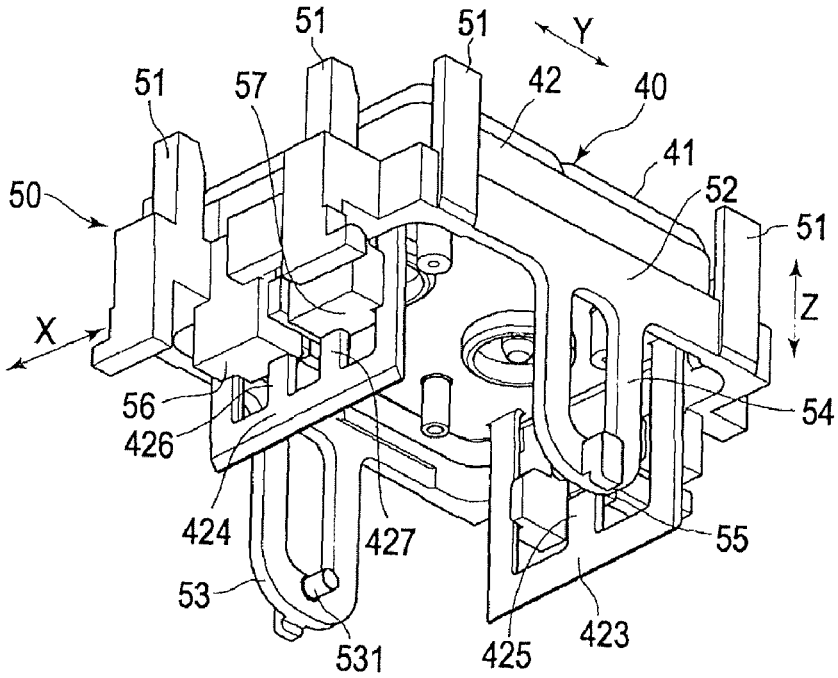
FIGS. 11A and 11B are a perspective view and a front view showing an engagement state of a cap and a head guide.
Figure 11B:
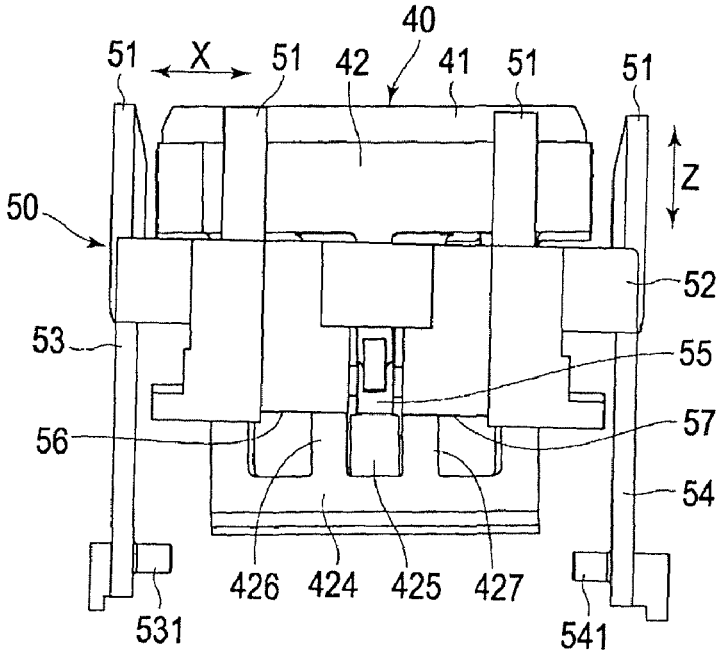

FIGS. 11A and 11B are a perspective view and a front view showing an engagement state of the cap 40 and the head guide 50.

The cap main body 42 of the cap 40 has a first contact portion 425, a second contact portion 426, and a third contact portion 427 as "second regulation portion". The first contact portion 425 is formed integrally with the first locking portion 423 so as to protrude in the Z direction. The second contact portion 426 and the third contact portion 427 are formed integrally with the second locking portion 424 so as to protrude in the Z direction. The first contact portion 425 and the second contact portion 426 are formed at a gap in the Y direction (first direction). The third contact portion 427 is formed at a gap in the X direction (second direction) with respect to the first contact portion 425 and the second contact portion 426.

The head guide 50 has a first contacted portion 55, a second contacted portion 56 and a third contacted portion 57. The first contacted portion 55 is formed at a position corresponding to the Z direction with respect to the first contact portion 425 of the cap main body 42. The second contacted portion 56 is formed at a position corresponding to the Z direction with respect to the second contact portion 426 of the cap main body 42. The third contacted portion 57 is formed at a position corresponding to the Z direction with respect to the third contact portion 427 of the cap main body 42. Moreover, in the state in which the posture of the cap 40 is regulated so that the sealing portion 42*c* of the cap main body 42 becomes parallel to the head surface of the recording heads 16 (state of FIGS. 10A and 10B), they are formed so that a gap between the first contact portion 425 and the first contacted portion 55 in the Z direction, a gap between the second contact portion 426 and the second contacted portion 56 in the Z direction, and a gap between the third contact portion 427 and the third contacted portion 57 in the Z direction are different from each other. More specifically, for example, the first contacted portion 55, the second contacted portion 56 and the third contacted portion 57 of the head guide 50 may have regular heights in the Z direction, and the first contact portion 425, the second contact portion 426 and the third contact portion 427 of the cap main body 42 may be formed at a step in the Z direction. Alternatively, the first contact portion 425, the second contact portion 426 and the third contact portion 427 of the cap main body 42 may have regular heights in the Z direction, and the first contacted portion 55, the second contacted portion 56 and the third contacted portion 57 of the head guide 50 may be formed at a step in the Z direction.

When the head guide 50 is displaced from the first displacement position to a predetermined position (hereinafter, referred to as the "second displacement position") that is displaced in the direction separated from the recording heads 16, the first locking portion 423 and the second locking portion 424 of the cap main body 42 enter the state of being separated from the first locking claw portion 395, the second locking claw portion 396, the third locking claw portion 397, and the fourth locking claw portion 398 of the base member 39. Furthermore, in that state, the first contact portion 425, the second contact portion 426 and the third contact portion 427 of the cap main body 42 enter the state of being respectively in contact with the first contacted portion 55, the second contacted portion 56 and the third contacted portion 57 of the head guide 50 (see FIGS. 11A and 11B). As a result, the posture of the cap 40 is regulated so that the sealing portion 42*c* of the cap main body 42 slopes with respect to the head surface of the recording heads 16 in a three-dimensional manner (slopes in the X direction and the Y direction).

FIGS. 12A to 12H are motion explanation diagrams that simply show a sealing motion and a sealing release motion of the head surface of the recording heads 16.

Hereinafter, with reference to FIGS. 12A to 12H, after summarizing the principal parts of the configuration of the head repairing apparatus 2 according to an aspect of the invention as described hereinabove, an example of a sealing motion and a sealing release motion of the head surface of the recording heads 16 in the head repairing apparatus 2 according to an aspect of the invention will be described.

The head repairing apparatus 2 can displace the maintenance unit 3 in the Z direction with respect to the recording heads 16 by the lift apparatus 23. The cap 40 of the maintenance unit 3 is elastically supported on the base member 39 by the coil spring 392. The head guide 50 of the maintenance unit 3 is provided separately from the cap 40 and is provided so as to be independently displaceable in the Z direction.

The first locking claw portion 395 and the second locking claw portion 396 of the base member 39 are formed at a position corresponding to the Z direction with respect to the first locking portion 423 of the cap main body 42. The third locking claw portion 397 and the fourth locking claw portion 398 of the base member 39 are formed at a position corresponding to the Z direction with respect to the second locking portion 424 of the cap main body 42.

The first contacted portion 55 of the head guide 50 is formed at a position corresponding to the Z direction with respect to the first contact portion 425 of the cap main body 42. The second contacted portion 56 of the head guide 50 is formed at a position corresponding to the Z direction with respect to the second contact portion 426 of the cap main body 42. The third contacted portion 57 of the head guide 50 is formed at a position corresponding to the Z direction with respect to the third contact portion 427 of the cap main body 42. Moreover, in the state in which the posture of the cap 40 is regulated so that the sealing portion 42*c* of the cap main body 42 becomes parallel to the head surface of the recording heads 16 (state shown in FIGS. 10A and 10B), they are formed so that a gap between the first contact portion 425 and the first contacted portion 55 in the Z direction, a gap between the second contact portion 426 and the second contacted portion 56 in the Z direction, and a gap between the third contact portion 427 and the third contacted portion 57 in the Z direction are different from each other.

Figures 12A, 12B, 12C, 12D, 12E, 12F, 12G, 12H:
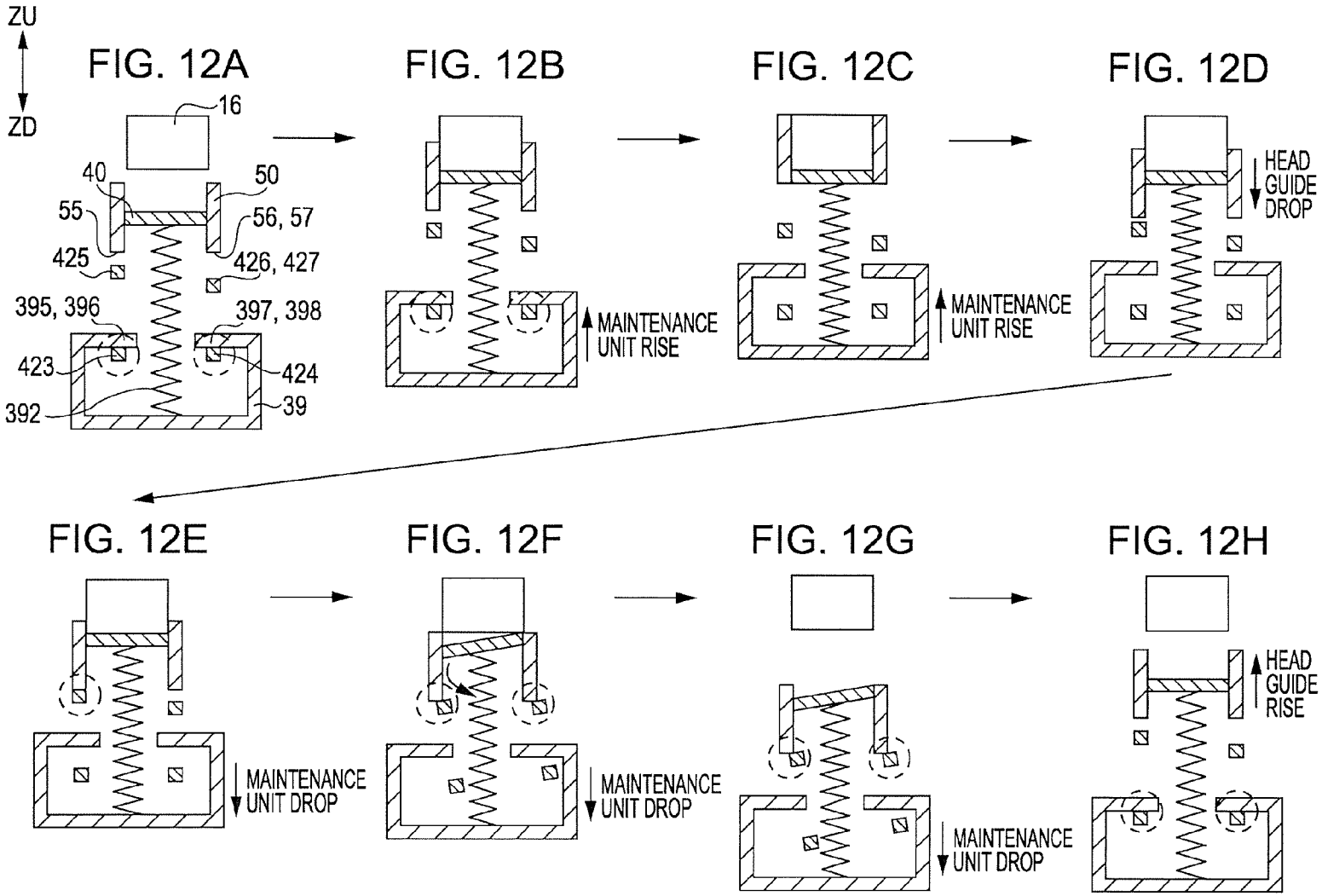
FIG. 12 is a motion explanation diagram showing a sealing motion and a sealing release motion of a recording head.

In the state in which the head guide 50 is in the first displacement position, by the elastic force of the coil spring 392, the first locking portion 423 and the second locking portion 424 of the cap 40 respectively come into contact with the first locking claw portion 395, the second locking claw portion 396, the third locking claw portion 397, and the fourth locking claw portion 398 of the base member 39 (see FIG. 12A). In the cap 40, the first locking portion 423 and the second locking portion 424 are parallel to the sealing portion 42*c*, and the first locking claw portion 395, the second locking claw portion 396, the third locking claw portion 397, and the fourth locking claw portion 398 of the base member 39 are parallel to the head surface of the recording heads 16. Thus, the posture of the cap 40 is regulated so that the sealing portion 42*c* of the cap main body 42 becomes parallel to the head surface of the recording heads 16 (FIGS. 10A and 10B). That is, the parallel posture of the cap 40 is maintained at the maintenance unit 3 side. As a result, it is possible to perform the positioning when bringing the sealing portion 42*c* of the cap main body 42 into close contact with the head surface of the recording heads 16 at a high accuracy.

When the maintenance unit 3 is displaced in the rise direction ZU by the lift apparatus 23 from this state, firstly, the guide portion 51 of the head guide 50 is engaged with the recording heads 16, and continuously, the sealing portion 42*c* of the cap main body 42 comes into contact with the head surface of the recording heads 16 (see FIG. 12B). In addition, the lift apparatus 23 is stopped at a position where the maintenance unit 3 is further displaced in the rise direction ZU. As a result, by the elastic force (elastic return force) of the coil spring 392 of the compressed state, the sealing portion 42*c* of the cap main body 42 is pressed against and brought into close contact with the head surface of the recording heads 16. Furthermore, after the sealing portion 42*c* of the cap main body 42 comes into contact with the head surface of the recording heads 16, the displacement of the cap 40 in the rise direction ZU is locked by the recording heads 16, whereas the base 39 is further displaced in the rise direction ZU. For that reason, the first locking portion 423 and the second locking portion 424 of the cap 40 are separated from the first locking claw portion 395, the second locking claw portion 396, the third locking claw portion 397, and the fourth locking claw portion 398 of the base member 39 (FIG. 12C).

From this state, after only the head guide 50 situated at the first displacement position is displaced in the drop direction ZD (FIG. 12D), the lift apparatus 23 displaces the maintenance unit 3 in the drop direction ZD. As described above, the gaps among the first contact portion 425, the second contact portion 426 and the third contact portion 427 of the cap 40 and the first contacted portion 55, the second contacted portion 56 and the third contacted portion 57 of the head guide 50 in the Z direction are different from each other. In addition, when the head guide 50 is displaced in the drop direction ZD, the state in which the cap 40 is in contact with the head surface of the recording heads 16 is maintained by the elastic force of the coil spring 392. As a result, firstly, the first contact portion 425 of the cap 40 comes into contact with the first contacted portion 55 of the head guide 50 (FIG. 12E), then, the second contact portion 426 of the cap 40 comes into contact with the second contacted portion 56 of the head guide 50, and finally, the third contact portion 427 of the cap 40 comes into contact with the third contacted portion 57 of the head guide 50, which becomes the second displacement position (FIG. 12F). In this state, the posture of the cap 40 is regulated so that the sealing portion 42*c* of the cap main body 42 slopes with respect to the head surface of the recording heads 16 in a three-dimensional manner (FIGS. 11A and 11B). As a result, since the cap 40 can be separated from the head surface of the recording heads 16, while causing the sealing portion 42*c* of the cap main body 42 to slope, it is possible to reduce the scattering of ink generated when separating the cap 40 from the head surface of the recording heads 16.

In addition, the lift apparatus 23 is stopped by displacing the maintenance unit 3 up to the position shown in FIG. 12A in the drop direction ZD (FIG. 12G), and the head guide 50 situated at the second displacement position is displaced in the rise direction ZU and is moved to the first displacement direction (FIG. 12H). As a result, it is possible to return the head repairing apparatus 2 to the initial state.

In this manner, the head repairing apparatus 2 according to an aspect of the invention can perform the positioning when the sealing portion 42*c* of the cap main body 42 is brought into close contact with the head surface of the recording heads 16 at a high accuracy, and can reduce the scattering of ink generated when separating the cap 40 from the head surface of the recording heads 16.

Configuration of Wiper Unit 60

A configuration of a wiper unit 60 will be described with reference to FIGS. 13 to 15.

Figure 13:
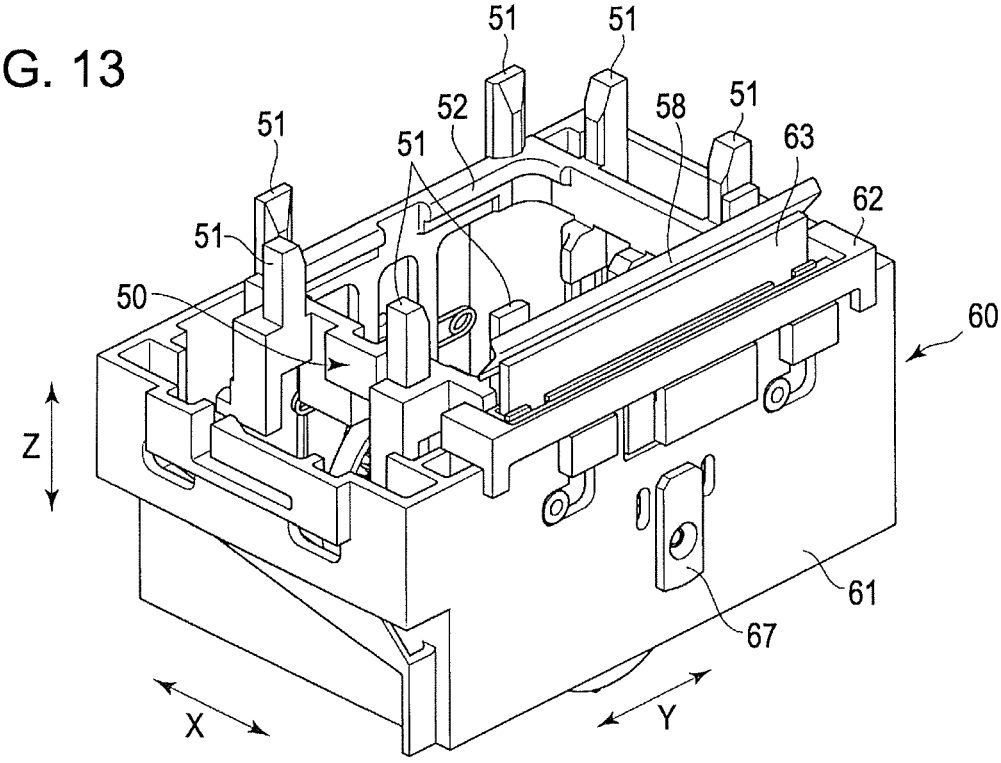
FIG. 13 is a perspective view of a portion where a head guide and a wiper unit are provided.
Figure 14:
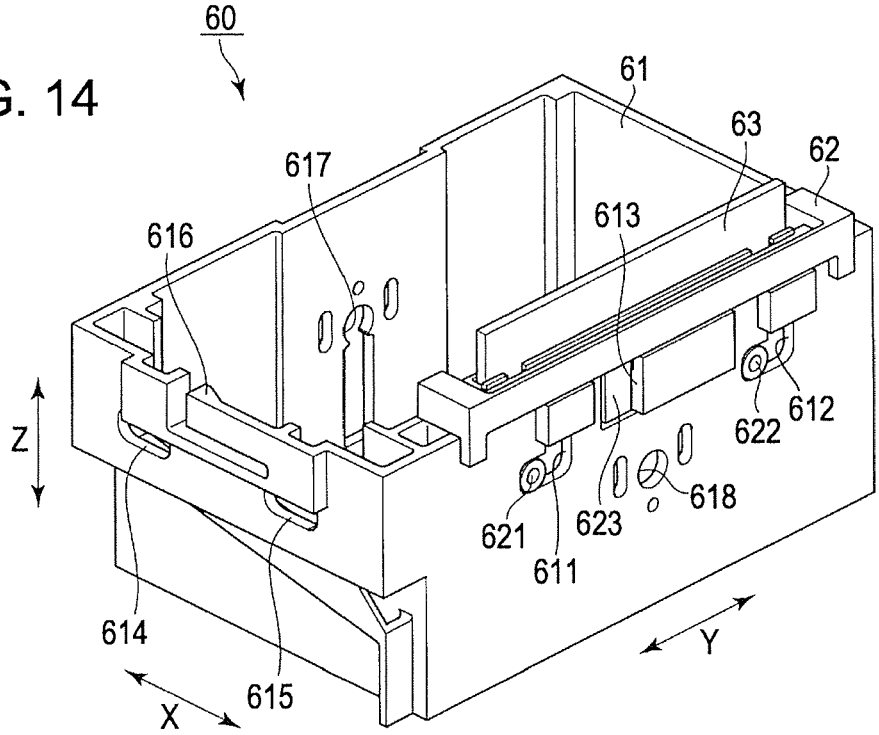
FIG. 14 is a perspective view of a wiper unit.
Figure 15:
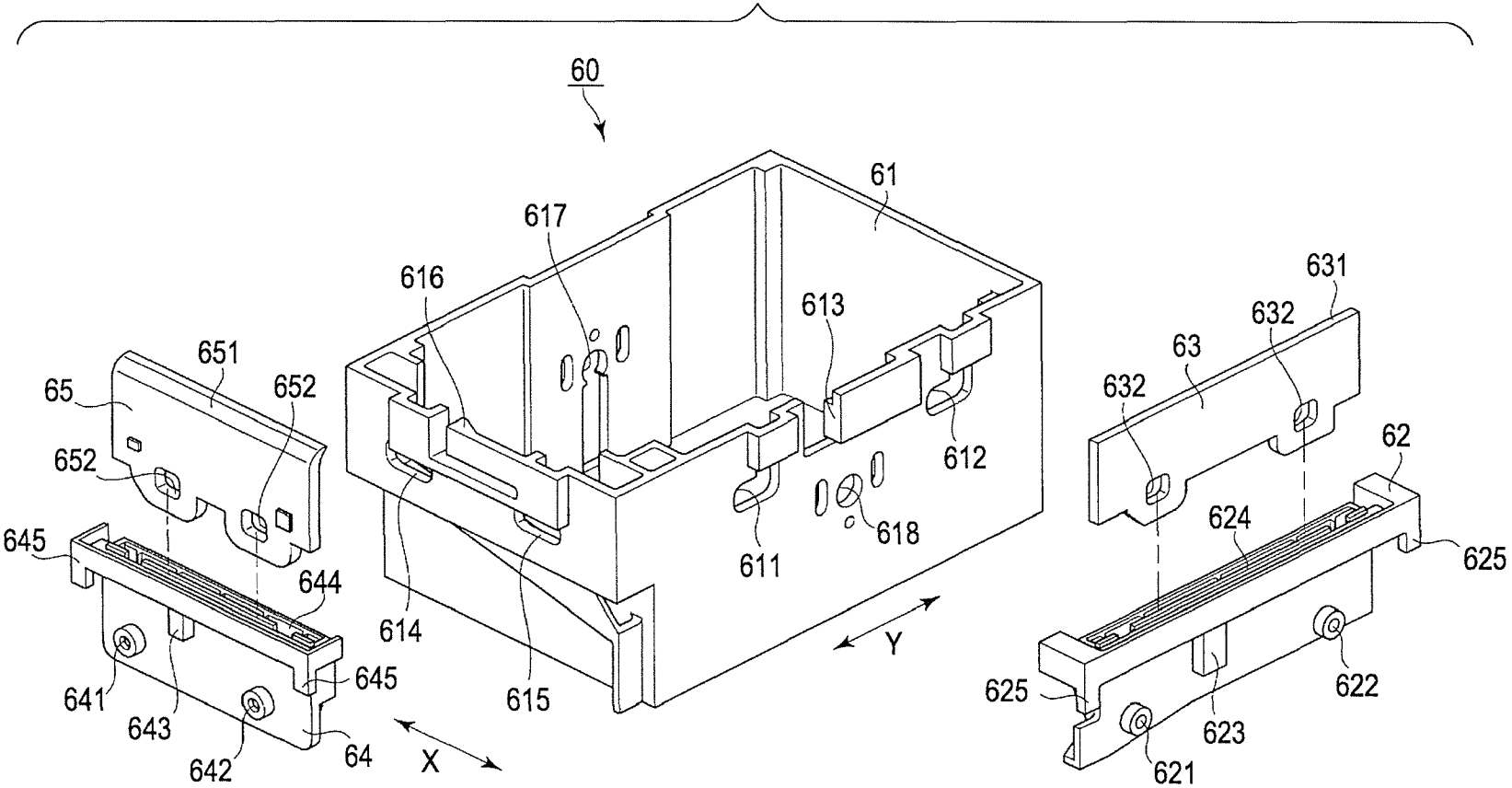
FIG. 15 is an exploded perspective view of a wiper unit.

FIG. 13 is an excerpt perspective view of a portion where the head guide 50 and the wiper unit 60 are provided, FIG. 14 is a perspective view of the wiper unit 60, and FIG. 15 is an exploded perspective view.

The wiper unit 60 has a wiper support member 61, a first wiper attachment member 62, a first wiper 63, a second wiper attachment member 64, and a second wiper 65.

The wiper support member 61 is disposed at the outside of the base member 39 provided at the outside of the head guide 50 and is supported by the base member 39 so as to be displaceable in the Z direction.

The first wiper 63 is formed of a material having the elasticity such as elastomer and is a member for removing the affixed matter attached to the head surface of the recording heads 16 by the wiping in the X direction. More specifically, in the state in which the wiper support member 61 is moved to a position where the first wiper 63 can come into slide-contact with the head surface of the recording heads 16, the maintenance unit 3 is displaced with respect to the recording heads 16 in the X direction, so that the front end 631 of the first wiper 63 is brought into slide-contact with the head surface of the recording heads 16. As a result, the affixed matter attached to the head surface of the recording heads 16 is wiped and removed by the first wiper 63.

The first wiper member 62 is a member for attaching the first wiper 63 to the wiper support member 61 in an easily attachable and detachable manner. The first wiper 63 is inserted into an attachment groove 624 of the first wiper attachment member 62 and is fixed in the state in which the hole portion 632 is engaged with a convex portion (not shown) in the attachment groove 624, thereby being attached to the first wiper attachment member 62.

The first wiper attachment member 62 can be easily attached to the wiper support member 61 by the following attachment order. Firstly, circular convex portions 621 and 622 are inserted into bent long holes 611 and 612 formed at the side wall portion of the wiper support member 61 and are pressed downward along the shapes of the bent long holes 611 and 612. As a result, the wiper attachment member 62 is locked at the upper end of the side wall portion of the wiper support member 61 by two locking portions 625. In addition, the wiper attachment member 62 is slid from that state to the terminal end thereof along the bent long holes 611 and 612 in the Y direction. As a result, the convex portion 623 is locked on the locking claw portion 613 of the wipe support member 61, so that the first wiper attachment member 62 is positioned at a predetermined position of the wiper support member 61 and is and attached thereto. Furthermore, the first wiper attachment member 62 attached to the wiper support member 61 can be simply detached, by sliding the convex portion 623 along the shape of the bent long holes 611 and 612 in the Y direction in the state in which the locking claw portion 613 of the wiper support member 61 is caused to bend outward, thereby releasing the locking of the convex portion 623, and then pulling the convex portion 623 upward.

The second wiper 65 is a member for removing the affixed matter attached to the head surface of the recording heads 16 by the wiping in the Y direction, and is formed of a material having the elasticity such as elastomer in the same manner as the first wiper 63. Furthermore, as shown, the second wiper 65 is configured so that the front end portion 651 thereof is in the shape of a taper and the front end portion 651 has a shape bent to the inside. The second wiper attachment member 64 is a member for attaching the second wiper 65 to the wiper support member 61 in an easily attachable and detachable manner. The second wiper 65 is inserted into an attachment groove 644 of the second wiper attachment member 64, fixed in the state in which the hole portion 652 is engaged with a convex portion (not shown) in the attachment groove 644 and is attached to the second wiper attachment member 64.

The second wiper attachment member 64 can be simply attached to and detached from the wiper support member 61, in the same manner as the first wiper attachment member 62. Firstly, the circular convex portions 641 and 642 are locked to the bent long holes 614 and 615 formed in the side wall portion of the wiper support member 61, thereby being pressed downward along the shapes of the bent long holes 614 and 615. As a result, the second wiper attachment member 64 is locked to the upper end of the side wall portion of the wiper support member 61 by two locking portions 645. In addition, the second wiper attachment member 64 is slid from that state to the terminal end thereof along the bent long holes 614 and 615 in the X direction. As a result, the convex portion 643 is locked on the locking claw portion 616 of the wipe support member 61, so that the second wiper attachment member 64 is positioned at a predetermined position of the wiper support member 61 and is attached thereto. Furthermore, the second wiper attachment member 64 attached to the wiper support member 61 can be simply detached, by sliding the convex portion 643 along the shapes of the bent long holes 614 and 615 in the X direction in the state in which the locking claw portion 616 of the wiper support member 61 is caused to bend outward, thereby releasing the hook of the convex portion 643, and then pulling the convex portion 643 upward.

Since, by adopting a wiper attachment structure by the snap-fit mechanism, it is possible to easily exchange the first wiper 63 and the second wiper 65 in which the wiping capability of the affixed matter declines, it is easy to maintain the wiping capability of the first wiper 63 and the second wiper 65. Any one of the first wiper 63 and the second wiper 65 may be used by being attached to the wiper support member 61 and both of them may be used by being attached to the wiper support member 61, depending on the specifications of the ink jet printer 1 becoming the object or the like.

In addition, as a modified example, the first wiper 63 and the second wiper 65 may be provided in parallel in the wiper support member 61 in the same direction. As a result, the operation of wiping the affixed matter of the head surface of the recording heads 16 by the wiper can be doubly performed by one wipe, whereby it is possible to improve the capability of removing the affixed matter of the head surface of the recording heads 16. Alternatively, it is also possible to selectively and separately use two or more wipers with different shapes or elasticity, depending on the state of the head surface of the recording heads 16 or the like.

In addition, in the present embodiment, the case where only the first wiper 63 is attached will be described below.

Wiper Cleaner 58

A wiper cleaner 58 will be described with reference to FIGS. 16 and 17.

Figure 16:
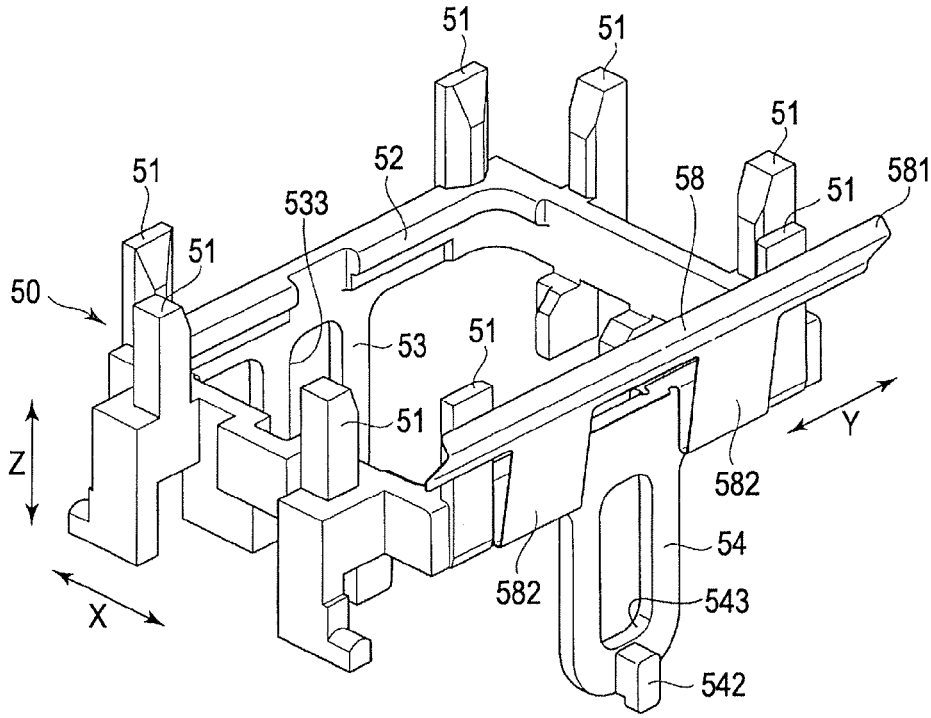
FIG. 16 is a perspective view of a head guide.

FIG. 16 is a perspective view of the head guide 50.

On the head guide 50, there is provided a wiper cleaner 58 as a "removal portion" which comes into slide contact with the first wiper 63 and removes the affixed matter attached to the first wiper 63 (not shown in FIGS. 3 to 12H). The wiper cleaner 58 is formed by attaching an absorbent material such as s felt to the surface of the metallic member of a thin plate shape. The wiper cleaner 58 has a shape in which the elastic support portion 582 gives the slide contact engagement portion 581 the elasticity, so that the slide contact engagement portion 581 comes into slide-contact with the first wiper 63. The affixed matter attached to the first wiper 63 can be removed by bring the slide contact engagement portion 581 of the wiper cleaner 58 into slide-contact with the first wiper 63. At this time, the wiper cleaner 58 is supported in the state of being provided with the elasticity by the elastic support portion 582, so that it is possible to reduce a possibility that the excessive frictional force is generated in the slide contact portion. As a result, it is possible to reduce a possibility that abrasion, breakdown or the like is generated in the first wiper 63 when the wiper cleaner 58 comes into slide contact with the first wiper 63.

Figure 17:
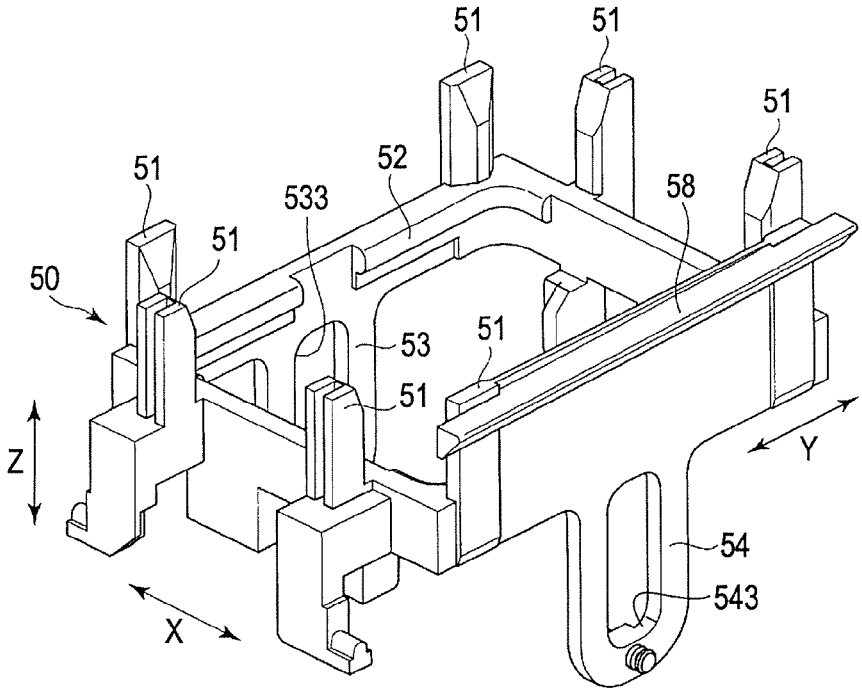
FIG. 17 is a perspective view showing a modified example of a wiper cleaner.

FIG. 17 is a perspective view showing a modified example of the wiper cleaner 58.

The wiper cleaner 58 of the modified example is integrally formed in the guide portion 51 of the head guide 50 formed of the synthetic resin member such as plastic. The synthetic resin member such as plastic is a material having the elasticity, so that it is possible to bring the wiper cleaner 58 into slide-contact with the first wiper 63 with the elasticity. In this manner, the wiper cleaner 58 can be provided, whereby the number of the components can be reduced, which can provide a low-cost configuration.

Displacement Mechanism of Wiper Unit 60

A displacement mechanism of the wiper unit 60 will be described with reference to FIGS. 13 to 17 and 18.

Figure 18:
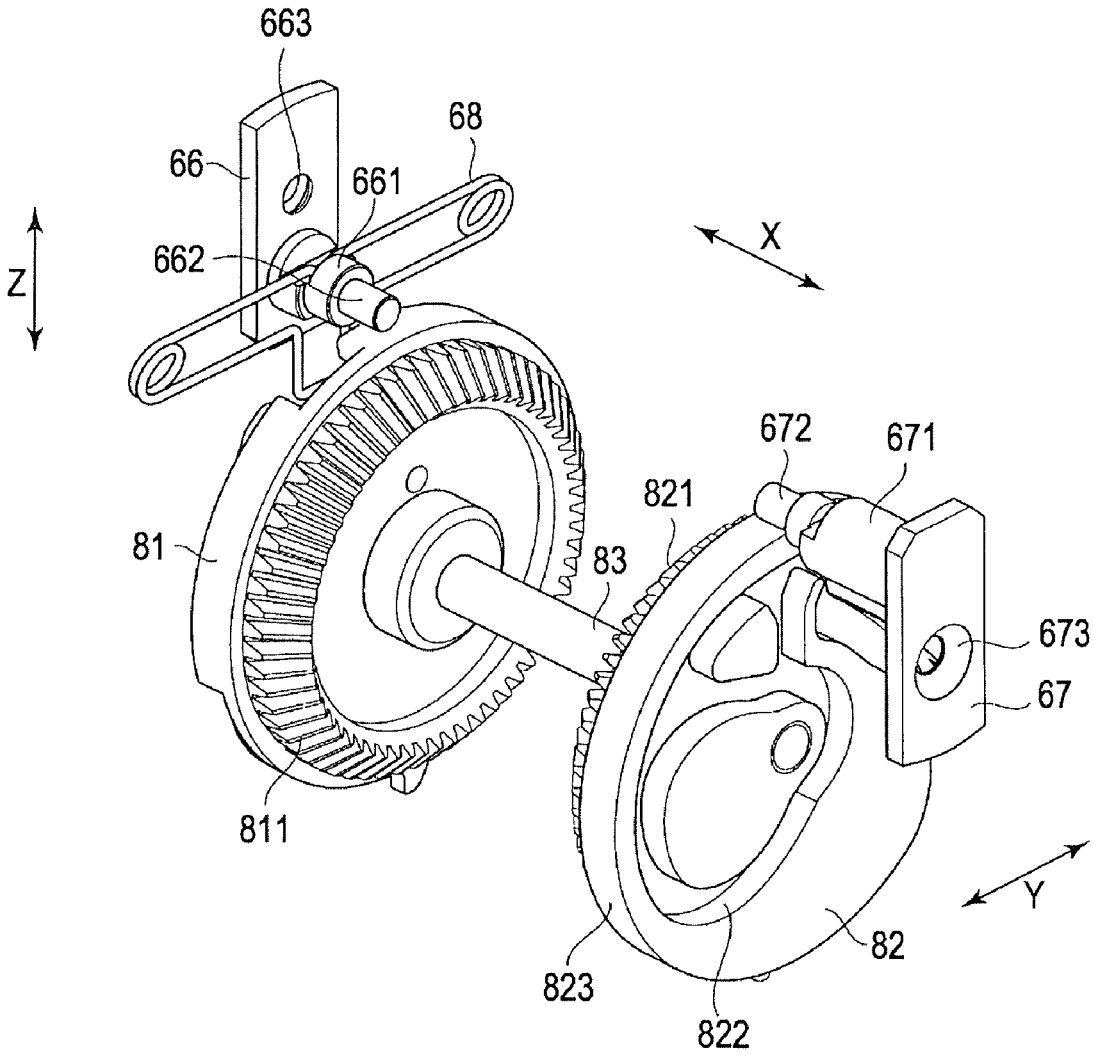
FIG. 18 is a perspective view showing an engagement portion of a cam structure and a wiper unit.

FIG. 18 is a perspective view showing an engagement portion of the left cam structure 81, the right cam structure 82 and the wiper unit 60.

The wiper unit 60 has a left cam engagement member 66, a right cam engagement member 67, a left cam press spring 68 and a right cam press spring 69.

The right cam engagement member 67 is fixed to the wiper support member 61 by a screw via the through hole 673. The shaft portion 671 of the right cam engagement member 67 protrudes inside the wiper support member 61 via the hole portion 618 of the wipe support member 61 and protrudes inside the head guide 50 via the long hole 543 of the right arm portion 54 of the head guide 50. An engagement portion 672 formed in the front end of the shaft portion 671 is engaged with a wiper support member cam 823 of the right cam structure 82. The right cam press spring 69 (see FIG. 20 to 23) presses the engagement portion 672 of the right cam engagement portion 67 to the wiper support member cam 823 of the right cam structure 82 and is engaged with a spring engagement portion 542 formed in the right arm portion 54 of the head guide 50, thereby pressing the convex portion 541 formed in the right arm portion 54 to the head guide cam 82 of the right cam structure 822.

Similarly, the left cam engagement member 66 is fixed to the wiper support member 61 by the screw via the through hole 663. The shaft portion 661 of the left cam engagement member 66 protrudes inside the wiper support member 61 via the hole portion 617 of the wipe support member 61 and protrudes inside the head guide 50 via the long hole 533 of the left arm portion 53 of the head guide 50. An engagement portion 662 formed in the front end of the shaft portion 661 is engaged with a wiper support member cam (not shown) of the left cam structure 81. The left cam press spring 68 presses the engagement portion 662 of the left cam engagement portion 66 to a wiper support member cam (not shown) of the left cam structure 81 and presses the convex portion 531 formed on the left arm portion 53 of the head guide 50 to a head guide cam (not shown) of the left cam structure 81.

Cleaning Motion of First Wiper 63

A motion (hereinafter, referred to as "cleaning motion of the first wiper 63") that wipes the affixed matter attached to the first wiper 63 by the wiper cleaner 58 will be described with reference to FIGS. 19 to 23.

Figure 19:
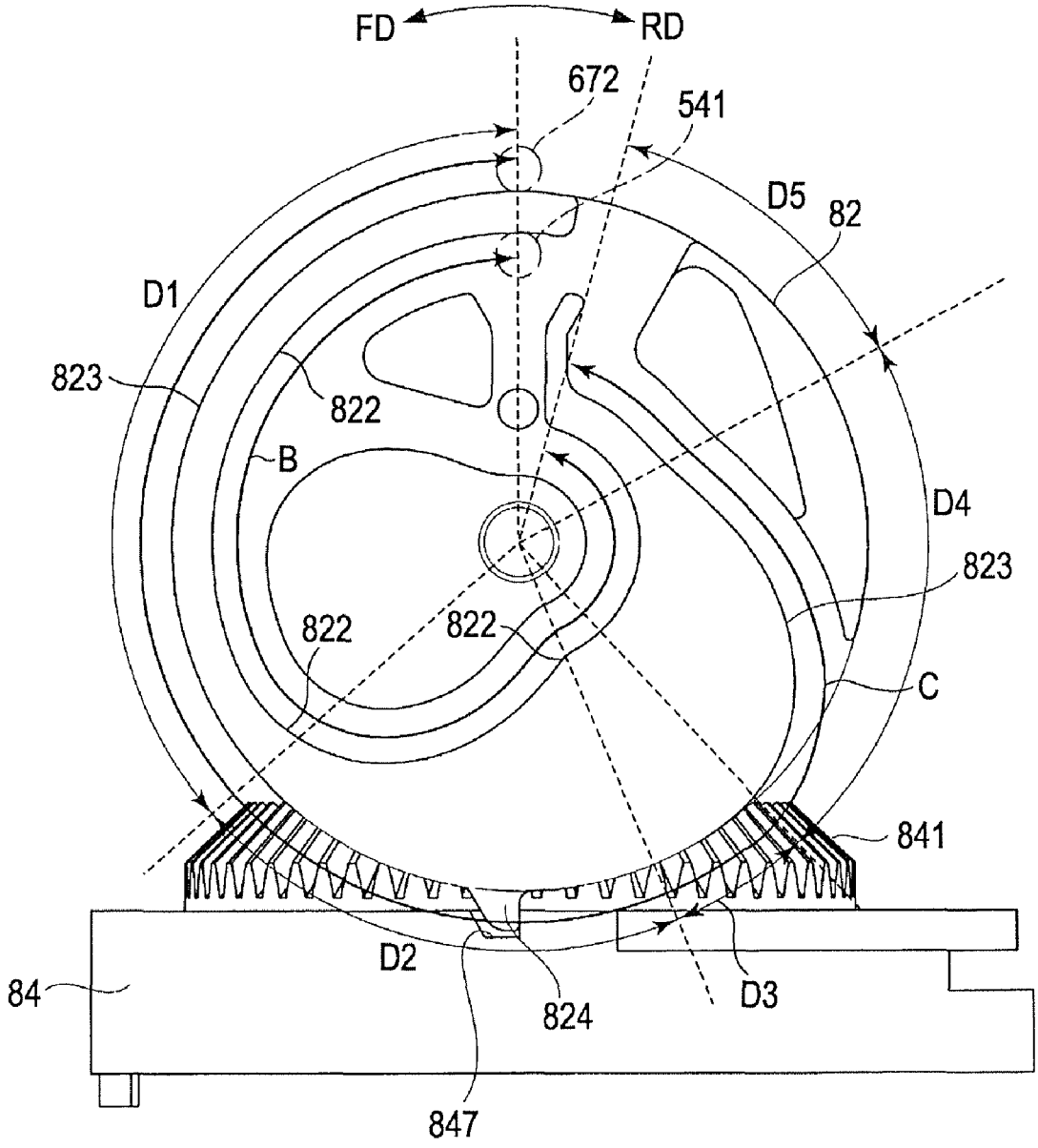
FIG. 19 is an enlarged side view of the principal part showing a portion where a right cam structure is provided.

FIG. 19 is an enlarged side view of the principal part that shows a portion where the right cam structure 82 is provided. FIGS. 20 to 23 are enlarged perspective views of the principal part that show a slide contact engagement portion of the first wiper 63 and the wiper cleaner 58.

A gear portion 811 of the left cam structure 81 and a gear portion 821 of the right cam structure 82 are engaged with a cam drive gear portion 841 of the rotating body 84 constituting a driving force transmission mechanism 80 described later. A protrusion portion 824 is formed at a predetermined position of the outer peripheral surface of the right cam structure 82. The protrusion portion 824 is engaged with a concave portion 847 formed outside the cam drive gear portion 841 of the rotating body 84 and acts to define the phase of the right cam structure 82 relative to the rotation position of the rotating body 84. For example, at the time of assembling the maintenance unit 3, the protrusion portion 824 of the right cam structure 82 is assembled in the state of being engaged with the concave portion 847 of the rotating body 84. As a result, in the state in which there is no deviation of the phase of the right cam structure 82 relative to the rotation position of the rotating body 84, it is possible to easily and reliably carry out the engagement of the gear portion 821 of the right cam structure 82 with the cam drive gear portion 841 of the rotating body 84.

As described above, since the left cam structure 81 and the right cam structure 82 are components having the same shape, hereinafter, the right cam structure 82 will be described and the description of the left cam structure 81 will be omitted.

The convex portion 541 formed in the right arm portion 54 of the head guide 50 is engaged with the head guide cam 822 of the right cam structure 82 in the range shown by reference numeral B (hereinafter, simply referred to as "the head guide 50 is engaged with the head guide cam 822"). That is, the head guide 50 is displaced in the Z direction along the shape of the head guide cam 822 of the right cam structure 82 in the range shown by reference numeral B. Furthermore, the engagement portion 672 formed in the right cam engagement portion 67 of the wiper support member 61 is engaged with the head guide cam 823 of the right cam structure 82 in the range shown by reference numeral C (hereinafter, simply referred to as "the wiper support member 61 is engaged with the wipe support member cam 823"). That is, the wiper unit 60 is displaced in the Z direction along the shape of the head guide cam 823 of the right cam structure 82 in the range shown by reference numeral C.

Figure 20:
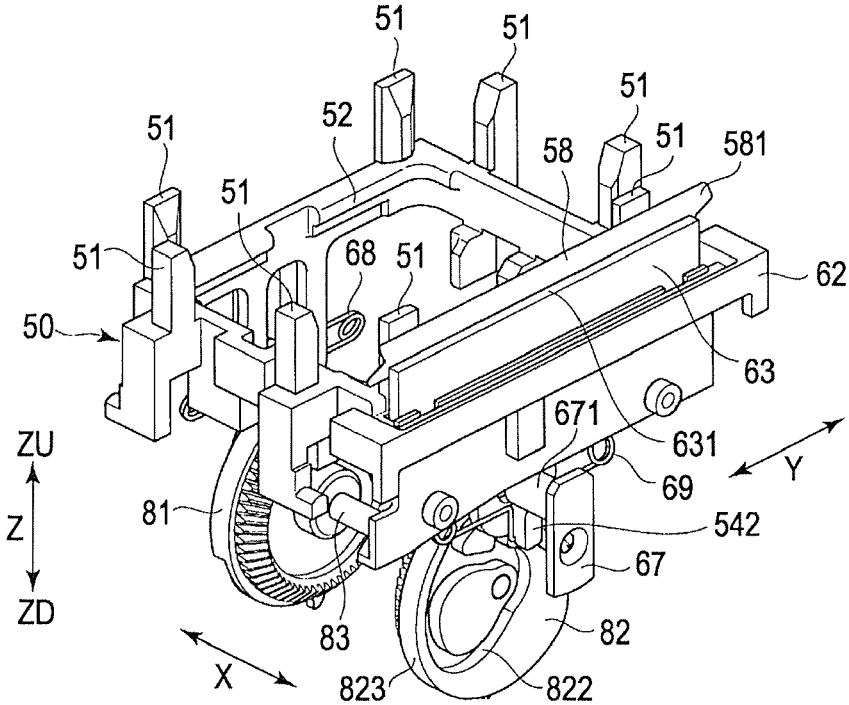
FIG. 20 is a perspective view of the principal part of a slide-contact engagement portion of a first wiper and a wiper cleaner.

In the rotation range (a first cam portion) shown by reference numeral D1 of the right cam structure 82, the head guide 50 and the wiper unit 60 are maintained in the state of being displaced to the uppermost position in the Z direction (FIG. 20). In this state, the guide portion 51 of the head guide 50 protrudes from the absorbent material surface 411 of the cap 40 to the recording heads 16 side (FIG. 9A). That is, in the state in which the relative positional relationship of the recording heads 16 and the cap 40 in a direction along the head surface of the recording heads 16 is regulated by the guide portion 51 of the head guide 50, the sealing portion 42*c* of the cap main body 42 can be brought into close contact with the head surface of the recording heads 16.

The wiper cleaner 58 provided on the guide portion 51 of the head guide 50 is adjacent to the wiping surface side of the first wiper 63. Furthermore, as shown, the slide contact engagement portion 581 of the wiper cleaner 58 is formed so that the front end side thereof is bent so as to protrude to the wiping surface side of the first wiper 63. In addition, in the state shown in FIG. 20, the front end 631 of the first wiper 63 is situated at the drop direction ZD from the slide contact engagement portion 581 of the wiper cleaner 58. For this reason, in the state shown in FIG. 20, the front end 631 of the first wiper 63 and the wiping surface of the first wiper 63 are covered with the wiper cleaner 58, whereby it is possible to reduce the concern that the affixed matter such as the paper powder, the dust or the like is attached to the wiping surface of the front end 631 of the first wiper 63 and the wiping surface of the first wiper 63. As a result, it is possible to reduce the possibility that the foreign matter attached to the first wiper 63 is transited and attached to the head surface of the recording heads 16.

Figure 21:
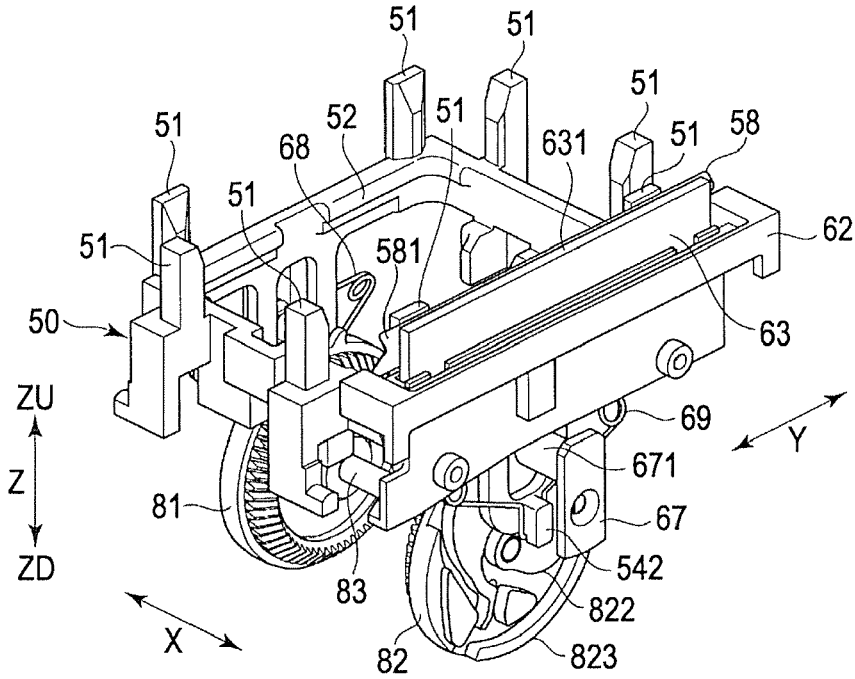
FIG. 21 is a perspective view of the principal part of a slide-contact engagement portion of a first wiper and a wiper cleaner.

In the rotation range (a second cam portion) shown by reference numeral D2 of the right cam structure 82, the wiper structure 60 is maintained at the state of being displaced to the uppermost position in the Z direction. On the other hand, the head guide 50 is displaced in the drop direction ZD when the right cam structure 82 is rotated in the reverse rotation direction RD, and the head guide 50 is displaced in the rise direction ZU when the right cam structure 82 is rotated in the forward rotation direction FD. That is, in the rotation range shown by reference numeral D2, the wiper unit 60 can move only the head guide 50 up and down (displacement in the Z direction) while maintaining the state of being displaced to the uppermost position in the Z direction (FIG. 21). Furthermore, in the process of moving only the head guide 50 up and down, the wiper cleaner 58 provided on the head guide 50 comes into slide contact with the portion from the front end 631 of the first wiper 63 to the side surface thereof, thereby performing the cleaning motion of the first wiper 63. As a result, the affixed matter attached to the first wiper 63 is removed by the wiper cleaner 58.

Figure 22:
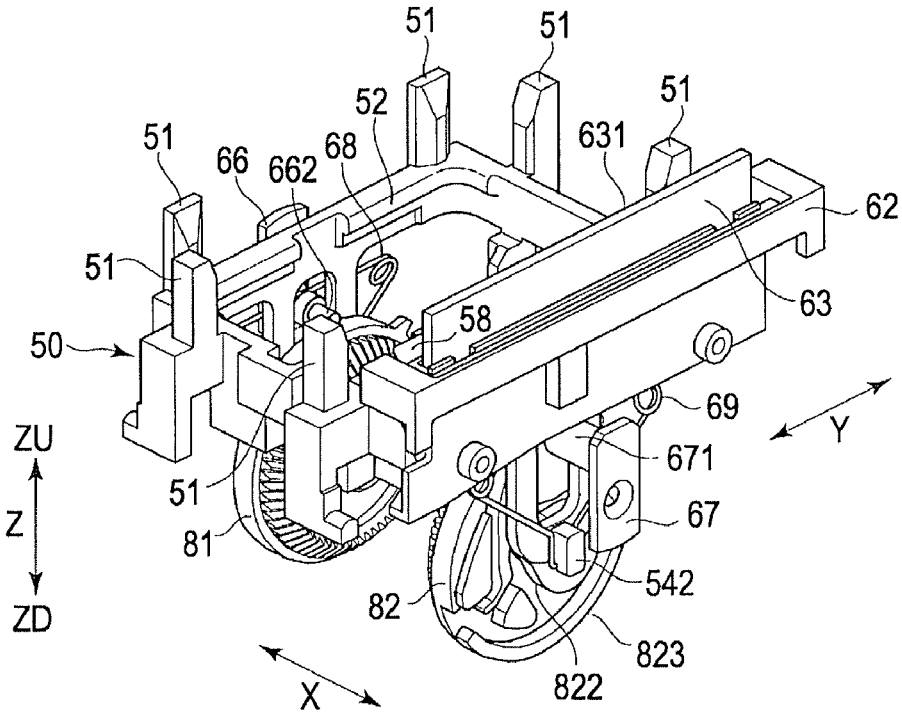
FIG. 22 is a perspective view of the principal part of a slide-contact engagement portion of a first wiper and a wiper cleaner.

In the rotation range shown by reference numeral D3 of the right cam structure 82, in the state in which the wiper unit 60 is displaced to the uppermost position in the Z direction, the head guide 50 is maintained at the state of being displaced to the lowermost position in the Z direction (FIG. 22). In this state, the first wiper 63 protrudes from the guide portion 51 of the head guide 50 to the recording heads 16 side (FIG. 22). Thus, in this state, it is possible to wipe the head surface of the recording heads 16 by the first wiper 63.

In the range (a third cam portion) shown by reference numeral D4 of the right cam structure 82, the head guide 50 is maintained at the state of being displaced to the lowermost position in the Z direction. On the other hand, the wiper unit 60 is displaced in the drop direction ZD when the right cam structure 82 is rotated in the rearward rotation direction RD, and the wiper unit 60 is displaced in the rise direction ZU when the right cam structure 82 is rotated in the forward rotation direction FD. That is, in the rotation range shown by reference numeral D4, the head guide 50 can move only the wiper 60 up and down (displacement in the Z direction), while maintaining the state of being displaced to the lowermost position in the Z direction (FIG. 21). Furthermore, in the process of moving only the wiper unit 60 up and down, the wiper cleaner 58 provided on the head guide 50 comes into slide contact with the portion from the front end 631 of the first wiper 63 to the side surface thereof, thereby performing the cleaning motion of the first wiper 63. As a result, the affixed matter attached to the first wiper 63 is removed by the wiper cleaner 58.

Figure 23:
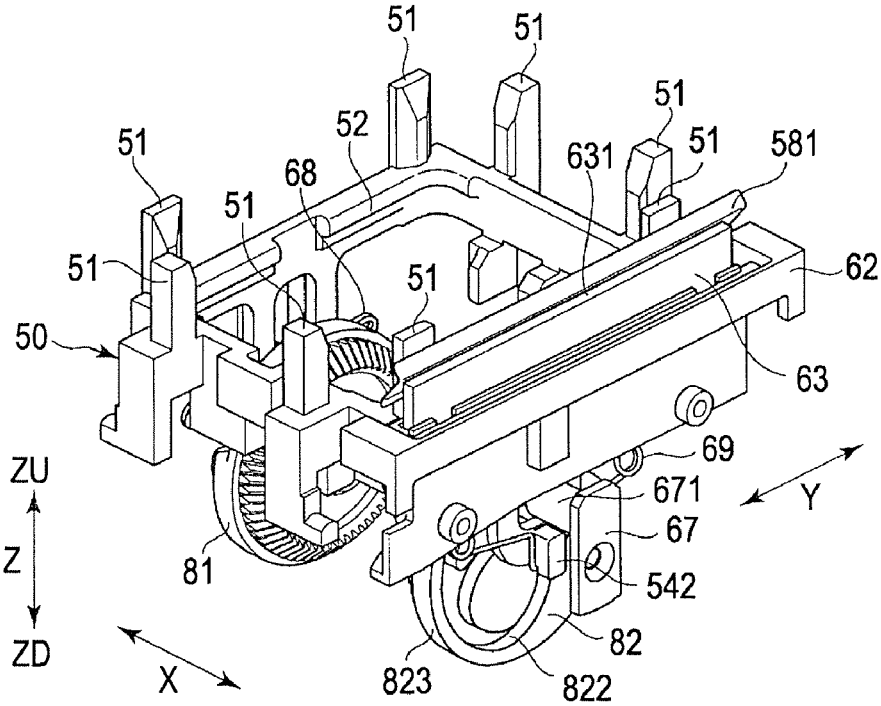
FIG. 23 is a perspective view of the principal part of a slide-contact engagement portion of a first wiper and a wiper cleaner.

In the rotation range shown by reference numeral D5 of the right cam structure 82, both of the head guide 50 and the wiper unit 60 are maintained at the state of being displaced to the lowermost position in the Z direction (FIG. 23). In this state, the absorbent material surface 411 of the cap 40 slightly protrudes from the protrusion end of the guide portion 51 of the head guide 50 and the front end 631 of the first wiper 63 to the head surface side of the recording heads 16 (FIG. 9B). During recording implementation onto the recording paper P, it is possible to maintain the gap between the head surface of the recording heads 16 and the absorbent material surface 411 of the cap 40 at a gap suitable for the flushing, thereby performing the flushing. Furthermore, even in this state, the front end 631 of the first wiper 63 is covered with the wiper cleaner 58. During recording implementation onto the recording paper P, since the paper powder easily rises up and floats especially when the recording paper P is transported, by maintaining the above state during recording implementation onto the recording paper P, it is possible to reduce the concern that the paper powder is attached to the first wiper 63 during recording implementation onto the recording paper P.

In this manner, in the process of sequentially transiting the state of the maintenance unit 3 from the state (FIG. 9A) in which the sealing motion of the head surface of the recording heads 16 can be regulated by the head guide 50 at a high accuracy to the state (FIG. 22) in which the wiping is possible, and the state (FIG. 9B) in which the flushing is possible at an optimal ejection distance, the cleaning motion of the first wiper 63 is performed at least twice. Furthermore, in the process of sequentially transiting the state of the maintenance unit 3 in the reverse order, the cleaning motion is also performed at least twice. That is, among a series of maintenance operations that individually moves the head guide 50 and the wiper unit 60 forward and rearward with respect to the recording heads 16, the cleaning motion of the first wiper 63 by the wiper cleaner 58 can be performed at least four times without generating an unnecessary operation. As a result, it is possible to reliably reduce the concern that the whole affixed matters attached to the first wiper 63 cannot be removed, without lowering the throughput of the ink jet printer 1.

Configuration of Atmosphere Opening Valve Unit 70

A configuration of the atmosphere opening valve unit 70 will be described with reference to FIGS. 24 to 27.

Figure 24:
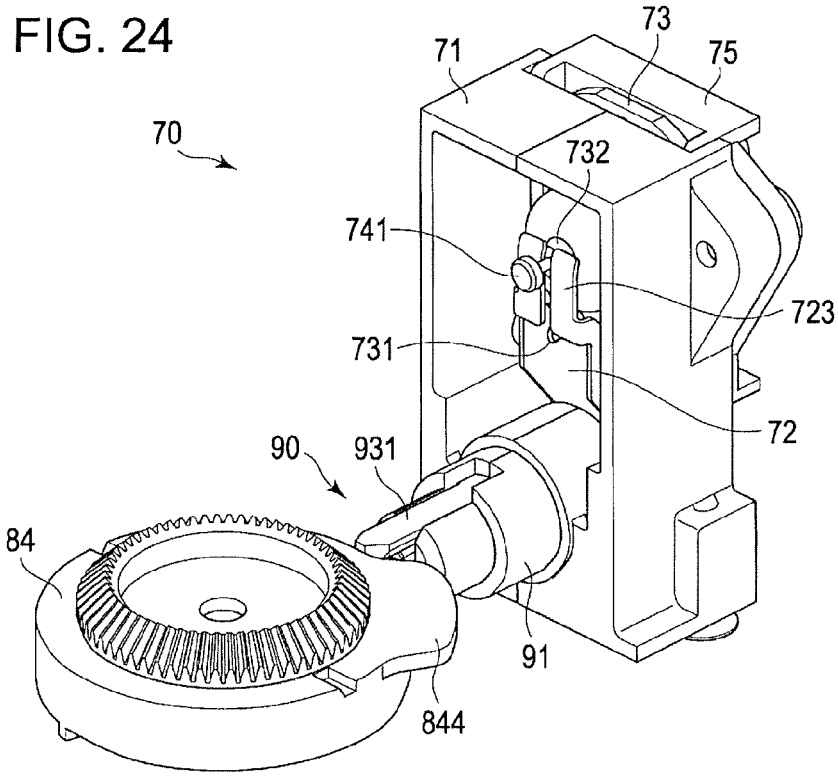
FIG. 24 is a perspective view of an atmosphere opening valve unit seen obliquely from a front part thereof.
Figure 25:
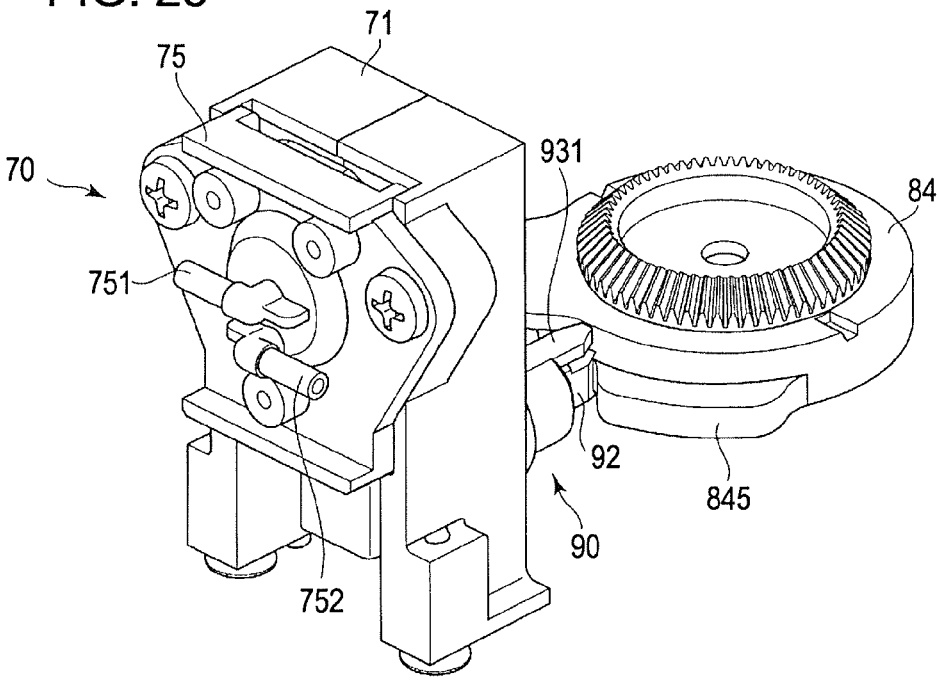
FIG. 25 is a perspective view of an atmosphere opening valve unit seen obliquely from a rear part thereof.
Figure 26:
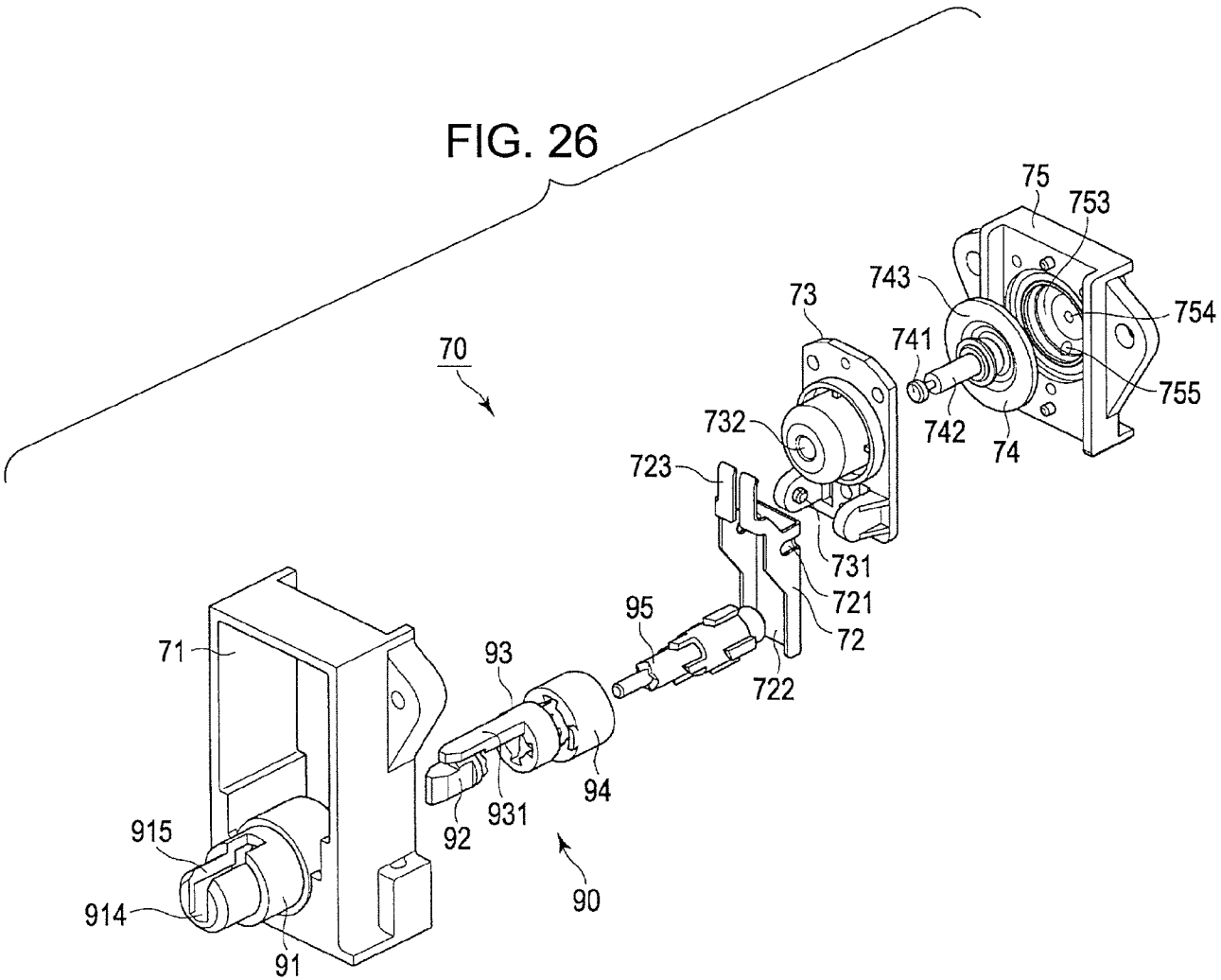
FIG. 26 is an exploded perspective view of an atmosphere opening valve unit.
Figure 27:
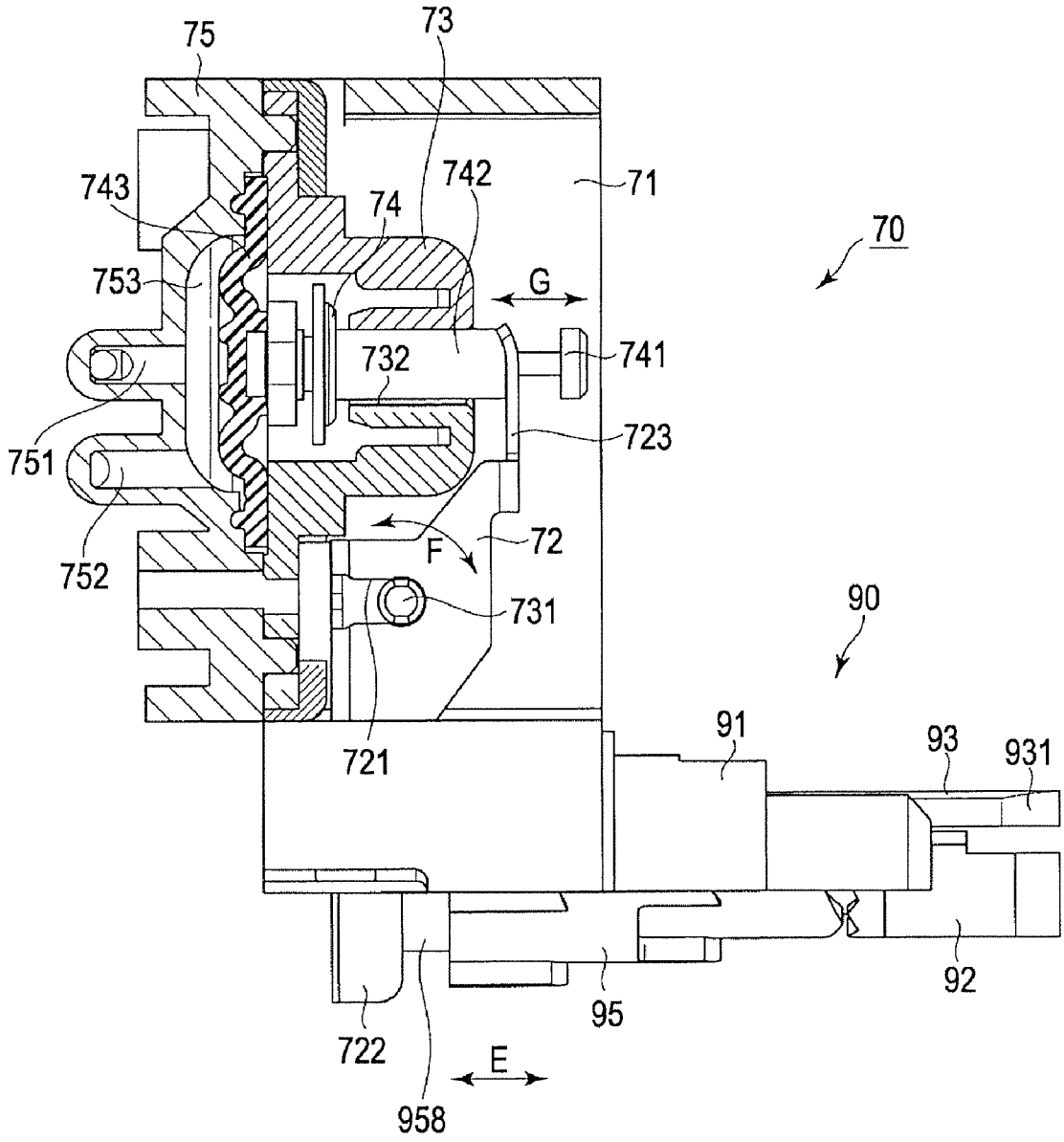
FIG. 27 is a side view of an atmosphere opening valve unit with a part thereof shown in cross section.

FIG. 24 is a perspective view when the atmosphere opening valve unit 70 is seen obliquely from the front part thereof. FIG. 25 is a perspective view when the atmosphere opening valve unit 70 is seen obliquely from the rear part thereof. FIG. 26 is an exploded perspective view of the atmosphere opening valve unit 70. FIG. 27 is a side view of the atmosphere opening valve unit 70 with a part thereof shown in cross section.

The atmosphere opening valve unit 70 is provided to opening and closing an atmosphere communication path that opens the negative chamber 421 of the cap 40 to the atmosphere. The atmosphere opening valve unit 70 has a unit case 71, a rolling member 72, a support member 73, a valve main body support portion 74, a valve seat portion 75 and a push latch mechanism portion 90.

The unit case 71 is configured so that a mechanism main portion 91 constituting a part of the push latch mechanism portion 90 is formed integrally therewith and the valve seat portion 75 is fixed by a screw. The support member 73 is fixed to the valve seat portion 75 by the screw. The rolling member 72 is supported by the support member 73 so as to be rollable in a direction shown by reference numeral F in the state in which the notch portion 721 is engaged with the rolling support convex portion 731 of the support member 73. Moreover, the rolling member 72 is pressed to a rolling direction by which a contacted portion 722 comes into contact with a contact portion 958 of an operation shaft body 95 constituting a part of the push latch mechanism portion 90, by a press member such as a twist coil spring (not shown). That is, the operation shaft body 95 of the push latch mechanism portion 90 is displaced in the operation direction E, whereby the rolling member 72 rolls in the rolling direction F.

The valve main body support portion 74 is supported by the support member 73 so as to be displaceable in a direction shown by reference numeral G (hereinafter, referred to as "open and closed direction G") in the state in which the shaft portion 742 is inserted into an insertion hole 732 of the support member 73. An engagement portion 723 of the rolling member 72 is engaged with an engaged portion 741 formed at the front end of the shaft portion 742. That is, the valve main body support portion 74 is provided so as to be moved back and forth in the open and closed direction G through the rolling of the rolling member 72 in the rolling direction G. The valve main body 743 supported by the valve main body support portion 74 is a disk-shaped member having steps and is formed of a material such as rubber having flexibility. The valve main body 743 is elastically deformed in a direction which comes into contact with and is separated from the inner peripheral surface of the valve seat portion 75 together with the reciprocation movement of the shaft portion 742 in the open and closed direction G, while maintaining the state of coming into close contact with the periphery edge of the concave surface-shaped valve seat 753 without gap.

A first tube portion 751 and a second tube portion 752 are provided at the rear surface side of the valve seat 75. The first tube portion 751 is connected to the atmosphere communication hole portion 429 of the cam main body 42 of the cap 40 via an atmosphere opening tube (not shown) having flexibility. The second tube portion 752 is opened to the atmosphere via an atmosphere opening tube (not shown). On the valve seat 753 of the valve seat portion 75, there are formed a first through hole 754 through which the first tube portion 751 communicates with the inner peripheral surface of the valve seat 753, and a second through hole 752 through which the second tube portion 755 communicates with the inner peripheral surface of the valve seat 753.

In the atmosphere opening valve unit 70 having this configuration, the rolling member 72 rolls in the rolling direction F through the displacement of the operation shaft body 95 of the push latch mechanism portion 90 in the operation direction E. As a result, the valve main body support portion 74 moves back and forth in the open and closed direction G, whereby the valve main body 743 is elastically deformed in the direction contacting and separated from the inner peripheral surface of the inner peripheral surface of the valve seat portion 75. In the state in which the center portion of the valve main body 743 is separated from the inner peripheral surface of the valve seat 753, the first tube portion 751 and the second tube portion 752 communicate with each other through the closed space formed between the inner peripheral surface of the valve seat 753 and the valve main body 743. In that state, the atmosphere opening valve unit 70 enters the opened state, that is, the absorbent material surface 411 of the cap 40 is opened to the atmosphere via the atmosphere opening tube. On the other hand, in the state in which the center portion of the valve main body 743 comes into plane contact with and is seated on the inner peripheral surface of the valve seat 753, the first thorough hole 754 and the second through hole 755 are blocked by the valve main body 743. For this reason, the communication of the first tube portion 751 and the second tube portion 752 is blocked by the valve main body 743, whereby, in that state, the atmosphere opening valve unit 70 enters the closed state, that is, the absorbent material surface 411 of the cap 40 is not opened to the atmosphere via the atmosphere opening tube.

Configuration of Push Latch Mechanism Portion 90

A configuration of a push latch mechanism portion 90 will be described with reference to FIGS. 24 to 27, 28 and 29.

Figure 28:
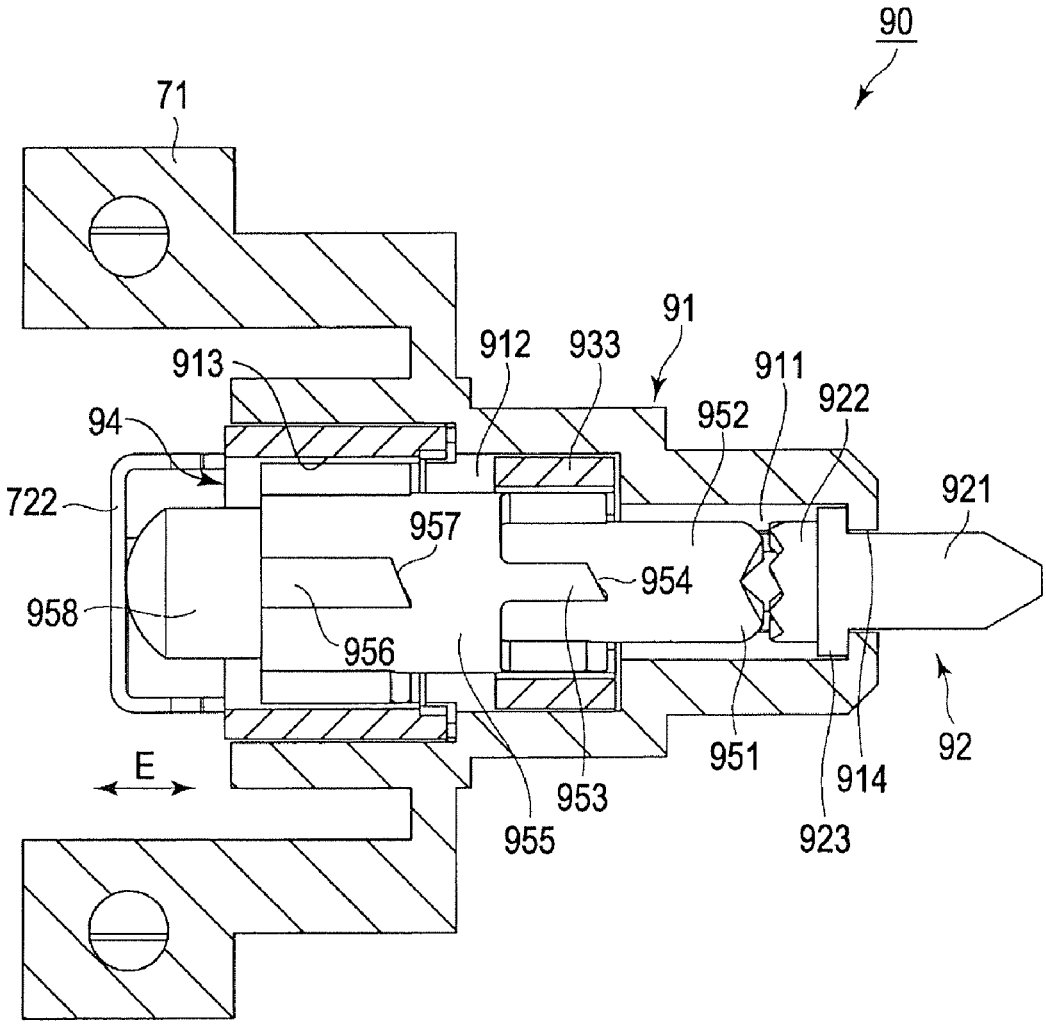
FIG. 28 is a bottom view of a push latch mechanism portion with a part thereof shown in cross section.
Figure 29:
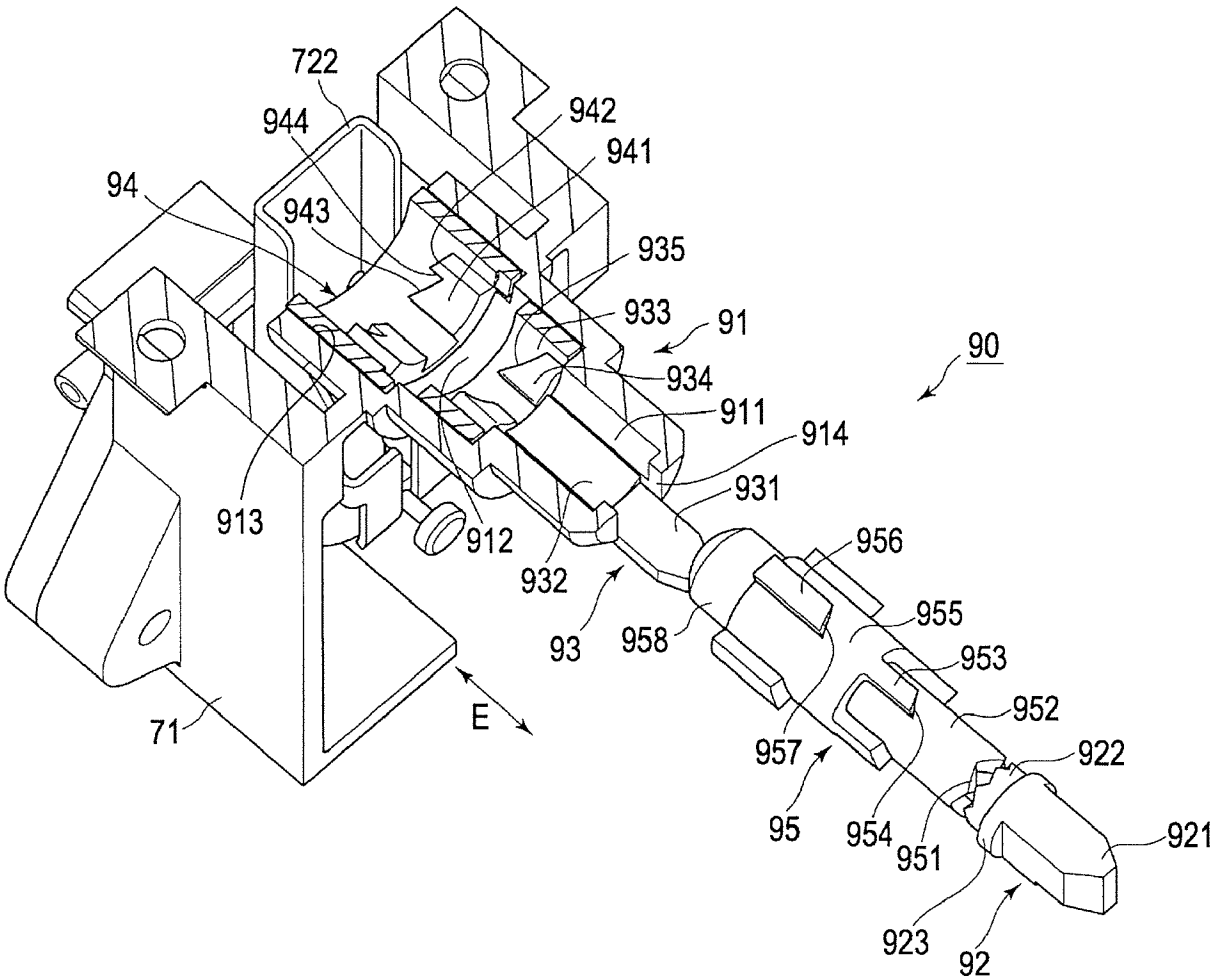
FIG. 29 is an exploded perspective view of a push latch mechanism portion with a part thereof shown in cross section from a bottom side.

FIG. 28 is a bottom diagram of the push latch mechanism portion 90 with a part thereof shown in cross section. FIG. 29 is an exploded perspective view of the push latch mechanism portion 90 when seen from the bottom surface side thereof with a part thereof shown in cross section.

The push latch mechanism portion 90 for performing the opening and closing operation of the valve main body 743 of the atmosphere opening valve unit 70 has a mechanism main body portion 91, a push member 92, a reset member 93, a cylinder body 94, and an operation shaft body 95.

The mechanism main body portion 91 is formed integrally with the unit case 71 as described above. The mechanism main body portion 91 has a first cylinder portion 911, a second cylinder portion 912, and a third cylinder portion 913 that have consecutive spaces formed therein in which inner diameters thereof are expanded by stages. At an inlet portion of the first cylinder portion 911, a rectangular-shaped guide hole 914 is formed. On the upper part of the first cylinder portion 911, a guide portion 915 which is notched along the operation direction E is formed.

The push member 92 is supported by the first cylinder portion 911 so as to be displaceable in the operation direction E in the state the push member 92 is guided to the guide hole 914 and the rotation in the circumferential direction is locked, and has a push operation portion 921, a wave teeth cam portion 922 and a locking portion 923. The push operation portion 921 is disposed in the state in which the front end thereof protrudes from the guide hole 914 of the first cylinder portion 911. The locking portion 923 has a diameter that is slightly smaller than the inner diameter of the first cylinder portion 911, and forms a disk shape larger than the guide hole 914. The outer peripheral surface of the locking portion 923 comes into slide contact with the inner peripheral surface of the first cylinder portion 911, whereby the push operation portion 921 is supported so as to be displaceable in the operation direction E. Furthermore, the locking portion 923 of the push operation portion 921 prevents the push operation portion 921 from being eliminated from the first cylinder portion 911 when being displaced in the operation direction E. On the wave teeth cam portion 922, eight wave teeth, in which an up inclined surface and a down inclined surface are alternately formed in the circumferential direction, are formed in the circumferential direction at equal distances.

The reset member 93 is disposed so as to be displaceable in the operation direction E in the state in which the cylinder portion 933 is inserted into the second cylinder portion 912 and the reset operation portion 931 is engaged with the guide portion 915 of the first cylinder portion 911. The reset member 93 is pressed in a direction protruding to the rotating body 84 side, by a press unit (not shown) such as a coil spring. The reset operation portion 931 is formed on the cylinder portion 933 so as to protrude in the operation direction E, and at the rear side of the portion of the first cylinder portion 911 that is engaged with the guide portion 915, an inner wall surface portion 932 is formed so as to complement the inner peripheral surface of the first cylinder portion 911. On the inner peripheral surface of the cylinder portion 933 of the reset member 93, four reset protrusions 934 are formed at regular distances in the circumferential direction. At one end of the reset protrusions 934 in the operation direction E, a reset guide inclined surface 935 which slopes relative to the circumferential direction at a regular angle is formed.

The cylinder body 94 is inserted into the third cylinder portion 913 and is fixed at a predetermined position. That is, the cylinder body 94 is provided in the third cylinder portion 913 in the state of not being rotated in the circumferential direction and not being displaced in the operation direction E. On the inner peripheral surface of the cylinder body 94, four push latch protrusions 941 are formed at regular distances in the circumferential direction. The push latch protrusions 941 are formed at positions corresponding to the operation direction E with respect to the reset protrusions 934 of the reset member 93. At one end of the push latch protrusion 941 in the operation direction E, a first guide inclined surface 942, a second guide inclined surface 943, and a locking portion 944 are formed. The first guide inclined surface 942 and the second guide inclined surface 943 are inclined surfaces that slope with respect to the circumferential direction at regular angles, and the inclination direction thereof is the same as the inclination direction of the reset guide inclined surface 935 of the reset member 93. The locking portion 944 will be described later.

The operation shaft body 95 is disposed so as to be displaceable in the operation direction E and rotatable in the circumferential direction in the state of being inserted into the cylinder portion 933 of the reset member 93 and the cylinder body 94, and has a wave teeth contact portion 951, a first shaft portion 952, a second shaft portion 955, and a contact portion 958. The wave teeth contact portion 951 is formed at a position facing the wave teeth cam portion 922 of the push member 92. Furthermore, a up inclined surface and a down inclined surface are alternately repeated on the wave teeth contact portion 951 in the circumferential direction, whereby four wave teeth are formed at regular distances in the circumferential direction. On the first shaft portion 952, in the portion corresponding to the inner peripheral surface of the cylinder portion 933 of the reset member 93, four first protrusions 953 having inclined surfaces 954, which slope at regular angles in the circumferential direction, formed at end portions thereof are formed at regular distances in the circumferential direction. On the second shaft portion 955, in the portion corresponding to the inner peripheral surface of the cylinder body 94, four second protrusions 956 having inclined surfaces 957, which slope at regular angles in the circumferential direction, formed at end portions thereof are formed at regular distances in the circumferential direction. The four first protrusions 953 are formed at positions corresponding to the operation direction E with respect to the valley portion of the wave teeth of the wave teeth contact portion 951. Moreover, four second protrusions 956 are formed at positions corresponding to the operation direction E with respect to the four first protrusions 953. The contacted portion 722 of the rolling member 72 is in contact with the contact portion 958, whereby the pressing force due to the press unit described above acts via the rolling member 72. That is, the pressing force in the direction coming into contact with the push member 92 acts on the operation shaft body 95.

Push Latch Operation of Push Latch Mechanism Portion 90

A push latch motion in the push latch mechanism portion 90 will be described with reference to FIGS. 30A to 30H.

FIGS. 30A to 30H are motion explanation diagrams that schematically show push latch motions in the push latch mechanism portion 90.

Figure 30A:
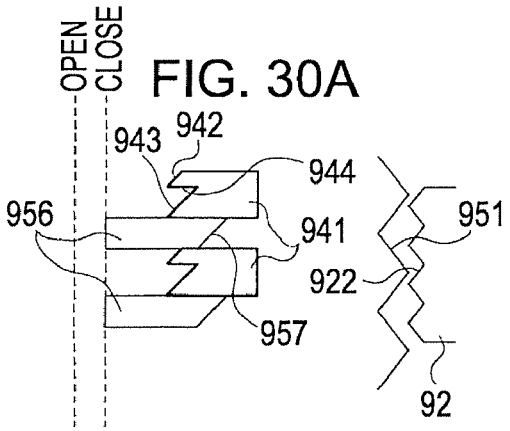
FIGS. 30A to 30H are motion explanation diagrams that schematically show push latch motions.

Furthermore, in FIGS. 30A to 30H, in order to make the drawings easier to understand, reference numerals are applied only to FIG. 30A, and reference numerals are omitted to FIGS. 30B to 30H.

Firstly, motions from the closed state of the atmosphere opening valve unit 70 to the opened state thereof will be described with reference to FIGS. 30A to 30D.

In the push latch mechanism portion 90, in the state in which four second protrusions 956 of the operation shaft body 95 enter between the push latch protrusions 941 of the cylinder body 94, the atmosphere opening valve unit 70 enters the closed state (FIG. 30A).

Figure 30B:
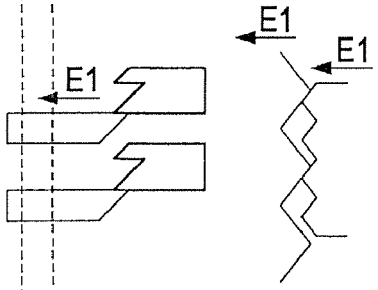

From this state, when the push latch cam 845 formed on the rotating body 84 is engaged with the push operation portion 921 of the push member 92, the push member 92 is displaced in a pushing movement direction E1. The pushing movement direction E1 is a direction of the operation direction E, a direction in which the push operation portion 921 of the push member 92 is pushed by the push latch cam 845, and a direction in which the reset portion 931 of the reset member 93 is pushed by the reset cam 844. The push member 92 is displaced in the pushing movement direction E1, whereby the wave teeth cam portion 922 of the push member 92 comes into contact with the wave teeth contact portion 951 of the operation shaft body 95, so that the push member 92 pushes the operation shaft body 95 in the pushing movement direction E1 in resistance to the pressing force acting from the rolling member 72. At this time, since the wave teeth cam portion 922 of the push member 92 and the wave teeth contact portion 951 of the operation shaft body 95 are in contact with each other at the inclined surfaces of the wave teeth, by the pressing force acting from the rolling member 72, the rotational force in the circumferential direction acts on the operation shaft body 95. However, while the four second protrusions 956 of the operation shaft body 95 enter between the push latch protrusions 941 of the cylinder body 94, the rotation of the operation shaft 95 in the circumferential direction is locked by the push latch protrusion 941. Thus, the operation shaft body 95 is displaced only in the pushing movement direction E1 in the meantime (FIG. 30B).

Figure 30C:
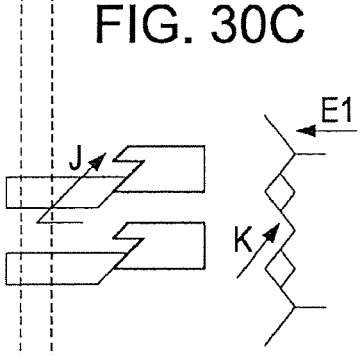

When the push member 92 is gradually further pushed in the pushing movement direction E1, the operation shaft body 95 is displaced in the pushing movement direction E1 up to a position where the four second protrusions 956 of the operation shaft body 95 are separated from the portion between the push latch protrusions 941 of the cylinder body 94. At that point in time, the hook of the rotation of the operation shaft body 95 in the circumferential direction is released. For that reason, until reaching the state in which the valley portion of the wave teeth cam portion 922 of the push member 92 is mated with the peak portion of the wave teeth contact portion 951 of the operation shaft body 95 by the pressing force acting from the rolling member 72, the operation shaft body 95 is displaced while being rotated in a direction along the inclined surface of the wave teeth (reference numeral K). As a result, the operation shaft body 95 is rotated and displaced in a trace shown by reference numeral J, whereby the inclined surface 957 of the second protrusion 956 of the operation shaft body 95 comes into contact with the second guide inclined surface 943 of the push latch protrusion 941 of the cylinder body 94 (FIG. 30C).

Figure 30D:
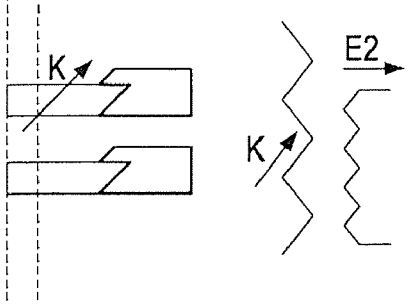

When the push latch cam 845 is separated from the push operation portion 921 of the push member 92, the operation shaft body 95 is displaced while being rotated in a direction along the second guidance inclined surface 943 of the push latch protrusion 941 of the cylinder body 94, by the pressing force acting from the rolling member 72 (reference numeral K). In addition, the second protrusion 956 of the operation shaft body 95 comes into contact with the locking portion 944 of the push latch protrusion 941 of the cylinder body 94. As a result, the state in which the operation shaft body 95 is engaged with the cylinder body 94 is maintained. In this state, the atmosphere opening valve unit 70 enters the opened state (FIG. 30D). Furthermore, the push member 92 is pushed to the operation shaft body 95 and is displaced in the press direction E2. The press direction E2 is another direction of the operation direction E and is a direction of the pressing force acting on the operation shaft body 95 via the rolling member 72.

Next, the operation from the opened state of the atmosphere opening valve unit 70 to the closed state thereof will be described with reference to FIGS. 30E to 30H.

Figure 30E:
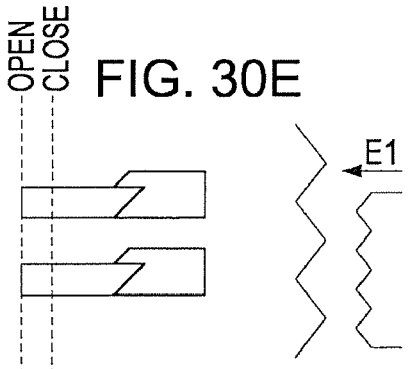

When the push latch cam 845 formed on the rotating body 84 is engaged with the push operation portion 921 of the push member 92 from the opened state of the atmosphere opening valve unit 70, the push member 92 is displaced in the pushing movement direction E1 (FIG. 30E).

Figure 30F:
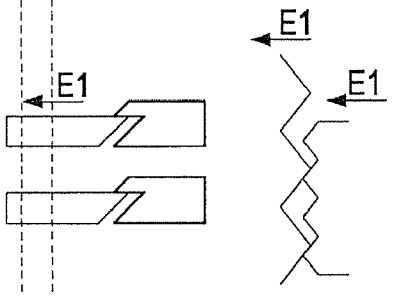

By the displacement of the push member 92 in the pushing movement direction E1, the wave teeth cam portion 922 of the push member 92 comes into contact with the wave teeth contact portion 951 of the operation shaft body 95, the push member 92 pushes the operation shaft body 95 in the pushing movement direction E1 in resistance to the pressing force acting from the rolling member 72. At this time, since the wave teeth cam portion 922 of the push member 92 and the wave teeth contact portion 951 of the operation shaft body 95 are in contact with each other at the inclined surfaces of the wave teeth, by the pressing force acting from the rolling member 72, the rotational force in the circumferential direction acts on the operation shaft body 95. However, while the four second protrusions 956 of the operation shaft body 95 is locked to the locking portion 944 of the push latch protrusions 941 of the cylinder body 94, the rotation of the operation shaft body 95 in the circumferential direction is locked. Thus, the operation shaft body 95 is displaced only in the pushing movement direction E1 in the meantime (FIG. 30F).

Figure 30G:
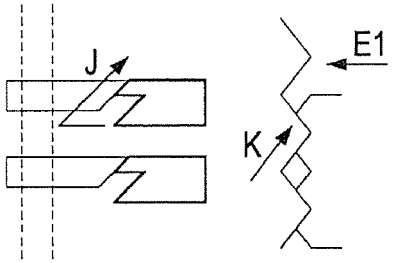

When the push member 92 is gradually further pushed, the operation shaft body 95 is displaced in the pushing movement direction E1 up to a position where the four second protrusions 956 of the operation shaft body 95 are separated from the locking portion 944 of the push latch protrusions 941 of the cylinder body 94. At that point in time, the hook of the rotation of the operation shaft body 95 in the circumferential direction is released. As a result, until reaching the state in which the valley portion of the wave teeth cam portion 922 of the push member 92 is mated with the peak portion of the wave teeth contact portion 951 of the operation shaft body 95 by the pressing force acting from the rolling member 72, the operation shaft body 95 is displaced while being rotated in a direction along the inclined surface of the wave teeth (reference numeral K). Furthermore, concurrently, the operation shaft body 95 is rotated and displaced in a trace shown by reference numeral J, whereby the inclined surface 957 of the second protrusion 956 of the operation shaft body 95 comes into contact with the first guide inclined surface 942 of the push latch protrusion 941 of the cylinder body 94 (FIG. 30G).

Figure 30H:
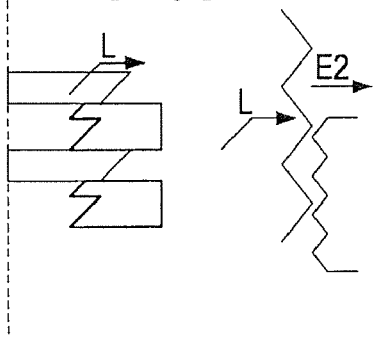

When the push latch cam 845 is separated from the push operation portion 921 of the push member 92, the operation shaft body 95 is displaced, while being rotated in a direction along the first guidance inclined surface 942 of the push latch protrusion 941 of the cylinder body 94, by the pressing force acting from the rolling member 72. As a result, the four second protrusions 956 of the operation shaft body 95 enter the portion between the push latch protrusions 941 of the cylinder body 94 (reference numeral L). Furthermore, the push member 92 is pushed to the operation shaft body 95 and is displaced in the press direction E2. In this state, the atmosphere opening valve unit 70 enters the closed state (FIG. 30H).

In this manner, the atmosphere opening valve unit 70 can switch from and to the opened state and the closed state by the push latch mechanism portion 90. That is, when performing the pushing movement of the push operation portion 921 of the push latch mechanism portion 90, the opened state and the closed state of the atmosphere opening valve unit 70 are alternately and completely switched. Furthermore, since the push latch mechanism portion 90 is a mechanism that maintains the operation state itself, the open and closed state of the atmosphere opening valve unit 70 is maintained by the push latch mechanism portion 90. Since the related art had a structure in which the cap 40 is slightly displaced in the range capable of maintaining the sealing state of the head surface of the recording heads 16 by the cap 40 to opening and closing the atmosphere opening valve, there is a possibility that the sealing state of the head surface becomes unstable due to the open and close operation of the atmosphere opening valve. On the contrary to this, the maintenance unit 3 according to an aspect of the invention can switch the open and closed state of the atmosphere opening valve unit 70 while maintaining the positional relationship of the recording heads 16 and the cap, in the state of sealing the head surface of the recording heads 16 by the cap 40.

Furthermore, the maintenance unit 3 according to an aspect of the invention is configured so that the mechanism for driving the atmosphere opening valve unit 70 also serves as the drive mechanism of other members, but has a configuration in which the open and closed state of the atmosphere opening valve unit 70 is maintained itself by the push latch mechanism portion 90. For that reason, a complicated drive mechanism is not necessary for driving other members while maintaining the open and closed state of the atmosphere opening valve unit 70.

According to an aspect of the invention as described above, regardless of the open and closed state of the atmosphere communication path by the atmosphere opening valve unit 70, it is possible to realize the head repairing apparatus 2 capable of sealing the head surface of the recording heads 16 in the sufficient and stable close contact state by the low-cost configuration.

Furthermore, the push latch mechanism portion 90 is not particularly limited to the aspect of the present embodiment. That is, if a mechanism has a configuration in which the open and closed state of the atmosphere opening valve unit 70 can be switched when performing the pushing movement operation of the operation portion and the operation state can be maintained itself, any type of mechanism may be used. For example, a push latch mechanism which uses a so-called heart cam may be used.

Reset Motion in Push Latch Mechanism Portion 90

A reset motion in the push latch mechanism portion 90 will be described with reference to FIGS. 31A to 31G.

FIGS. 31A to 31G are motion explanation diagrams that schematically show a reset operation in the push latch mechanism portion 90.

Figures 31A, 31B, 31C, 31D, 31E, 31F, 31G:
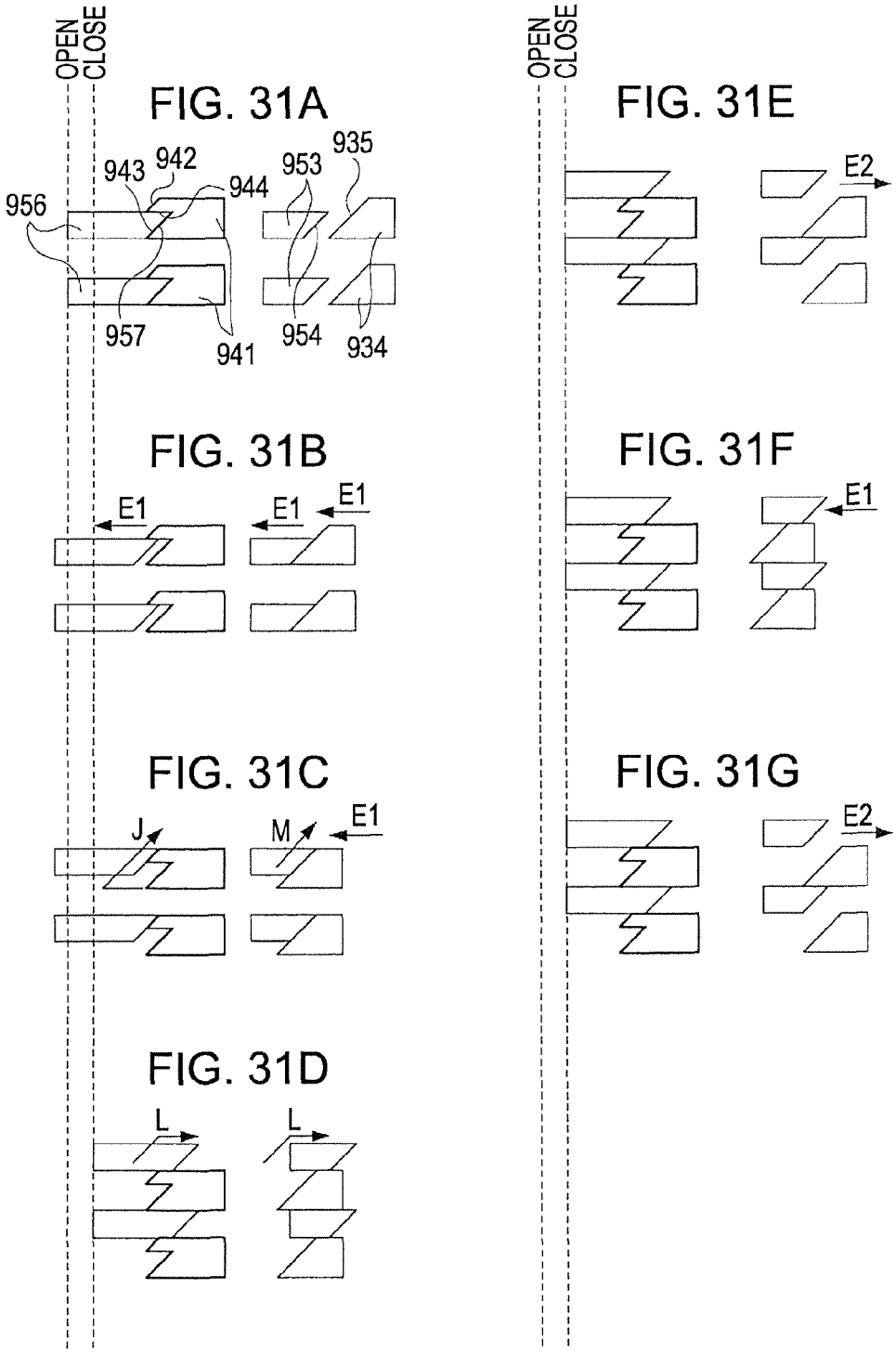
FIGS. 31A to 31G are motion explanation diagrams that schematically show reset motions.

Moreover, even in FIG. 31, in order to make the drawings easier to understand, reference numerals are applied only to FIG. 31A, and in FIGS. 31B to 31G, reference numerals are omitted.

Firstly, the reset portion when the atmosphere opening valve unit 70 is opened will be described with reference to FIGS. 31A to 31E.

In the state in which the second protrusion 956 of the operation shaft body 95 comes into contact with the locking portion 944 of the push latch protrusion 941 of the cylinder body 94 and the operation shaft body 95 is locked by the cylinder body 94 in that position, the opened state of the atmosphere opening valve unit 70 is maintained. In this state, with respect to the reset protrusion 934 of the reset member 93, the first protrusion 953 of the operation shaft body 95 enters the state of existing in the position corresponding to the operation direction E. That is, the reset guide inclined surface 935 of the reset member 93 faces the inclined surface 954 of the operation shaft body 95 in the positional relationship capable of coming into contact with each other in the operation direction E (FIG. 31A).

When the reset cam 844 formed on the rotating state 84 is engaged with the reset operation portion 931 of the reset member 93 from this state, the reset member 93 is displaced in the pushing movement direction E1. By the displacement of the reset member 93 in the pushing movement direction E1, the reset guide inclined surface 935 of the reset protrusion 934 comes into contact with the inclined surface 954 of the first protrusion 953 of the operation shaft body 95, so that the reset member 93 pushes the operation shaft body 95 in the pushing movement direction E1 in resistance to the pressing force acting from the rolling member 72. At this time, since the reset member 93 and the operation shaft body 95 are in contact with each other in the inclined surfaces, by the pressing force acting from the rolling member 72, the rotational force in the circumferential direction acts on the operation shaft body 95. However, while four second protrusion 956 of the operation shaft body 95 are locked to the locking portion 944 of the push latch protrusion 941 of the cylinder body 94, the rotation of the operation shaft body 95 in the circumferential direction is locked by the locking portion 944. Thus, the operation shaft body 95 is displaced in the pushing movement direction E1 in the meantime (FIG. 31B).

When the reset member 93 is gradually further pushed, the operation shaft body 95 is displaced in the pushing movement direction E1 up to a position where the four second protrusions 956 of the operation shaft body 95 are separated from the locking portion 944 of the push latch protrusions 941 of the cylinder body 94. At that time point, the hook of the rotation of the operation shaft body 95 in the circumferential direction is released. As a result, by the pressing force acting from the rolling member 72, the operation shaft body 95 is displaced, while being rotated in a direction along the reset guide inclined surface 935 of the reset member 93 (reference numeral M). Furthermore, concurrently, the operation shaft body 95 is rotated and displaced in a trace shown by reference numeral J, whereby the inclined surface 957 of the second protrusion 956 of the operation shaft body 95 comes into contact with the first guide inclined surface 942 of the push latch protrusion 941 of the cylinder body 94 (FIG. 31C).

Furthermore, by the pressing force acting from the rolling member 72, the operation shaft body 95 is displaced, while being rotated in a direction along the first inclined surface 942 of the push latch protrusion 941 of the cylinder body 94. As a result, the four second protrusions 956 of the operation shaft body 95 enter the portion between the push latch protrusions 941 of the cylinder body 94 (reference numeral L). Herein, the operation shaft body 95 has four second protrusions 956 formed at positions corresponding to the operation direction E with respect to the four first protrusions 953. Furthermore, the reset member 93 has reset protrusions 934 formed at positions corresponding to the operation direction E with respect to the push latch protrusions 941 of the cylinder body 94. Thus, in the state in which the four second protrusions 956 of the operation shaft body 95 enter between the push latch protrusions 941 of the cylinder body 94, the four first protrusions 953 of the operation shaft body 95 enter between the reset protrusions 934 of the reset member 93 (reference numeral L). In this state, the atmosphere opening valve unit 70 enters the closed state (FIG. 31D). When the reset cam 844 is separated from the reset operation portion 931 of the reset member 93, the reset member 93 is displaced in the press direction E2 by the pressing force of a press unit (not shown) (FIG. 31E).

Next, a reset motion in the closed state of the atmosphere opening valve unit 70 will be described with reference to FIGS. 31E to 31G.

In the state in which the four second protrusions 956 of the operation shaft body 95 enter between the push latch protrusions 941 of the cylinder body 94, the atmosphere opening valve unit 70 is in the closed state. Furthermore, in this state, the four first protrusions 953 of the operation shaft body 95 enter between the reset protrusions 934 of the reset member 93 (FIG. 31E).

When the reset cam 844 formed on the rotating body 84 is engaged with the reset operation portion 931 of the reset member 93 from this state, the reset member 93 is displaced in the pushing movement direction E1. However, at this time, the reset protrusions 934 of the reset member 93 merely enter between the first protrusions 953 of the operation shaft body 95 (FIG. 31F). For that reason, the operation shaft body 95 is not pushed in the pushing movement direction E1 by the reset protrusions 934 of the reset member 93. That is, in the closed state of the atmosphere opening valve unit 70, even if the reset member 93 is moved back and forth in the operation direction E, the reset protrusion 934 merely resonates between the first protrusions 953 of the operation shaft body 95. Thus, the operation shaft body 95 is not displaced in the pushing movement direction E1, and the closed state of the atmosphere opening valve unit 70 is not changed. When the reset cam 844 is separated from the reset operation portion 931 of the reset member 93, the reset member 93 is displaced in the press direction E2 by the pressing force of a press unit (not shown) (FIG. 31G).

In this manner, according to the push latch mechanism portion 90 equipped with "reset mechanism", in the opened state of the atmosphere opening valve unit 70, by the reset motion due to the pushing movement operation of the reset operation portion 931, the atmosphere opening valve unit 70 can be forcibly transited to the closed state. On the other hand, in the closed state of the atmosphere opening valve unit 70, even if the pushing movement operation of the reset operation portion 931 is performed, the closed state of the atmosphere opening valve unit 70 is not changed. That is, when the reset motion by the pushing movement operation of the reset operation portion 931 is performed, it is assured that the atmosphere opening valve unit 70 is always in the closed state.

For example, in cases where a blackout occurs during opening and closing motion of the atmosphere opening valve unit 70 or a power supply socket of the ink jet printer 1 which is in the power supply ON state is abruptly pulled out, there is a possibility that the open and closed state of the atmosphere opening valve unit 70 cannot be distinguished. Thus, for example, if the reset motion by the reset mechanism is adapted to be uniformly performed during power supply input of the ink jet printer 1, the control can necessarily begin from the closed state of the atmosphere opening valve unit 70. As a result, it is possible to accurately specify the open and closed state of the atmosphere opening valve unit 70 in every case, without providing a sensor capable of detecting the open and closed state of the atmosphere opening valve unit 70.

Configuration of Driving Force Transmission Mechanism 80

A configuration of a driving force transmission mechanism 80 will be described with reference to FIGS. 32 to 37.

Figure 32:
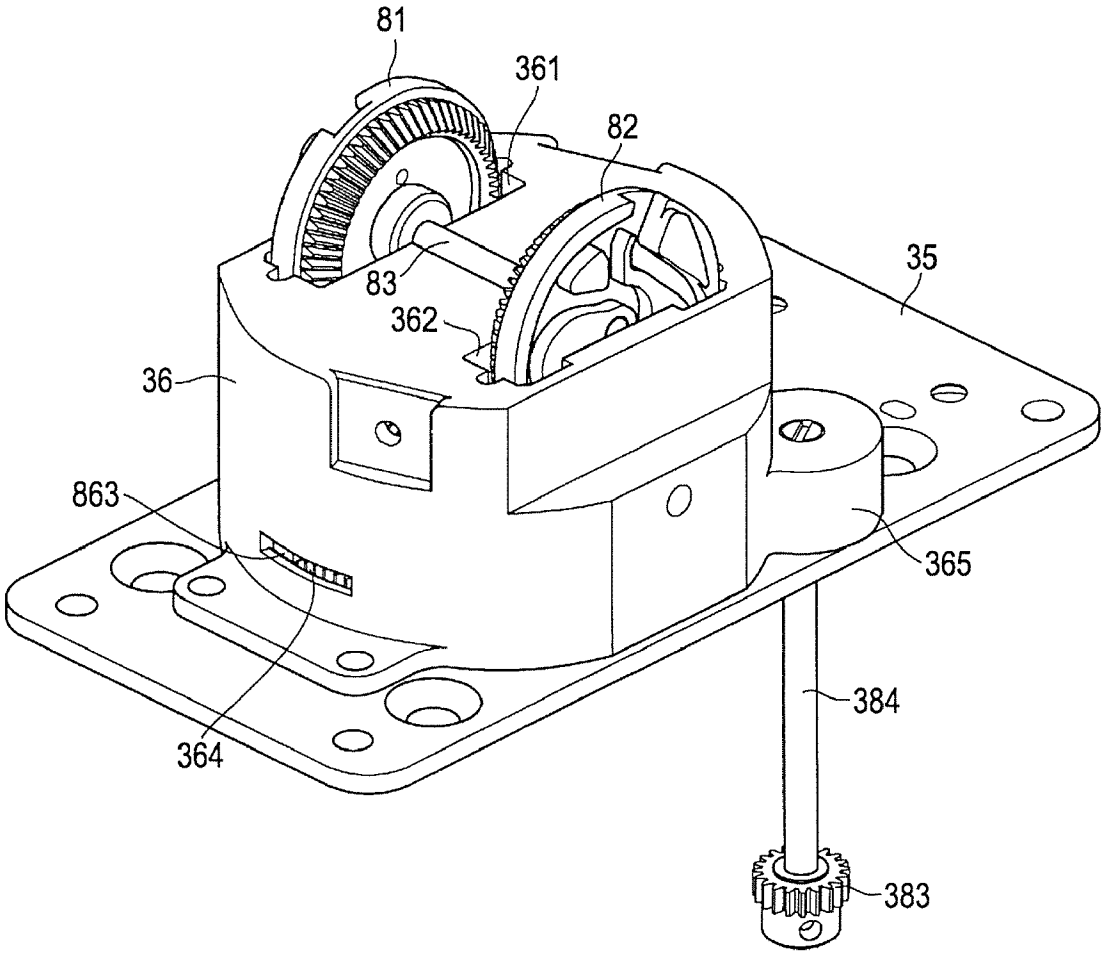
FIG. 32 is an excerpt perspective view showing a portion where a driving force transmission mechanism is provided.
Figure 33:
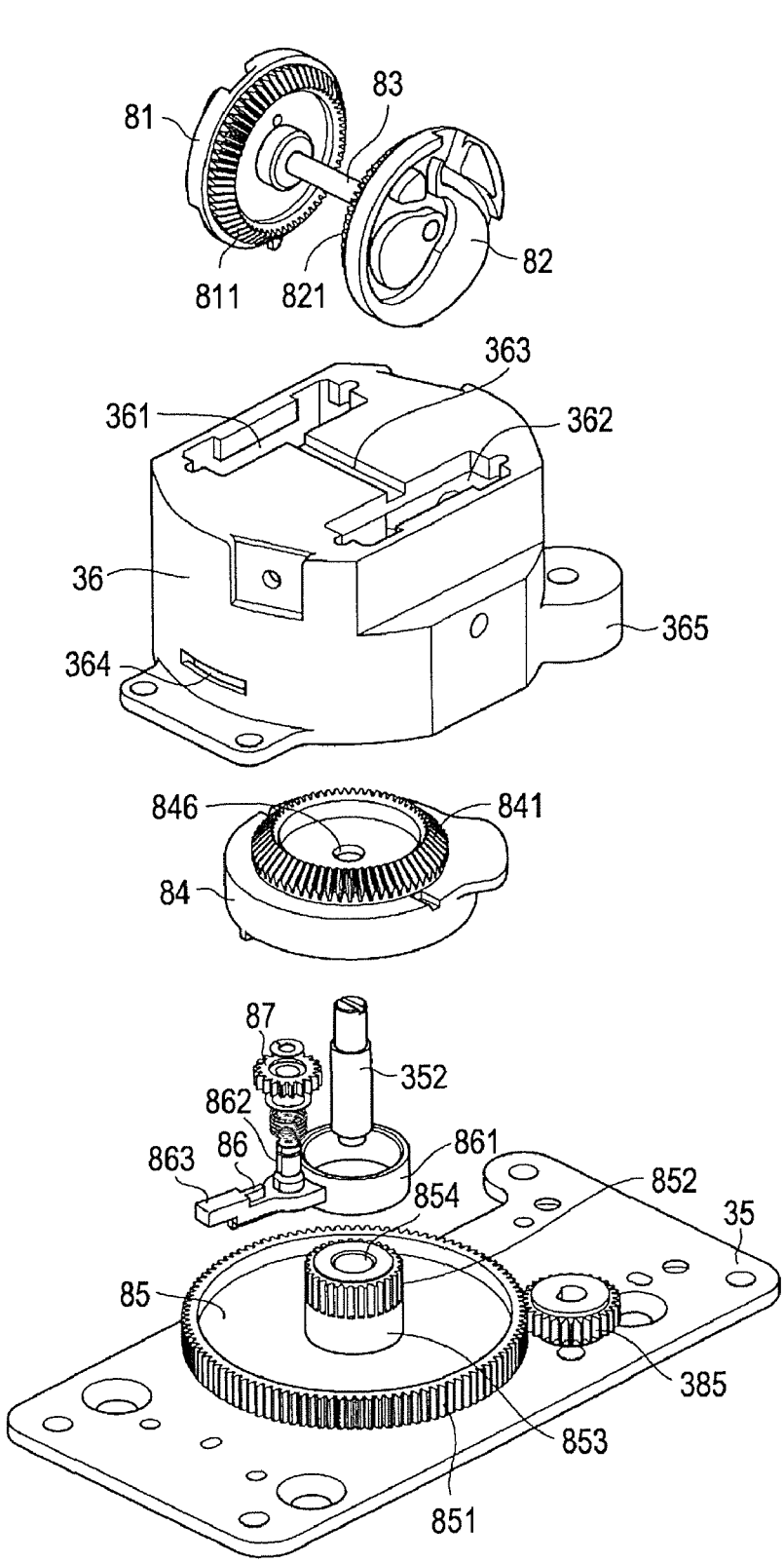
FIG. 33 is an exploded perspective view of a portion where a driving force transmission mechanism of a maintenance unit is provided.
Figure 34:
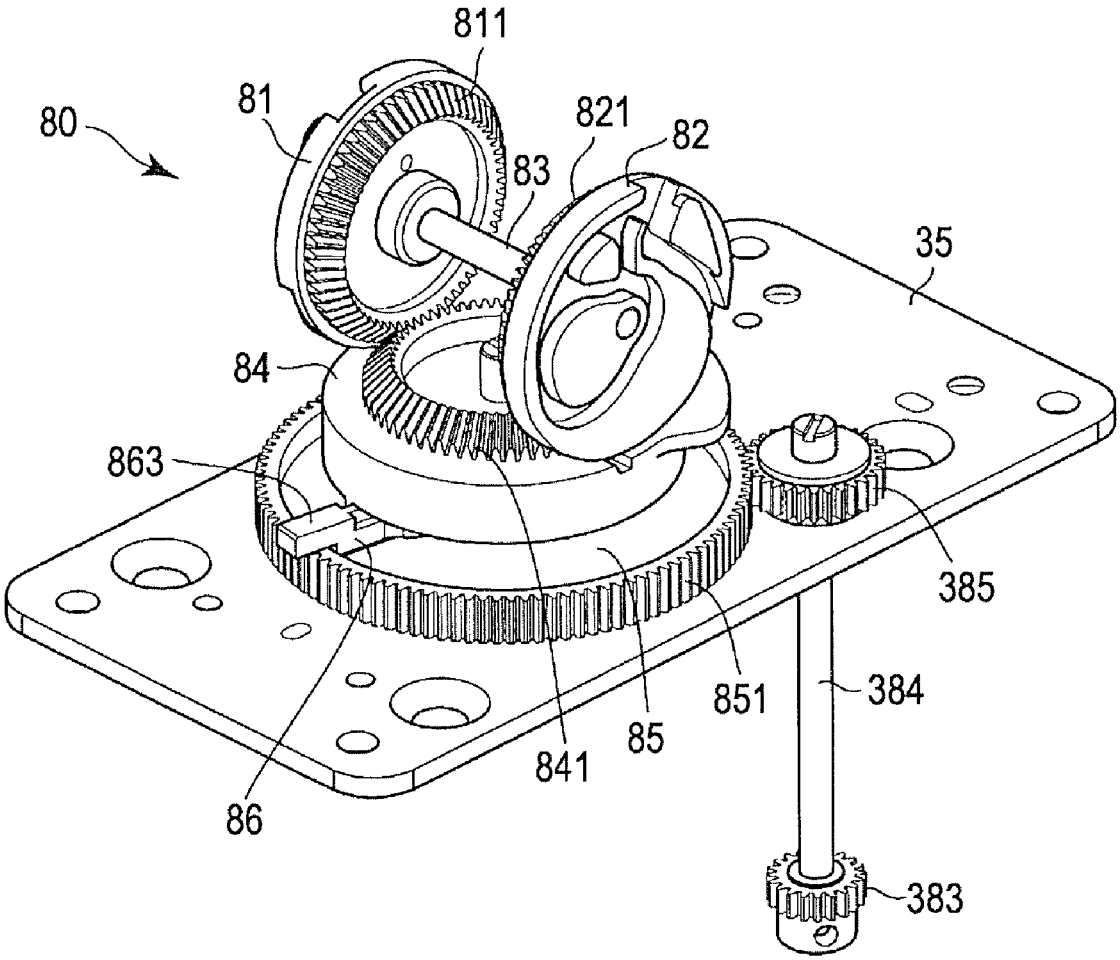
FIG. 34 is a perspective view of a driving force transmission mechanism.
Figure 35:
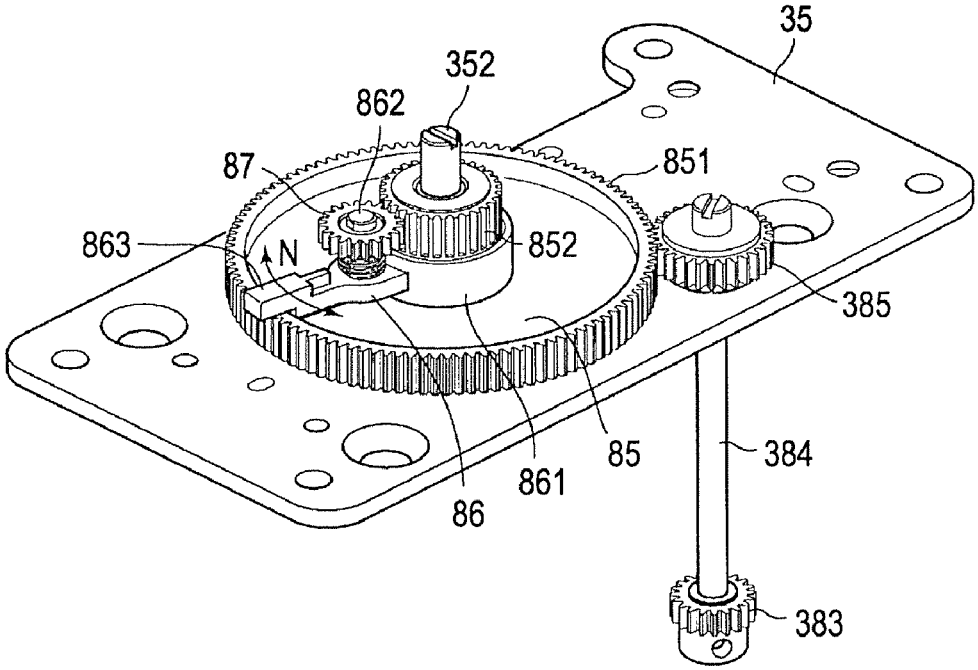
FIG. 35 is a perspective view showing a planetary gear mechanism portion of a driving force transmission mechanism.
Figure 36:
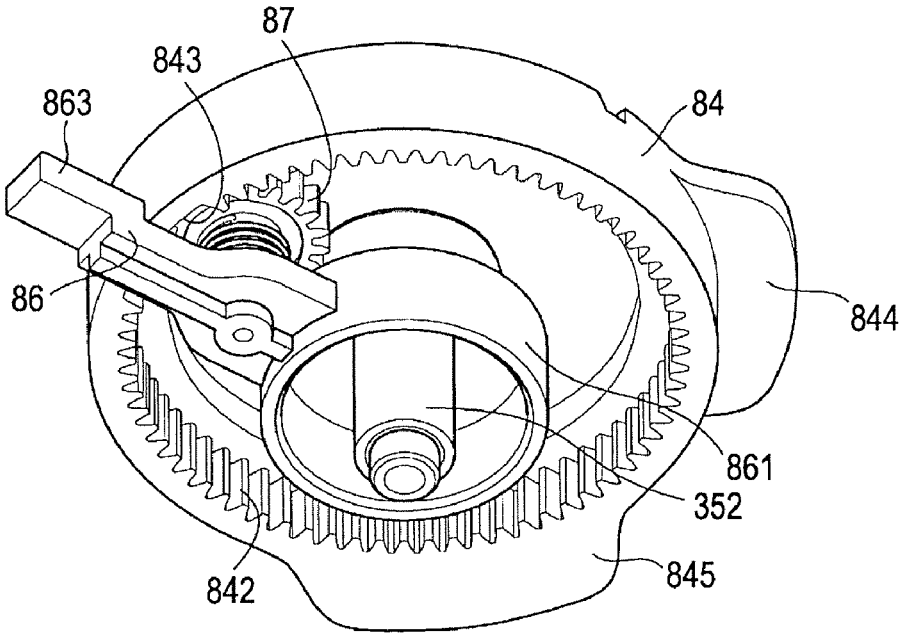
FIG. 36 is a perspective view of an engagement structure of an intermittence gear portion of a rotating body and a planetary gear.
Figure 37:
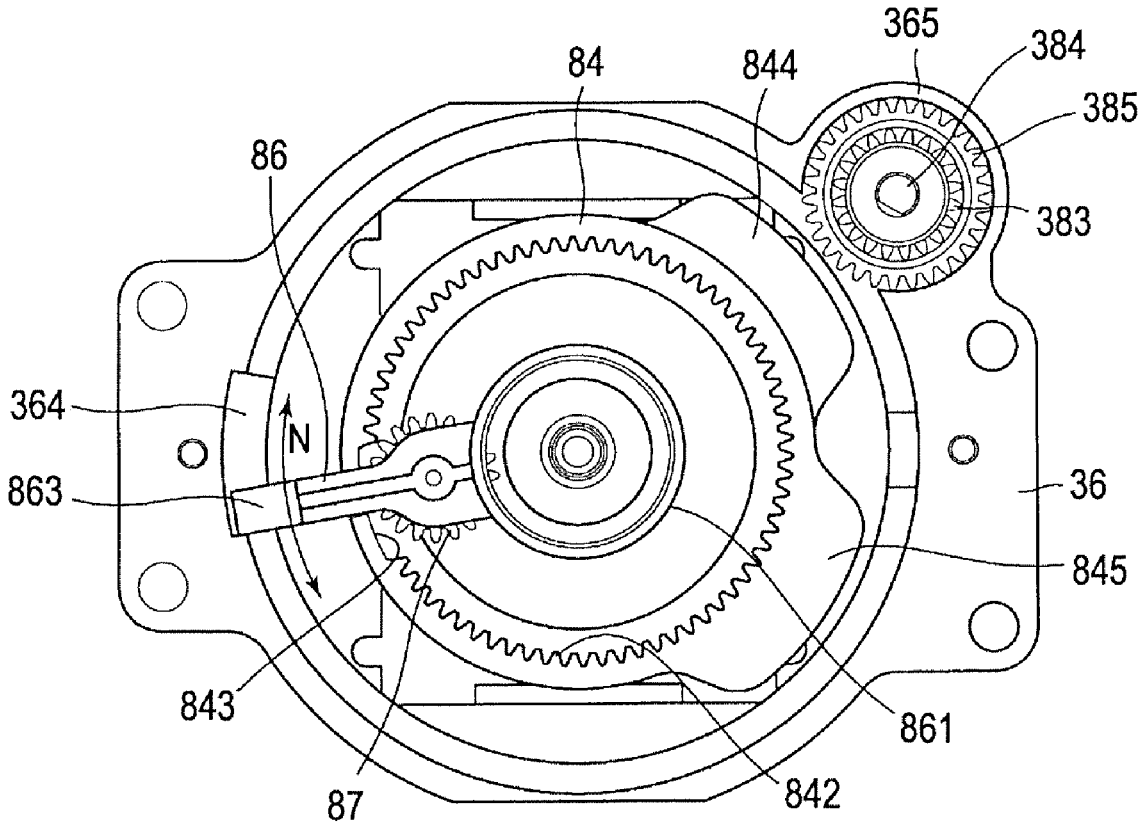
FIG. 37 is a bottom view of an engagement structure of an intermittence gear portion of a rotating body and a planetary gear.

FIG. 32 is an excerpt perspective view showing a portion where the driving force transmission mechanism 80 of the maintenance unit 3 is provided. FIG. 33 is an exploded perspective view of a portion where the driving force transmission mechanism 80 of the maintenance unit 3 is provided. FIG. 34 is the perspective view of a driving force transmission mechanism 80. FIG. 35 is a perspective view showing a planetary gear mechanism portion of the driving force transmission mechanism 80. FIG. 36 is a perspective view showing an engagement structure of an intermittence gear portion 842 and a planetary gear 87 of a rotating body 84. FIG. 37 is a bottom view thereof.

The driving force transmission mechanism 80 provided in the unit base portion 30 has mechanisms (the drive gear 381 and the pump gear 371) that transmit the driving force of the maintenance unit motor 38 to the suction pump 37 as described above (see FIG. 6). In addition, the driving force transmission mechanism 80 has the rotating body 84, the sun gear 85, and planetary lever 86 and the planetary gear 87 as mechanisms for operating the left cam structure 81 and the right cam structure 82 described above and the atmosphere opening valve unit 70 by the driving force of the maintenance unit motor 38.

The cam shaft 83 that pivotally supports the left cam structure 81 and the right cam structure 82 so as to be independently rotatable is fixedly provided on the support portion constituted by a part of the support groove 363 of the cover member 36 and the base member 39 forming the unit base portion 30. The left cam structure 81 is disposed at a position becoming the state in which lower half thereof enters the hole 361 formed in the cover member 36, and the right cam structure 82 is disposed at a position becoming the state in which lower half thereof enters the hole 362 formed in the cover member 36. The gear portion 811 of the left cam structure 81 and the gear portion 821 of the right cam structure 82 are engaged with the cam drive gear portion 841 of the rotating body 84 disposed inside the cover member 36. The gear portion 811 of the left cam structure 81, the gear portion 821 of the right cam structure 82, and the cam drive gear portion 841 of the rotating body 84 have an approximately cone shape and is a so-called bevel gear in which teeth are carved on the circumferential surface of the cone portion.

The sun gear 85 is a two-stage gear that has a first gear portion 851 in which the teeth are formed on the outer peripheral surface thereof, and a second gear portion 852 in which the teeth are formed on the outer peripheral surface of the bearing portion 854. The sun gear 85 is pivotally supported on the support shaft 352 in the state the support shaft 352 standing on the support plate 35 constituting the unit base portion 30 is inserted into the bearing portion 854. The first gear portion 851 of the sun gear 85 is engaged with the gear 385 accommodated and disposed in a gear accommodation portion 365 of the cover member 36. That is, the driving force of the maintenance unit motor 38 is transmitted to the sun gear 85 via the gear 383, the rotation transmission shaft 384 and the gear 385, whereby the sun gear 85 is rotated.

The planetary lever 86 is supported by the bearing portion 854 of the sun gear 85 so as to roll in the rolling direction V in the state in which the arm support member 853 (a portion where the teeth are not formed on the outer peripheral surface of the bearing 854) of the sun gear 85 is inserted into the cylinder portion 861. An arm portion 863 protrudes from the cylinder portion 861 of the planetary lever 86. The front end portion of the arm portion 863 is engaged with a rolling regulation hole 364 formed at a corresponding position of the cover member 36, so that the rolling range of the planetary lever 86 is limited in a certain range.

The planetary gear 87 is pivotally supported by the shaft portion 862 formed in the arm portion 863 of the planetary lever 86, and is engaged with the second gear portion 852 of the sun gear 85.

The rotating body 84 is pivotally supported by the support shaft 352 in the state in which the upper part of the support shaft 352 is inserted into the bearing hole 846. On the surface of the rotating body 84, there is formed the cam drive gear portion 841 (cam drive gear) described above that is engaged with the gear portion 811 of the left cam structure 81 and the gear portion 821 of the right cam structure 82. Furthermore, on the inner peripheral surface of the rotating body 84, there is formed the intermittence gear portion 842 that is engaged with the planetary hear 87 in the range in which the teeth are formed. Moreover, on the outer peripheral surface of the rotating body 84, the reset cam 844 and the push latch cam 845 engaged with the push latch mechanism portion 90 described above are formed at steps in the Z direction at the position of not being overlapped in the circumferential direction.

In the driving force transmission mechanism 80 of this configuration, in the state in which the intermittence gear portion 842 of the rotating body 84 is engaged with the planetary gear 87 in a range (range of about 350 times in the present embodiment) in which the teeth are formed, the rotation of the sun gear 85 is transmitted to the intermittence gear portion 842 via the planetary gear 87, whereby the rotating body 84 is rotated. In addition, when the rotating body 84 is rotated up to a position where the intermittence portion 843 (a portion without the teeth) of the intermittence gear portion 842 reach the planetary gear 87, the planetary gear 87 enters a idling state. Thus, even if the sun gear 85 is rotated by the driving force of the maintenance unit motor 38, the rotating body 84 is not rotated. Furthermore, from the state, when reversing the rotation direction of the sun gear 85, the planetary lever 86 rolls in a rotation direction after the reverse in a certain rolling range (rolling range regulated by the rolling regulation hole 364), so that the planetary gear 87 is engaged with the portion formed with the teeth of the intermittence gear portion 842. As a result, the rotation of the sun gear 85 is transmitted to the intermittence gear portion 842 via the planetary gear 87, so that the rotating body 84 is rotated.

Motion of Driving Force Transmission Mechanism 80

A motion of the driving force transmission mechanism 80 will be described with reference to FIG. 38.

Figure 38:
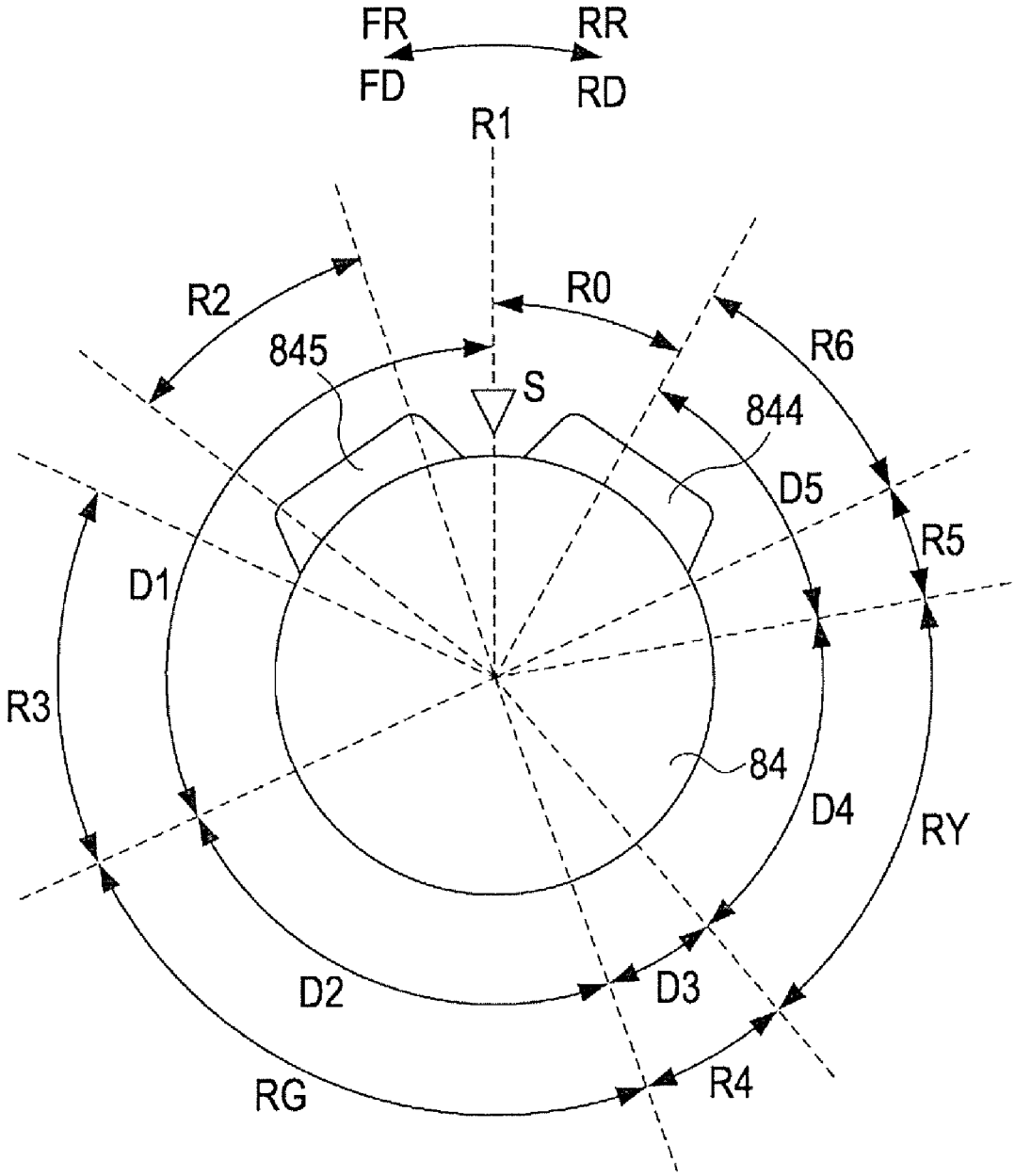
FIG. 38 is a motion explanation diagram showing a motion state of a maintenance unit.

FIG. 38 is a motion explanation diagram that shows the motion state of the maintenance unit 3 to correspond to the rotation position of the rotating body 84.

Here, reference numerals R0 to R6 show the rotation positions or the rotation ranges of the rotating body 84 based on a standard point S. The standard point S coincides with the positions of the push operation portion 921 and the reset operation portion 931 of the push latch mechanism portion 90. Furthermore, reference numerals D1 to D5 show the rotation range of the rotating body 84 based on the standard point S. The rotation ranges D1 to D5 show the rotation ranges D1 to D5 of the right cam structure 82 shown in FIG. 19 to correspond to the rotation range of the rotating body 84 (although t is not shown, the same is also true for the left cam structure 81).

The maintenance unit 3 is configured so that, when rotating the maintenance unit motor 38 forward (CW), the rotating body 84 is rotated in the forward rotation direction FR, and when rotating the maintenance unit motor 38 reversely (CCW), the rotating body 84 is rotated in the reverse rotation direction RR. In addition, when the rotating body 84 is rotated in the forward rotation direction FR, both of the left cam structure 81 and the right cam structure 82 are rotated in the forward rotation direction FD, and when the rotating body 84 is rotated in the reverse rotation direction RR, both of the left cam structure 81 and the right cam structure 82 are rotated in the reverse rotation direction RD.

The rotation range R0 corresponds to the intermittence portion 843 of the intermittence gear portion 842. That is, the rotation range R0 is a range in which the planetary gear 87 is not engaged with the intermittence gear portion 842 but the planetary gear 87 idles (hereinafter, referred to as "revolution range R0"). Thus, in the idling range R0, even if the sun gear 85 is rotated by the driving force of the maintenance unit motor 38, the rotating body 84 is not rotated. That is, in the idling range R0, the state, in which the suction pump 37 continues to operate by the driving force of the maintenance unit motor 38 whereas the rotation of the rotating body 84 is stopped, is maintained.

The rotation position R1 is a rotation position in which the planetary gear 87 begins to idle when rotating the rotating body 84 in the forward rotation direction FR and becomes a starting point of the idling range R0 in the forward rotation direction FR. That is, when continuously rotating the sun gear 85 in the rotation direction in which the rotating body 84 rotates in the forward rotation direction FR, after the rotation position R1 reaches the standard point S, the planetary gear 87 idles and the rotating body 84 is not rotated in the forward rotation direction FR more than that (hereinafter, referred to as "revolution starting position R1").

The rotation ranges R2 to R6 are set in the rotation range other than the idling range R0, that is, the range in which the planetary gear 87 is engaged with the intermittence gear portion 842, whereby the rotating body 84 can be rotated.

The rotation range R2 is a rotation range capable of opening and closing the atmosphere opening valve unit 70. That is, in the rotation range R2, the push operation portion 921 of the push latch mechanism portion 90 is engaged with the push latch cam 845, whereby the push member 92 is pushed (hereinafter, referred to as "push operation range R2"). In addition, in the idling starting position R1 or the rotation range R3 adjacent to the push operation range R2, the push latch cam 845 is separated from the push operation portion 921 of the push latch mechanism portion 90. Thus, for example, by rotating the rotating body 84 so as to reciprocate between the push operation range R2 and the rotation range R3, the opening and closing operation of the atmosphere opening valve unit 70 can be performed. Alternatively, even by rotating the rotating body 84 so as to reciprocate between the idling starting position R1 and the push operation range R2, the opening and closing operation of the atmosphere opening valve unit 70 can be performed. Alternatively, even by rotating the rotating body 84 from the idling starting position R1 to the rotation range R3 or from the rotation range R3 to the idling starting position R1, the opening and closing operation of the atmosphere opening valve unit 70 can be performed.

The rotation range R2 and the rotation range R3 correspond to the rotation range D1 of the left cam structure 81 and the right cam structure 82. Thus, in the rotation range R2 and the rotation range R3, the head guide 50 and the wiper unit 60 are maintained in the state of being displaced to the uppermost position in the Z direction (FIG. 20). That is, in the state in which the relative positional relationship of the recording heads 16 and the cap 40 in a direction along the head surface of the recording heads 16 is regulated by the guide portion 51 of the head guide 50, it is possible to bring the sealing portion 42*c* of the cap main body 42 into close contact with the head surface of the recording head 16.

The rotation range RG corresponds to the rotation range D2 of the left cam structure 81 and the right cam structure 82, and is a rotation range in which the head guide 50 is displaced (hereinafter, referred to as "head guide operation range RG"). That is, in the head guide operation range RG, as described above, the wiper unit 60 can move only the head guide 50 up and down (displacement in the Z direction), while maintaining the state of being displaced to the uppermost position in the Z direction (FIG. 21). Furthermore, the head guide operation range RG is set in the range of not being overlapped with the push operating range R2, only the head guide 50 can be moved up and down while maintaining the open and closed state of the atmosphere opening valve unit 70. Moreover, in the head guide operation range RG, by moving only the head guide 50 up and down, as described above, it is possible to perform the cleaning motion of the first wiper 63 by the wipe cleaner 58.

The rotation range R4 corresponds to the rotation range D3 of the left cam structure 81 and the right cam structure 82. That is, in the rotation range R4, as described above, the state in which the first wiper 63 protrudes from the guide portion 51 of the head guide 50 to the recording heads 16 side is maintained (FIG. 22). In this state, as described above, it is possible to wipe the head surface of the recording paper 16 by the first wiper 63 (hereinafter, referred to as "wiping implementation range R4").

The rotation range RY corresponds to the rotation range D4 of the left cam structure 81 and the right cam structure 82, and is a rotation range in which the wiper unit 60 is displaced (hereinafter, referred to as "wiper operation range RY"). That is, in the wiper operation range RY, as described above, the head guide 50 can move only the wiper unit 60 up and down (displacement in the Z direction), while maintaining the state of being displaced to the lowermost position in the Z direction. Furthermore, since the wiper operation range RY is set in the range of not being overlapped with any of the push operating range R2 and the head guide operation range RG, only the wiper unit 60 can be moved up and down, while maintaining the open and closed state of the atmosphere opening valve unit 70. Moreover, in the wiper operation range RY, by moving only the wiper unit 60 up and down, as described above, it is possible to perform the cleaning motion of the first wiper 63 by the wipe cleaner 58.

The rotation range R5 corresponds to the rotation range D5 of the left cam structure 81 and the right cam structure 82. That is, in the rotation range R5, as described above, the absorbent material surface 411 of the cap 40 protrudes from the protrusion end of the guide portion 51 of the head guide 50 and the front end 631 of the first wiper 63 to the head surface side of the recording heads 16 (FIG. 9B). That is, it is possible to maintain the gap between the head surface of the recording heads 16 and the absorbent material surface 411 of the cap 40 at a gap suitable for the flushing, thereby performing the flushing (hereinafter, referred to as "recording implementation range R5"). That is, in order to perform the recording on the recording paper P, the rotating body 84 may be rotated up to the recording implementation range R5 (up to the position where the standard point S is within the recording implementation range R5).

The rotation range R6 is a rotation range that is capable of resetting the latch of the push latch mechanism portion 90 to make the atmosphere opening valve unit 70 a forcibly closed state (hereinafter, referred to as "reset operation range R6"). That is, in the reset operation range R6, the reset operation portion 931 of the push latch mechanism portion 90 is engaged with the reset cam 844 and the reset member 93 is pushed. In addition, in the recording implementation range R5 adjacent to the reset operation range R6, the reset cam 844 is separated from the reset operation portion 931 of the push latch mechanism portion 90. Thus, for example, by rotating the rotating body 84 so as to reciprocate between the recording implementation range R5 and the reset operation range R6, the atmosphere opening valve unit 70 can be forcibly closed. Furthermore, the reset operation range R6 is set in the range of not being overlapped with any of the push operation range R2, the head guide operation range RG and the wiper operation range RY. Thus, it is possible to perform the reset operation of the push latch mechanism portion 90 while maintaining the state in which the head guide 50 and the wiper unit 60 are displaced to the lowermost position in the Z direction. In addition, the reset operation range R6 corresponds to the rotation range D5 of the left cam structure 81 and the right cam structure 82. Thus, for example, it is also possible to perform the reset operation of the push latch mechanism portion 90 during recording implementation onto the recording paper P.

Control Order of Head Repairing Apparatus 2

An example of a control order of the head repairing apparatus 2 will be described with reference to FIG. 39. The control order of maintaining the recording heads 16 described later is implemented by the control apparatus 100.

Figure 39:
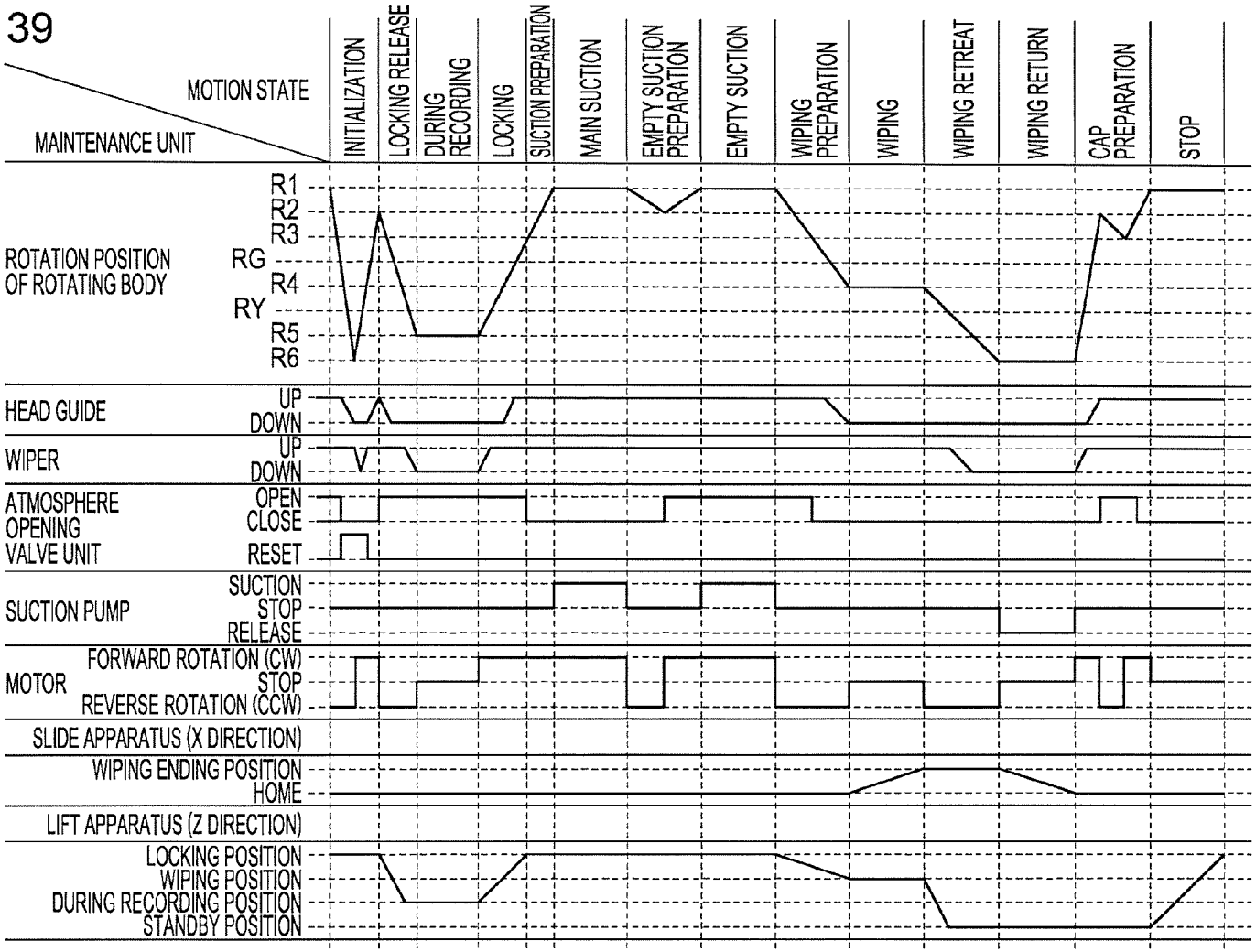
FIG. 39 is a timing chart showing a control order of a head repairing apparatus.

FIG. 39 is a timing chart showing a control order of the head repairing apparatus 2.

In the state in which the power supply of the ink jet printer 1 is OFF, the position of the maintenance unit 3 in the Z direction is in the sealing position, the head surface of the recording surface 16 is sealed by the cap 40, and the atmosphere opening valve unit 70 is closed. After the power supply input of the ink jet printer 1, as an initialization order of the maintenance unit 3, firstly, the reset operation of the push latch mechanism portion 90 is implemented, thereby defining the closed state of the atmosphere opening valve unit 70. This is because the atmosphere opening valve unit 70 is usually in the closed state during power supply OFF control, but in a case where it is in the opened state due to certain cause, there is a possibility that the contents of the opening and closing control of the atmosphere opening valve unit 70 do not coincide with the actual open and closed state.

More specifically, after the power supply input of the ink jet printer 1, firstly, by rotating reversely (CCW) the maintenance unit motor 38, the rotating body 84 is rotated in the reverse rotation direction RR up to the reset operation range R6. As a result, the reset cam 844 is engaged with the reset operation portion 931 of the push latch mechanism portion 90, thereby performing the reset operation of the push latch mechanism portion 90. Furthermore, the reset cam 844 is provided at a position exceeding the reset operation R6 and the idling range R0. Thus, in implementing a certain reset operation, it is desirable that the rotation amount when the maintenance unit motor 38 is rotated reversely (CCW) to rotate the rotating body 84 up to the reset operation range R6 is set at a rotation amount suitable for becoming the idling state in the idling range R0 even if the rotating body is any rotation position.

Furthermore, the reset operation of the push latch mechanism portion 90 can be implemented at any time other than at the time of power supply input of the ink jet printer 1. For example, even during recording implementation or in the maintenance motion of the recording heads 16, when it is judged that there is a possibility that the contents of the opening and closing control of the atmosphere opening valve unit 70 do not coincide with the actual open and closed state, in order to more reliably avoid an erroneous operation, the reset operation of the push latch mechanism portion 90 may be performed again.

After the reset operation of the push latch mechanism portion 90, continuously, the pushing movement operation of the push latch mechanism portion 90 by the push latch cam 845 is implemented only once and the atmosphere opening valve unit 70 is opened. More specifically, by rotating forward (CW) the maintenance unit motor 38, the rotating body 84 is rotated in the forward rotation direction FR up to the push operation range R2. As a result, the push latch cam 845 is engaged with the push operation portion 921 of the push latch mechanism portion 90, whereby the atmosphere opening valve unit 70 enters the opened state. The opened state is maintained by the push latch mechanism portion 90 (motion state: initialization).

Moreover, as described above, the suction pump 37 that is a known tube pump performs the suction motion generating the negative pressure when the maintenance unit motor 38 is rotated forward and is driven, and enters the release state when the maintenance unit motor 38 is reversely rotated and is driven, thereby not generating the negative pressure. Moreover, when the rotation direction of the pump gear 371 is completely switched from the reverse rotation to the forward rotation, a delay is not generated in the rotation transmission by less than one rotation. For this reason, the suction pump 37 is operated only in the state of rotating forward (CW) the maintenance unit motor 38 in the idling starting position R1.

After the initialization of the maintenance unit 3, when implementing the recording onto the recording paper P, firstly, by reversely rotating (CCW) the maintenance unit motor 38, the rotating body 84 is rotated up to the recording implementation range R5. As a result, the absorbent material surface 411 of the cap 40 protrudes from the protrusion end of the guide portion 51 of the head guide 50 and the front end 631 of the first wiper 63 to the head surface side of the recording heads 16. Furthermore, after at least the head guide 50 is displaced to the uppermost position (second displacement position) in the Z direction, the lift apparatus 23 lowers the overall maintenance unit 3 up to during recording position. As a result, the cap 40 is separated from the recording heads 16, so that the sealing of the head surface of the recording heads 16 by the cap 40 can be released. Furthermore, it is possible to set the gap between the head surface of the recording heads 16 and the absorbent material surface 411 of the cap 40 at a gap suitable for the flushing, thereby making it possible to implement the recording onto the recording paper P (motion state: sealing release).

When implementing the main suction motion after implementing the recording onto the recording paper P, firstly, by rotating forward (CW) the maintenance unit motor 38, the rotating body 84 is rotated up to the idling starting position R1. At this time, after the rotation range R3, the state in which both of the head guide 50 and the wiper unit 60 are displaced to the uppermost position in the Z direction is maintained. Thus, it is possible to bring the sealing portion 42*c* of the cap main body 42 into close contact with the head surface of the recording heads 16 in the state in which the relative positional relationship between the recording heads 16 and the cap 40 in the direction along the head surface of the recording heads 16 is regulated by the guide portion 51 of the head guide 50.

In addition, in the process of the rotation of the rotating body 84 up to the idling starting position R1 via the push operation range R2, the pushing movement operation of the push latch mechanism portion 90 by the push latch cam 845 is implemented once, so that the atmosphere opening valve unit 70 is completely switched from the opened state to the closed state (motion state: suction preparation). The closed state is maintained by the push latch mechanism portion 90.

In addition, after the rotating body 84 is rotated up to the rotation range R3, the lift apparatus 23 raises the overall maintenance unit 3 up to the sealing position. As a result, the sealing portion 42*c* of the cap main body 42 comes into contact with and close contact with the head surface of the recording heads 16 (motion state: sealing). By continuously rotating forward (CW) the maintenance unit motor 38 from that state, the suction pump 37 is operated and main suction motion (a suction motion in the closed state of the atmosphere opening valve unit 70) is implemented. At this time, since the planetary gear 87 idles, the rotating body 84 is maintained in the state of being stopped at the idling starting position R1 (motion state: main suction).

Furthermore, in the present embodiment, in the closed state of the atmosphere opening valve unit 70, the sealing portion 42*c* of the cap main body 42 is brought into close contact with the head surface of the recording heads 16, but it is considered that a fluctuation in pressure enough to destroy the meniscus hardly acts on the head surface of the recording heads 16. However, in extremely reducing the possibility of the meniscus destruction due to the fluctuation in pressure, for example, after first opening the atmosphere opening valve unit 70, the sealing portion 42*c* of the cap main body 42 is brought into close contact with the head surface of the recording heads 16, and then the atmosphere opening valve unit 70 may be switched to the closed state to implement the main suction motion.

After implementing the main suction motion, the suction motion can be continuously implemented while maintaining the state of sealing the head surface of the recording heads 16 by the cap 40. Firstly, by rotating reversely (CCW) the maintenance unit motor 38, the rotating body 84 is rotated up to the push operation range R2. Next, by rotating forward (CW) the maintenance unit motor 38, the rotating body 84 is rotated up to the idling starting position R1 again. As a result, the pushing movement operation of the push latch mechanism portion 90 by the push latch cam 845 is implemented once, whereby the atmosphere opening valve unit 70 is completely switched from the closed state to the opened state (motion state: empty suction preparation). The opened state is maintained by the push latch mechanism portion 90. By continuously rotating forward (CW) the maintenance unit motor 38 from that state, the suction pump 37 is operated to implement the empty suction motion (suction motion in the opened state of the atmosphere opening valve unit 70). At this time, since the planetary gear 87 idles, the rotating body 84 is maintained in the state of being stopped at the idling starting position R1 (motion state: empty suction).

When implementing the main suction motion again after the implementation of the empty suction motion, by rotating reversely (CCW) the maintenance unit motor 38, the rotating body 84 is rotated up to the push operation range R2, and the maintenance unit motor 38 is further rotated forward (CW), whereby the rotating body 84 may be rotated up to the idling starting position R1 again. As a result, it is possible to switch the atmosphere opening valve unit 70 of the opened state to the closed state again, while maintaining the state of sealing the head surface of the recording heads 16 by the cap 40. That is, the maintenance unit 3 according to an aspect of the invention can alternately switch the state capable of performing the main suction motion and the state capable of performing the empty suction motion, by rotating the rotating body 84 so as to reciprocate between the idling starting position R1 and the push operation range R2. Thus, it is possible to repeatedly perform the main suction motion and the empty suction motion only by necessary number as necessary. Furthermore, after the recording implementation onto the recording paper P, in a case where the main suction motion and the empty suction motion do not need to be performed, if the rotating body 84 does not rotate up to the idling starting position R1, the wiping described later can be implemented without performing the main suction motion and the empty suction motion.

After the recording implementation onto the recording paper P, after implementing the main suction motion and the empty suction motion as necessary, the wiping can be implemented. Firstly, by rotating reversely (CCW) the maintenance unit motor 38, the rotating body 84 is rotated up to the wiping implementation range R4. As a result, the first wiper 63 protrudes from the guide portion 51 of the head guide 50 to the recording heads 16 side. At this time, in the process of the rotation of the rotating body 84 from the idling starting position R1 to the wiping implementation range R4, the pushing movement operation of the push latch mechanism portion 90 by the push latch cam 845 is implemented once, whereby the atmosphere opening valve unit 70 is completely switched from the opened state to the closed state.

Furthermore, in the process of the rotation of the rotating body 84 from the idling starting position R1 to the wiping implementation range R4, when the head guide 50 drops in the head guide operation range RG, the wiper cleaner 58 comes into slide contact with the portion from the front end 631 of the first wiper 63 to the side surface thereof, thereby performing the cleaning motion of the first wiper 63 before the wiping. Since this time is a step before performing the wiping, it is considered that the ink is hardly attached to the first wiper 63. However, a part of the foreign matter such as the paper powder or the dust generated during recording implementation onto the recording paper P sometimes floats and is attached to the first wiper 63. In addition, when the foreign matter such as the paper powder or the dust attached to the first wiper 63 is attached to the head surface 16 during wiping, it becomes a factor of the blockage of the ink ejecting nozzle or the like. That is, the cleaning motion of the first wiper 63 performed before the wiping has the significance in that mainly, the foreign matter such as the paper powder or the dust attached to the first wiper 63 can be removed before the wiping.

In addition, after the head guide 50 is displaced to the uppermost position (second displacement position) in the Z direction, the lift apparatus 23 moves the overall maintenance unit 3 up to the wiping position (motion state: wiping preparation). The wiping position is set between the sealing position and the during recording position, and is a position where the front end 631 of the first wiper 63 can come into slide contact with the head surface of the recording heads 16. From this state, by displacing the overall maintenance unit 3 from the home position to the wiping ending position in the X direction by the slide apparatus 22, the wiping that brings the front end 631 of the first wiper 63 into slide contact with the head surface of the recording heads 16 is implemented. As a result, the affixed matter attached to the head surface of the recording heads 16 can be removed (motion state: wiping).

After implementing the wiping, by rotating reversely (CCW) the maintenance unit motor 38, the rotating body 84 is rotted up to the recording implementation range R6. As a result, the wiper unit 60 is displaced from the uppermost position in the Z direction to the lowermost position, and in that process, the wiper cleaner 58 comes into slide contact with the portion from the front end 631 of the first wiper 63 to the side surface thereof, thereby performing a first cleaning motion of the first wiper 63 after the wiping (motion state: wiper retreat to wiper return). A main object of the cleaning motion after the wiping is to remove the ink attached to the first wiper 63. Furthermore, after implementing, the overall maintenance unit 3 is displaced up to the home position in the X direction by the slide apparatus 22, and the overall maintenance unit 3 is lowered up to the standby position by the lift apparatus 23.

After implementing a series of the wiping order, when the head surface of the recording heads 16 is transited to a stop state of being sealed with the cap 40, the following order may be implemented. Firstly, by rotating forward (CW) the maintenance unit motor 38, the rotating body 84 is rotated up to the push operation range R2. After the maintenance unit motor 38 is rotated reversely (CCW) from that, so that the rotating body 84 is rotated up to the rotation range R3, the maintenance unit motor 38 is rotated forward (CW) again, so that the rotating body 84 is rotated up to the idling starting position R1. As a result, the pushing movement operation of the push latch mechanism portion 90 by the push latch cam 845 is implemented twice, so that the atmosphere opening valve unit 70 is completely switched from the closed state to the opened state, and then enters the closed state again. The closed state is maintained by the push latch mechanism portion 90. The reason for the implementation of the operation is that when rotating the rotating body 84 from the recording implementation range R5 to the idling starting position R1 in the closed state of the atmosphere opening valve unit 70, the atmosphere opening valve unit 70 is in the closed state even in the idling starting position R1.

Furthermore, in the process of the rotation of the rotating body 84 from the recording implementation range R5 to the idling starting position R1, when the wiper unit 60 rises in the wiper operation range RY, the wiper cleaner 58 comes into slide contact with the portion from the front end 631 of the first wiper 63 to the side surface thereof, thereby performing a second cleaning motion of the first wiper 63 after the wiping. In addition, when the head guide 50 rises in the head guide operation range RG, the wiper cleaner 58 comes into slide contact with the portion from the front end 631 of the first wiper 63 to the side surface thereof again, thereby performing a third cleaning motion of the first wiper 63 after the wiping.

In this manner, the cleaning motion of the first wiper 63 can be performed several times without generating unnecessary motion during the series of maintenance motions. As a result, it is possible to reduce the concern that all of the affixed matters attached to the first wiper 63 cannot be removed, without decreasing the throughput of the ink jet printer 1. Furthermore, the cleaning motion of the first wiper 63 performed before the wiping can mainly remove the foreign matter such as the paper powder and the dust attached to the first wiper 63 before the wiping. On the other hand, the cleaning motion of the first wiper 63 performed after the wiping can mainly remove the ink attached to the first wiper 63. That is, various affixed matters attached to the first wiper 63 can be reasonably removed by the cleaning motion before and after the wiping, which can further reduce the concern that the all of the affixed matters attached to the first wiper 63 cannot be removed.

After the rotation range R3, the state in which both of the head guide 50 and the wiper unit 60 are displaced to the uppermost position in the Z direction is maintained. As a result, it is possible to bring the sealing portion 42*c* of the cap main body 42 into close contact with the head surface of the recording heads 16, in the state in which the relative positional relationship between the recording heads 16 and the cap 40 in the direction along the head surface of the recording heads 16 is regulated by the guide portion 51 of the head guide 50 (motion state: cam preparation). In addition, after the rotating body 84 is rotated up to the rotation range R3, the lift apparatus 23 raises the overall maintenance unit 3 up to the sealing position. As a result, the sealing portion 42*c* of the cap main body 42 comes into slide contact with the head surface of the recording heads 16, whereby the head surface of the recording heads 16 is sealed with the cap 40 (motion state: stop).

The head repairing apparatus 2 according to an aspect of the invention has a configuration in which the driving of the suction pump 37, the open and closed of the atmosphere opening valve unit 70, the movement of the first wiper 63 can be performed by the driving force of one maintenance unit motor 38, and can flexibly select the main suction motion, the empty suction motion, the wiping, and the combination thereof to implement the maintenance motion.

ANOTHER EMBODIMENT

It is needless to say that the present invention can be variously modified within the scope of the invention described in the claims, without being limited to the embodiment as described above, and those are also included within the scope of the invention.

For example, the present invention can be applied to a so-called serial head type ink jet printer. More specifically, the maintenance unit 3 having the same number as that (usually, one) of the recording head mounted on a carriage may be provided on the pedestal 21 of the head repairing apparatus 2. Furthermore, since in the serial head type ink jet printer, the wiping can be performed by the movement of the carriage, the slide apparatus 22 of the head repairing apparatus 2 may not be provided.

In the above-described embodiments, the ink jet printer is adopted, but a fluid ejecting apparatus for ejecting a fluid other than ink or a fluid container for storing the fluid may be adopted. Various fluid ejecting apparatuses including a fluid ejecting head for ejecting a minute amount of liquid droplet may be adopted. In addition, the liquid droplet indicates the fluid ejected from the fluid ejecting apparatus, and includes a liquid having a particle shape, a tear shape, or a linear shape. Further, here, the fluid may be a material which can be ejected from the liquid ejecting apparatus.

For example, a liquid-state material may be used, and includes a liquid-state material such as sol or gel water having a high or low viscosity, a fluid-state material such as an inorganic solvent, an organic solvent, a liquid, a liquid-state resin, or liquid-state metal (metallic melt), and a material in which a functional material having a solid material such as pigment or metal particle is dissolved, dispersed, or mixed with a solvent in addition to a fluid. In addition, ink or liquid crystal described in the embodiments may be exemplified as a typical example of the fluid. Here, the ink indicates general water-based ink, oil-based ink, gel ink, or hot-melt ink which contains various fluid compositions.

As a detailed example of the fluid ejecting apparatus, for example, a liquid crystal display, an EL (electro-luminance) display, a plane-emission display, a fluid ejecting apparatus for ejecting a fluid containing dispersed or melted materials such as an electrode material or a color material used to manufacture a color filter, a fluid ejecting apparatus for ejecting a biological organic material used to manufacture a biochip, a fluid ejecting apparatus for ejecting a fluid as a sample used as a precise pipette, a silkscreen printing apparatus, or a micro dispenser may be used.

In addition, a fluid ejecting apparatus for ejecting lubricant from a pinpoint to a precise machine such as a watch or a camera, a fluid ejecting apparatus for ejecting a transparent resin liquid such as a UV-curing resin onto a substrate in order to form a minute hemispherical lens (optical lens) used for an optical transmission element or the like, or a fluid ejecting apparatus for ejecting an etching liquid such as an acid liquid or an alkali liquid in order to perform etching on a substrate or the like may be adopted. Further, the invention may be applied to any one of the fluid ejecting apparatuses and a fluid container thereof.

What is claimed is:

1. A head repairing apparatus for repairing a liquid ejecting head of a liquid ejecting apparatus which ejects liquid from a liquid ejecting nozzle provided on a head surface of the liquid ejecting head to a ejection object, comprising:

one or two more maintenance units which are supported by an apparatus base body so as to be displaceable in a predetermined displacement direction becoming a direction intersecting the head surface of the liquid ejecting head, wherein the maintenance units have a unit base portion that is supported by the apparatus base body so as to be displaceable in the displacement direction;

a seal member capable of sealing the head surface of the liquid ejecting head;

a suction pump capable of sucking a suction path that communicates with the sealing surface of the seal member;

an atmosphere communication path in which one side thereof communicates with the sealing surface of the seal member and the other side thereof is opened to atmosphere;

an atmosphere opening valve capable of opening and closing the atmosphere communication path;

a push latch mechanism for performing the opening and closing operation of the atmosphere opening valve;

a push latch cam which is engaged with an operation portion of the push latch mechanism and can perform a pushing movement operation of the operation portion;

a wiper support member which is supported by the unit base portion so as to be displaceable in the displacement direction;

a wiper attached to the wiper support member;

a wiper support member cam which is engaged with the wiper support member to displace the wiper support member in the displacement direction; and a driving force transmission mechanism for transmitting the driving force of a driving force source, wherein the driving force transmission mechanism includes a pump driving force transmission mechanism which transmits the driving force of the driving force source to the suction pump;

a sun gear to which the driving force of the driving force source is transmitted so as to be rotated;

a rolling arm in which a rolling range thereof is limited to a certain range and which is pivotally supported on a rotation axis of the sun gear;

a planetary gear which is rotatably supported by the rolling arm and is engaged with the sun gear; and an intermittence gear which is engaged with the planetary gear in a range in which teeth are formed;

wherein, the push latch cam is provided so as to be rotatable integrally with the intermittence gear, a cam driving gear for rotating the wiper support member cam rotates in connection with the rotation of the intermittence gear, and in a range in which the intermittence gear is engaged with the planetary gear, so that the intermittence gear can be rotated, a rotation range of the intermittence gear capable of opening and closing the atmosphere opening valve by the push latch mechanism and a rotation range of the intermittence gear in which the wiper is displaced by the rotation of the wiper support member cam are set in non-overlapped positions.

2. The head repairing apparatus according to claim 1, wherein the maintenance unit has a reset mechanism capable of resetting a latch of the push latch mechanism, and a reset cam which is provided so as to be rotatable integrally with the intermittence gear and is engaged with the operation portion of the reset mechanism, and wherein the rotation range of the intermittence gear, in which the latch of the push latch mechanism is reset by the reset cam, is set in a position where it is not overlapped with any one of a rotation range of the intermittence gear in which the atmosphere opening valve can be opened and closed by the push latch mechanism and a rotation range of the intermittence gear in which the wiper is displaced by the rotation of the wiper support member cam, within a range in which the intermittence gear is engaged with the planetary gear and the intermittence gear can be rotated.

3. The head repairing apparatus according to claim 2, wherein the maintenance unit has a guide member which is supported by the unit base portion so as to be displaceable in the displacement direction and regulates a relative positional relationship between the liquid ejecting head and the seal member in a direction along the head surface of the liquid ejecting head, in a state of being engaged with the liquid ejecting head; and a guide member cam which is engaged with the guide member to displace the guide member in the displacement direction, and wherein the driving force transmission mechanism is configured so that the cam driving gear rotates the guide member cam, and the rotation range of the intermittence gear in which the guide member is displaced by the rotation of the guide member cam is set at a position where it is not overlapped with any one of a rotation range of the intermittence gear in which the atmosphere opening valve can be opened and closed by the push latch mechanism, a rotation range of the intermittence gear in which the wiper is displaced by the rotation of the wiper support member cam, and a rotation range of the intermittence gear in which the latch of the push latch mechanism can be reset by the reset mechanism, within a range in which the intermittence gear is engaged with the planetary gear, so that the intermittence gear can be rotated.

4. A liquid ejecting apparatus for ejecting liquid from a liquid ejecting nozzle provided on a head surface of a liquid ejecting head to a ejection object including the head repairing apparatus according to claim 1.

* * * * *